US008359716B2

(12) United States Patent
Fiedler

(10) Patent No.: US 8,359,716 B2
(45) Date of Patent: Jan. 29, 2013

(54) MAGNETOMECHANICAL CONNECTION ASSEMBLY WITH LOAD SECURING

(75) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 191 days.

(21) Appl. No.: 12/918,440

(22) PCT Filed: Feb. 22, 2009

(86) PCT No.: PCT/DE2009/000231

§ 371 (c)(1),
(2), (4) Date: Aug. 19, 2010

(87) PCT Pub. No.: WO2009/103279

PCT Pub. Date: Aug. 27, 2009

(65) Prior Publication Data

US 2010/0325844 A1 Dec. 30, 2010

(30) Foreign Application Priority Data

Feb. 21, 2008 (DE) ..... 10 2008 010 273

(51) Int. Cl.
*A44B 11/25* (2006.01)

(52) U.S. Cl. ..... 24/303; 24/662; 24/664; 24/652

(58) Field of Classification Search ..... 63/29.2, 63/900; 24/303, 165, 312, 313, 319, 323, 24/324, 341, 302, 586.1, 652, 653, 656, 657, 24/662, 664, DIG. 51
See application file for complete search history.

(56) References Cited

U.S. PATENT DOCUMENTS

| | | | | | |
|---|---|---|---|---|---|
| 278,346 | A | * | 5/1883 | Long | 439/846 |
| 302,421 | A | * | 7/1884 | Mosier | 24/578.16 |
| 796,414 | A | * | 8/1905 | Chayes | 24/319 |
| 798,253 | A | * | 8/1905 | Basch | 2/306 |
| 1,896,129 | A | * | 2/1933 | Ward | 24/664 |
| 2,615,227 | A | * | 10/1952 | Hornik | 24/303 |
| 2,956,324 | A | * | 10/1960 | Klein | 24/323 |
| 2,959,832 | A | * | 11/1960 | Baermann | 24/303 |
| 3,000,069 | A | * | 9/1961 | Shears | 24/662 |
| 3,293,714 | A | * | 12/1966 | Shafer | 24/303 |

(Continued)

FOREIGN PATENT DOCUMENTS

| | | | |
|---|---|---|---|
| EP | 0907331 | B1 | 9/2003 |
| WO | 2008006357 | A2 | 1/2008 |

(Continued)

*Primary Examiner* — Robert J Sandy
*Assistant Examiner* — Abigail E Morrell
(74) *Attorney, Agent, or Firm* — The Webb Law Firm

(57) ABSTRACT

A connection assembly includes two connecting modules each including a load housing with a locking device, a spring locking element, a latch piece, a magnet and armature construction, and a movement track on which the latch piece can move from a closed position to an open position. The locking device, the magnet and armature construction and the movement track cooperate by way of an opening whereupon the connecting modules move on the movement track such that the magnet and armature move in opposition and the latch piece and the spring locking element move in opposition until the spring locking element is no longer engaged. On closing, the connecting module locks with the aid of magnetic force. The position of the load housing and the position and form of the movement track are such that on moving the connecting module the loading housings move together against a load.

20 Claims, 44 Drawing Sheets

U.S. PATENT DOCUMENTS

| | | | | |
|---|---|---|---|---|
| 3,979,801 | A * | 9/1976 | Tareau | 24/587.12 |
| 4,231,137 | A * | 11/1980 | Fujimoto | 24/303 |
| 4,578,843 | A * | 4/1986 | Lewis | 24/579.09 |
| 5,311,647 | A * | 5/1994 | Levy | 24/303 |
| 5,349,725 | A * | 9/1994 | Levy | 24/303 |
| 5,664,298 | A | 9/1997 | Nessar-Ivanovic | |
| 5,671,516 | A * | 9/1997 | Sartori | 24/652 |
| 6,292,985 | B1 * | 9/2001 | Grunberger | 24/303 |
| 6,505,385 | B2 * | 1/2003 | Grunberger | 24/303 |
| 6,606,767 | B2 * | 8/2003 | Wong | 24/303 |
| 6,857,169 | B2 * | 2/2005 | Chung | 24/303 |
| 2002/0116794 | A1 * | 8/2002 | Hoffman | 24/303 |
| 2003/0229974 | A1 * | 12/2003 | Zemer et al. | 24/303 |
| 2004/0107547 | A1 * | 6/2004 | Chung | 24/303 |
| 2010/0283269 | A1 | 11/2010 | Fiedler | |

FOREIGN PATENT DOCUMENTS

| | | | |
|---|---|---|---|
| WO | 2009010049 | A2 | 1/2009 |

* cited by examiner 1
70b
70a
71a
71b
2
A
A
$F_L$
51
1
9
9a
60
2
52
70a
5a
X
Y
A–A
51
4
9'
9b
70b
8
9
9a
70a
52

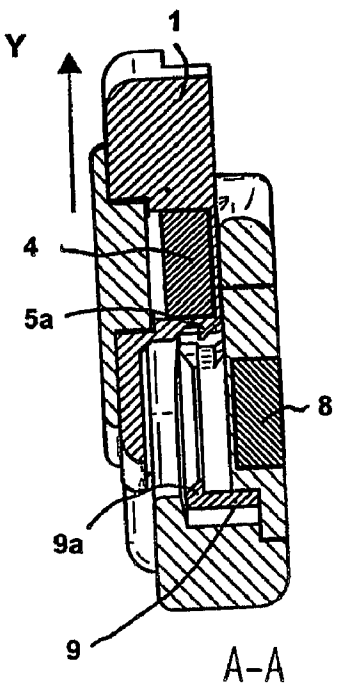
Fig. 6d
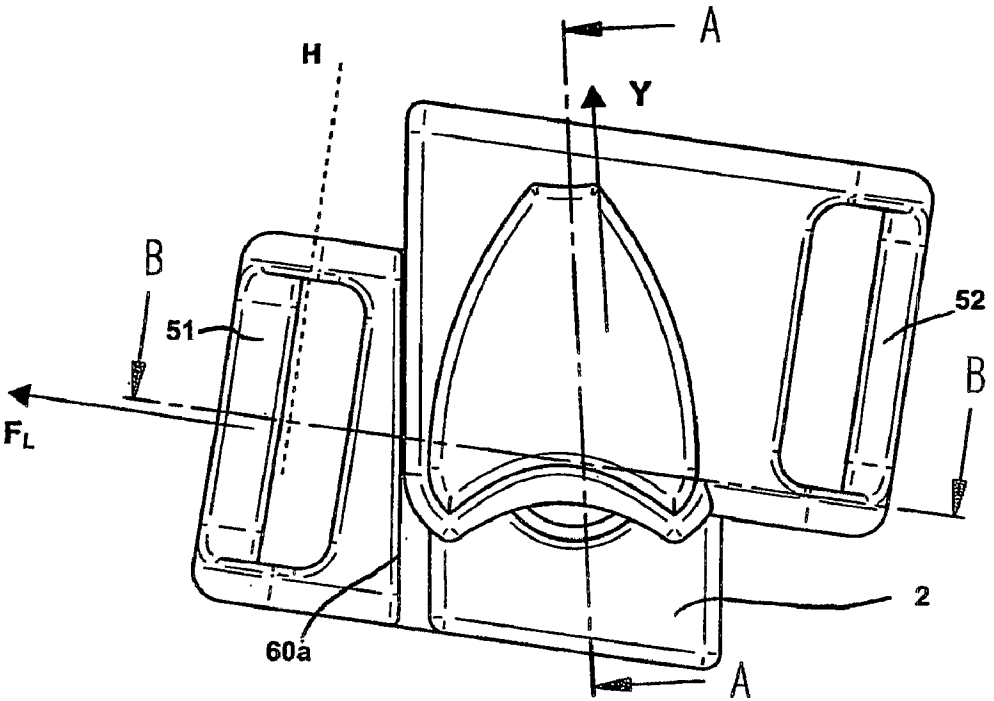
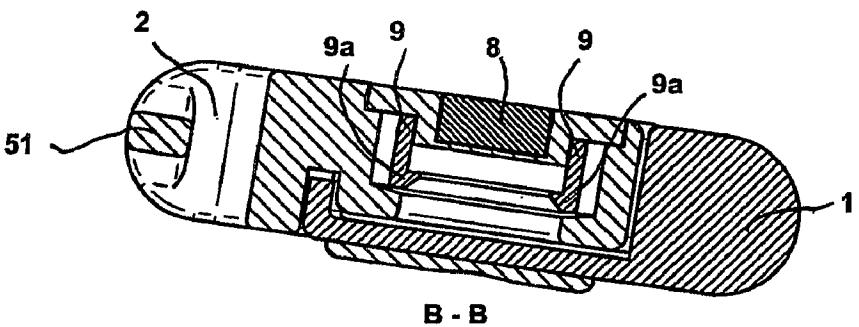

PRIOR ART

PRIOR ART

PRIOR ART

MAGNETOMECHANICAL CONNECTION ASSEMBLY WITH LOAD SECURING

CROSS-REFERENCE TO RELATED APPLICATION

This application is a National Phase Patent Application of International Patent Application Number PCT/DE2009/000231, filed on Feb. 22, 2009, which claims priority of German Patent Application Number 10 2008 010 273.3, filed on Feb. 21, 2008.

BACKGROUND OF THE INVENTION

Field of the Invention

This invention relates to a magnetomechanical connection assembly, i.e. a connection assembly with mechanical locking by means of magnetic-force assistance, with this connection assembly being particularly useful for closures as they are used on bags, rucksacks and comparable objects. However, this enumeration is not limiting for the field of application of the invention.

These hand-actuated closures must satisfy a wide variety of requirements depending on their application.

For example, it is a requirement that the closure is self-blocking under load. To satisfy this requirement, such closures include undercuts or bevels and are constructed such that a positive locking is obtained when the closure is loaded in the intended loading direction. For closing the closure, the closure halves to be connected are moved towards each other in closing direction and then mostly are hung into each other.

The explanations given below relate to closure halves which should be closed and are under a pretension, i.e. a force is applied to the closure halves which acts opposite to the closing direction.

For being hung into each other, the closure halves are moved into a closed position in which they are moved towards each other over a hang-in point. While being hung into each other, the closure halves move a smaller or larger distance opposite to the pretension, depending on the depth of the undercut. For opening, these closure halves must again be moved this distance opposite to the pretension, in order to disengage the closure halves, i.e. to overcome the undercut. Under pretension, the closure halves thus are harder to separate than without pretension. When disengaging or hanging out the closure halves, it often is also necessary to slightly move the closure halves sideways. These movements normally are not registered by man, because the human hand can easily perform such movements. When the performance of the hand is restricted, however, e.g. due to an illness, or when a ski glove is worn, the movements taking place on opening and closing gain great importance, in particular when on closing a force acts on at least one closure half, against which the force of the human hand must work.

The requirement that the closure can not or only hardly be opened under load thus has been fulfilled by means of the above-described locking with the undercuts, but only at the price that under pretension the closure closes just as hard as it opens.

However, there is also the requirement according to which it should be possible to comfortably close the closure under load. This can for example be achieved in that e.g. a push-in buckle also contains a magnet-armature construction beside the mechanical locking. In this way, it is achieved that the closure halves are pulled together on their own and thus the hand force is supported by the magnetic force of attraction.

Such closures often can only be opened again with a jerk, because on opening the magnetic force must be overcome. In a number of applications it is, however, desired that the closure can also be opened very easily and comfortably, so that even persons who wear thick gloves or are restricted in their manual motoricity can easily open the closure when the closure is unloaded.

From the prior art, a variety of closure constructions are known which, however, always satisfy only part of the above-described requirements.

For example, the documents WO2008/006357 A2 and WO2009/010049 A2 describe two closure constructions which are very easy to close and to open, but do not offer safe locking under load. Accordingly, such closure can open inadvertently under load, which must be avoided in the case of safety-relevant requirements. In these two closure constructions, closing is achieved or supported with the aid of magnetic force.

In the document EP 97 921 465, a closure construction for jewelry is described, in which the load occurring in use likewise is absorbed by means of a positive mechanical connection. Furthermore, magnets are provided, which effect a certain aid on closing. This magnetic closure opens harder under load than without load, since as described above the closure halves are hung into each other and for hanging out must be moved a certain distance towards each other. However, on closing under load it will close just as hard, since it must be moved against the load by the depth of the undercut. In addition, it is in part also necessary to work against the magnetic force. Depending on the constructive design of such magnetic closures, a more or less jerky separation of the magnet from the armature is obtained, which impairs the opening haptics of the closure.

From the spectrum of the different requirement profiles of the open and closing behavior of closures which are opened and closed by hand, the following profile or requirements has not yet become known from the prior art:

automatic or very easy closing without load
closing-force assistance on closing under load
safe locking under load
very easy opening without load.

SUMMARY OF THE INVENTION

It is the object of the invention to provide a closure which satisfies the requirement profile described above.

According to a first exemplary embodiment of the invention, a magnetomechanical connection assembly includes two connecting modules for connecting two elements. To each of the elements one of the connecting modules can be attached. Attachment is effected to the load housing of the connecting module. The load housing in a push-in buckle, for example, are the slot-shaped openings into which the belt webbings are threaded, in order to fasten the belt webbings at the push-in buckle. On closing, the connecting modules can already be loaded with a load $F_L$, i.e. the connecting modules must e.g. be pulled together by hand against the force generated by the load, before they come into engagement and are locked.

The force direction of the load $F_L$ extends substantially in direction of the connecting line between the load housings, i.e. in a push-in buckle arrangement the force direction extends on a line in direction of two tensioned belt webbings, whose end portions are connected with each other by means of the push-in buckle.

The connecting modules have the following features: a locking device for positively locking the connecting modules, wherein the locking device includes a spring locking element which is arranged in the first connecting module. In the second connecting module a matching locking piece is arranged.

A magnet-armature construction is provided, comprising a magnet which is arranged in one of the connecting modules and an armature or a second magnet which is arranged in the other connecting module.

Furthermore, a movement track is formed in the first connecting module, on which the locking piece of the second connecting module can be shifted from a closed position, i.e. a locking condition, into an open position, i.e. into an unlocked condition.

The locking device, the magnet-armature construction and the movement track are operatively connected by the following features:

On opening, the connecting modules are shifted on the movement track from the closed position into the open position, wherein the magnet and the armature or the second magnet are shifted against each other, so that a gradual attenuation of the mutual magnetic attraction occurs.

At the same time, the locking piece and the spring locking element are shifted against each other on the movement track, until the spring locking element enters into an especially provided recess in the locking piece and thus no longer is in engagement with the locking piece.

On closing, the connecting modules directly lock into the closed position by means of the locking device, in contrast to the subject-matter of EP 97 921 465, wherein the locking piece pushes the spring locking element to the side, until it snaps into place.

On closing, the magnet-armature construction at the same time pulls the connecting modules towards each other, whereby the locking of the locking device is at least supported.

The spatial position of the load housings on the connecting modules and the spatial position and shape of the movement track are formed and chosen such that on shifting the connecting modules from the closed position into the open position the load housings of the connecting modules must move onto each other by an amount $\Delta x$. This opening movement is effected against the load $F_L$, so that a physical work $W=F_L\times\Delta x$ is necessary for this purpose. Thus, the connection assembly is harder to open under the load $F_L$ than without the load $F_L$.

Thus, the object of the invention has been solved. The connection assembly closes automatically or very easily without load, since the magnetic force strongly supports the closing movement. Furthermore, the connection assembly will even comfortably close under load due to the magnetic closing-force assistance. Under load, a very safe locking is effected, which is the greater the greater the force of the acting load becomes. And without load, the connection assembly can be opened very easily.

According to a second exemplary embodiment of the invention, a magnetomechanical connection assembly includes two connecting modules for connecting two elements. To each of the elements one of the connecting modules can be attached. Attachment is effected to the load housing of the connecting module. The load housing of a push-in buckle are the slot-shaped openings into which the belt webbings are threaded, in order to fasten the belt webbings at the push-in buckle. On closing, the connecting modules can already be loaded with a load $F_L$, i.e. the connecting modules must e.g. be pulled together by hand against the force generated by the load, before they come into engagement and are locked.

The force direction of the load $F_L$ extends substantially in direction of the connecting line between the load housings, i.e. in a push-in buckle arrangement the force direction extends on a line in direction of two tensioned belt webbings, whose end portions are connected with each other by means of the push-in buckle.

The connecting modules have the following features: a locking device for positively locking the connecting modules, wherein the locking device includes a spring locking element which is arranged in the first connecting module. In the second connecting module a matching locking piece is arranged. In addition, a force-deflecting bevel is provided in the second connecting module.

There is provided a magnet-armature construction, comprising a magnet which is arranged in one of the connecting modules and an armature or a second magnet which is arranged in the other connecting module.

Furthermore, a movement track is formed in the first connecting module, on which the locking piece of the second connecting module can be shifted from a closed position, i.e. a locking condition, into an open position, i.e. into an unlocked condition.

The locking device, the magnet-armature construction and the movement track are operatively connected by the following features:

On opening, the connecting modules are shifted on the movement track from the closed position into the open position, wherein the magnet and the armature or the second magnet are shifted against each other, so that a gradual attenuation of the mutual magnetic attraction occurs.

At the same time, the locking piece and the spring locking element are shifted against each other on the movement track, wherein the spring locking element is pushed to the side by the force-deflecting bevel, until the spring locking element no longer is in engagement with the locking piece.

On closing, the connecting modules directly snap into the closed position by means of the locking device, in contrast to the subject-matter of EP 97 921 465, wherein the locking piece pushes the spring locking element to the side, until it snaps into place.

On closing, the magnet-armature construction at the same time pulls the connecting modules towards each other, whereby the locking of the locking device is at least supported.

The spatial position of the load housings on the connecting modules and the spatial position and shape of the movement track are formed and chosen here, such that on shifting the connecting modules from the closed position into the open position the load housings of the connecting modules must move onto each other by an amount $\Delta x$. This opening movement is effected against the load $F_L$, so that a physical work $W=F_L\times\Delta x$ is necessary for this purpose. Thus, the connection assembly is harder to open under the load $F_L$ than without the load $F_L$.

To explain the technical teaching underlying the invention, this teaching will first be discussed with reference to abstracted drawings, since this principle is contained in all subsequent concrete closure constructions.

The cooperation of the closure halves on closing and opening of the closure and the corresponding spatial positions of the essential functional elements will be described. Furthermore, the forces acting on closing and opening, i.e. when connecting and separating the closure halves, will be described, and the physical work to be performed on connecting and separating will also be described. For a better understanding, the technical teaching of the invention will be compared with the technical teaching underlying the closure construction of the above-mentioned EP 97 921 465.

BRIEF DESCRIPTION OF THE DRAWINGS

FIG. 6*d* shows the frontal sliding buckle according to FIG. 6*a* after being shifted in the open position.

DETAILED DESCRIPTION OF THE INVENTION

The teaching in accordance with the invention will first be explained by comparison with reference to the functions and effects occurring in a magnetic closure according to the prior art as described in document EP 97 921 465.

Figure 10A:
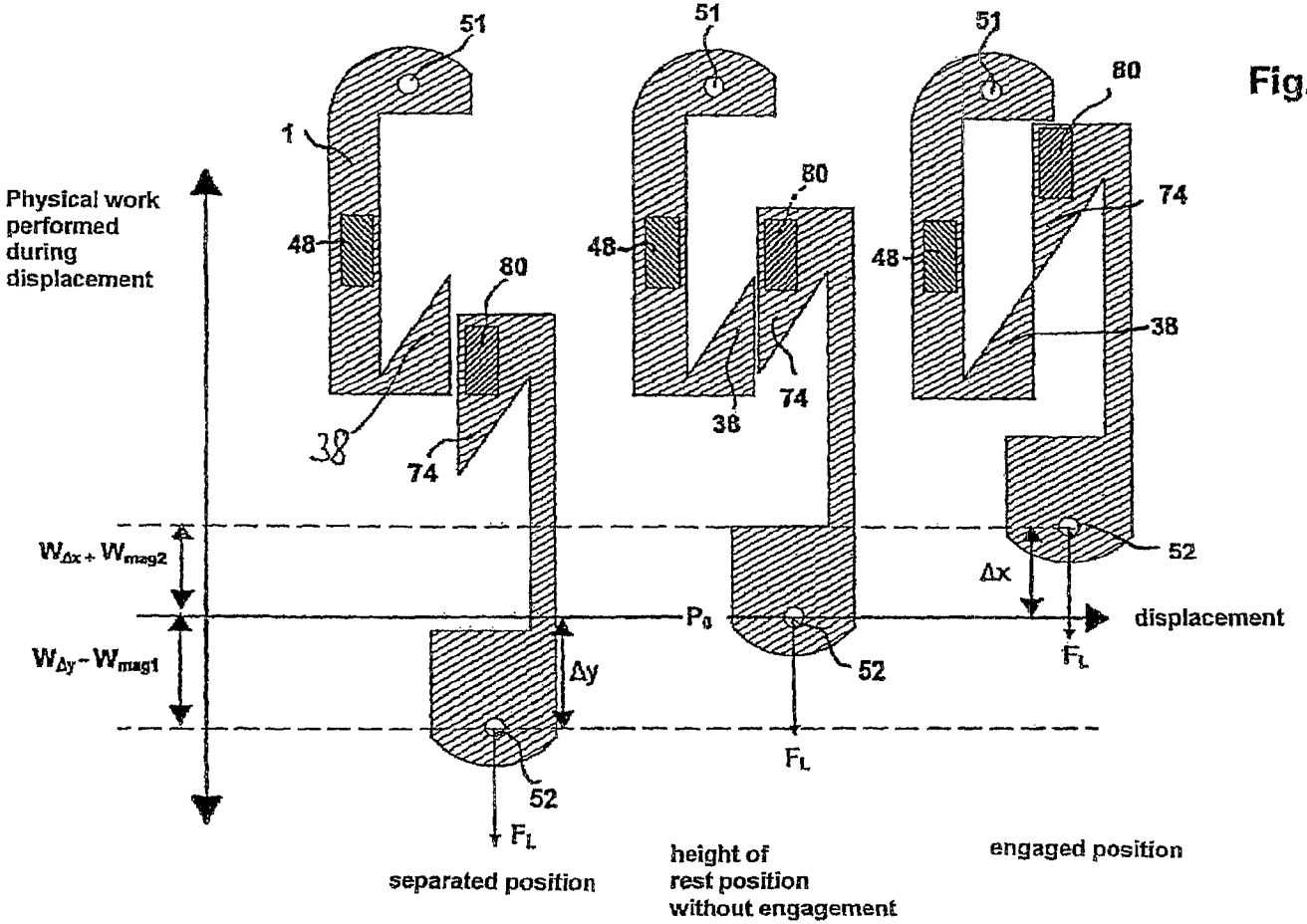
FIG. 10*a* shows the physical work to be performed on closing of a hook-shaped closure under load according to the prior art.
Figure 10B:
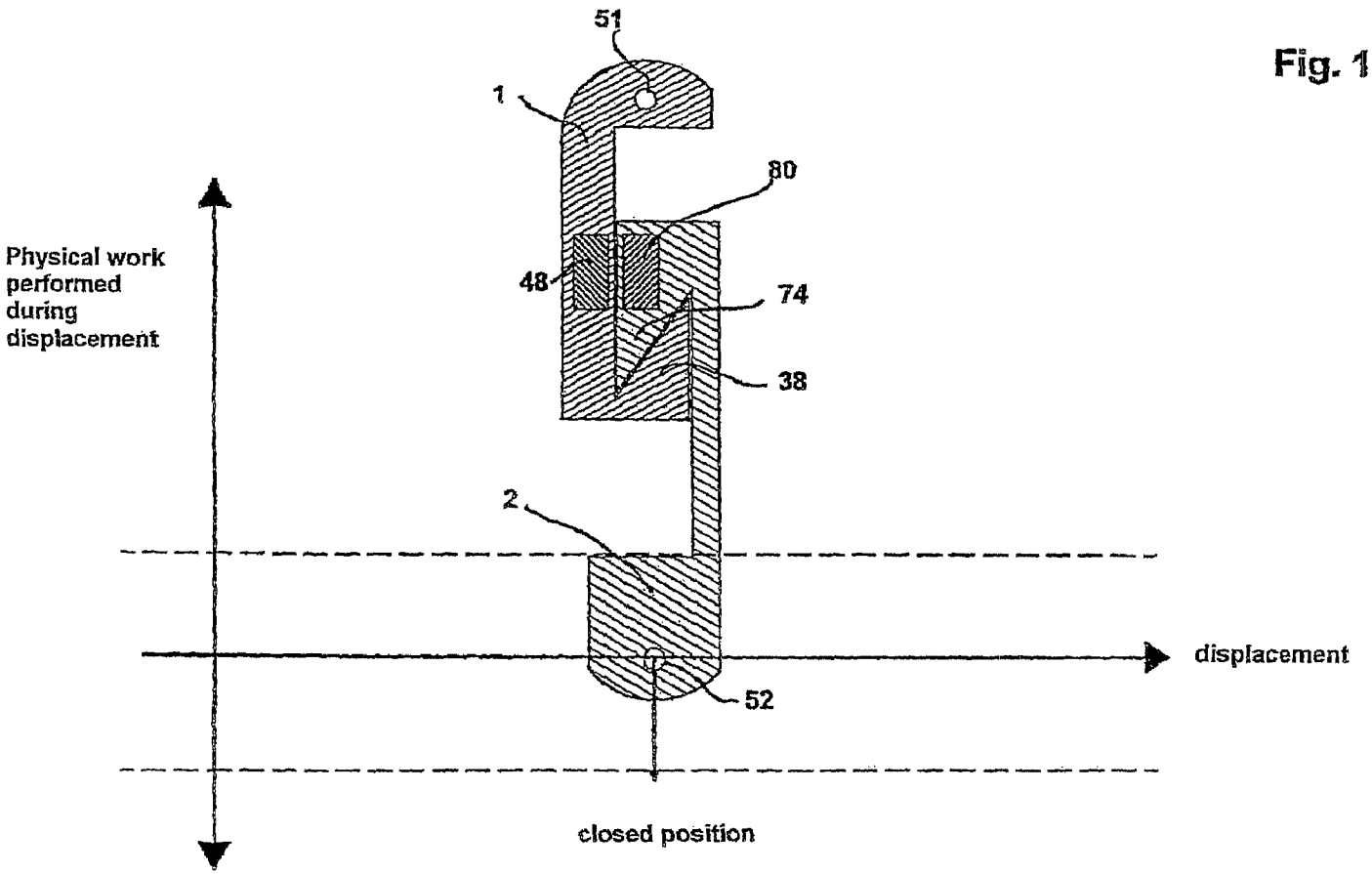
FIG. 10*b* shows the closed position of the closure according to FIG. 10*a*.
Figure 10C:
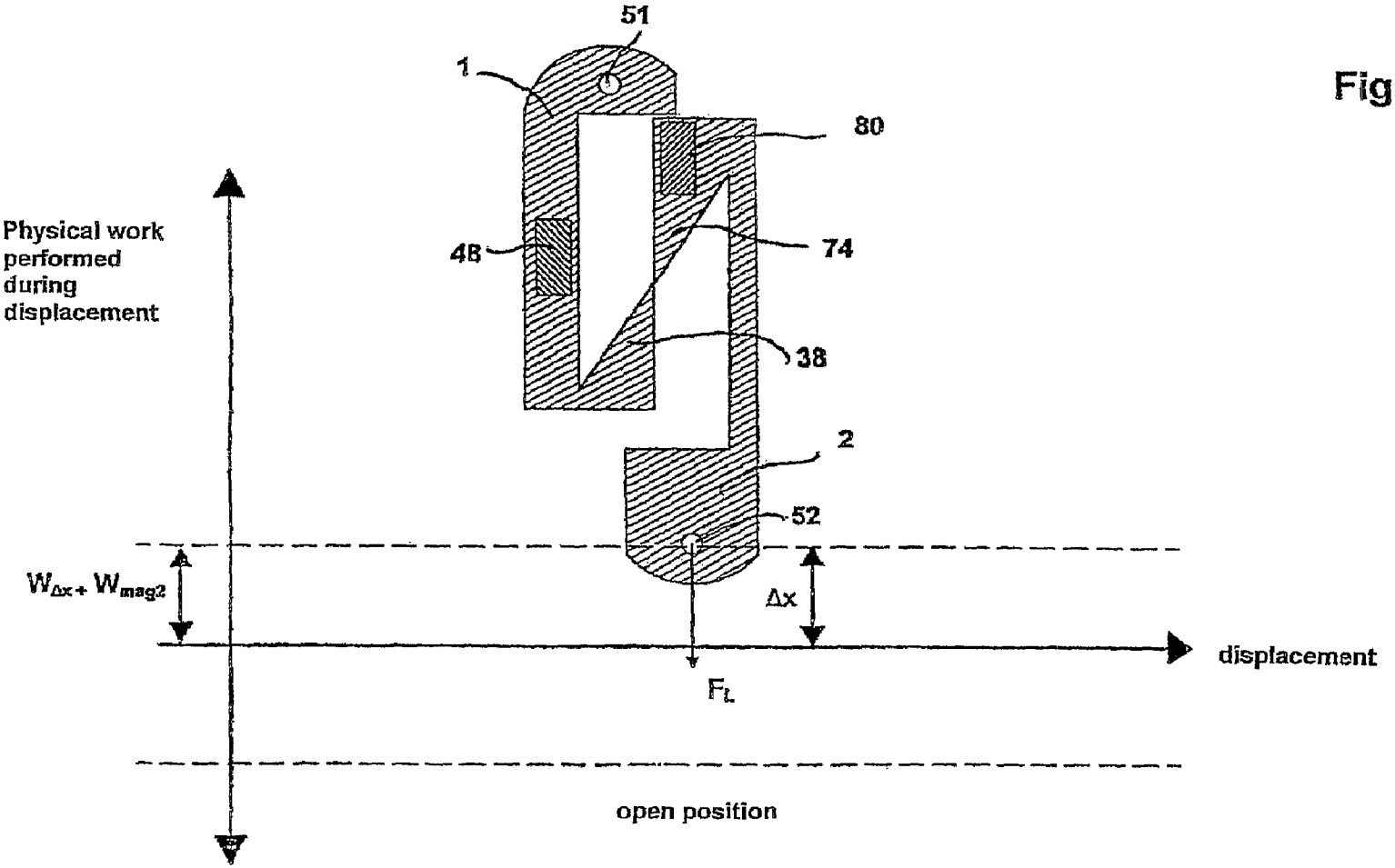
FIG. 10*c* shows the opening of the closure according to FIG. 10*a*.

In the form of a diagram, FIGS. 10*a* to 10*c* show constructive and also functional features of a hook-shaped closure during closing and opening. In each connecting module 1 and 2, this closure contains one magnet 48 and 80 each and closing means, which are formed as tongue 74 and base 38.

From left to right, FIG. 10*a* shows in two movement conditions the physical work to be performed on closing of the closure under load.

Proceeding from a rest condition, the connecting module 2 first is lifted against a downwardly directed force $F_L$ from a separating position to a height $P_0$, for which purpose the work $W_{\Delta y}$ is necessary. The height $P_0$ is the height position which the connecting module 2 also has in the condition hung in. Since the magnetic force slightly supports such lifting, the actually required work is $W_{\Delta y}$ minus $W_{mag1}$, cf. lower double arrow on the left. The force $F_L$ is the force which must be overcome on closing under load, in order to hang in the closure.

In the next step of movement, the connecting module 2 is lifted further, so that it is opposed to the recess of the connecting module 1. This distance covered on lifting is designated with Δx. To cover this distance Δx, a work $W_{\Delta x}$ is necessary. In addition, the magnets having approached each other as far as possible are again moved away from each other. This likewise requires a work which is designated with $W_{mag2}$ and additionally makes closing difficult. It should be noted that closing of this closure is the harder the greater the downwardly directed force $F_L$. Especially in the critical moment of hanging in the connecting module 2, the magnetic force additionally impedes the threading operation.

For completeness, the closed position and the process of opening the closure will also be described.

FIG. 10*b* shows the closed position of the closure, in which the connecting module 2 is lowered to the height $P_0$.

FIG. 10*c* shows the opening of the closure, wherein the connecting module 2 must be lifted by Δx against the load $F_L$.

In contrast to the above-described technical teaching known from the prior art, the closure of the invention closes more comfortably, in particular under load, which will be explained below.

Analogous to FIGS. 10*a* to 10*c*, the technical teaching in accordance with the invention will now be explained with reference to FIGS. 11*a* to 11*c*. For a better understanding, the difference with respect to the work to be done on closing will be described first.

Figure 11A:
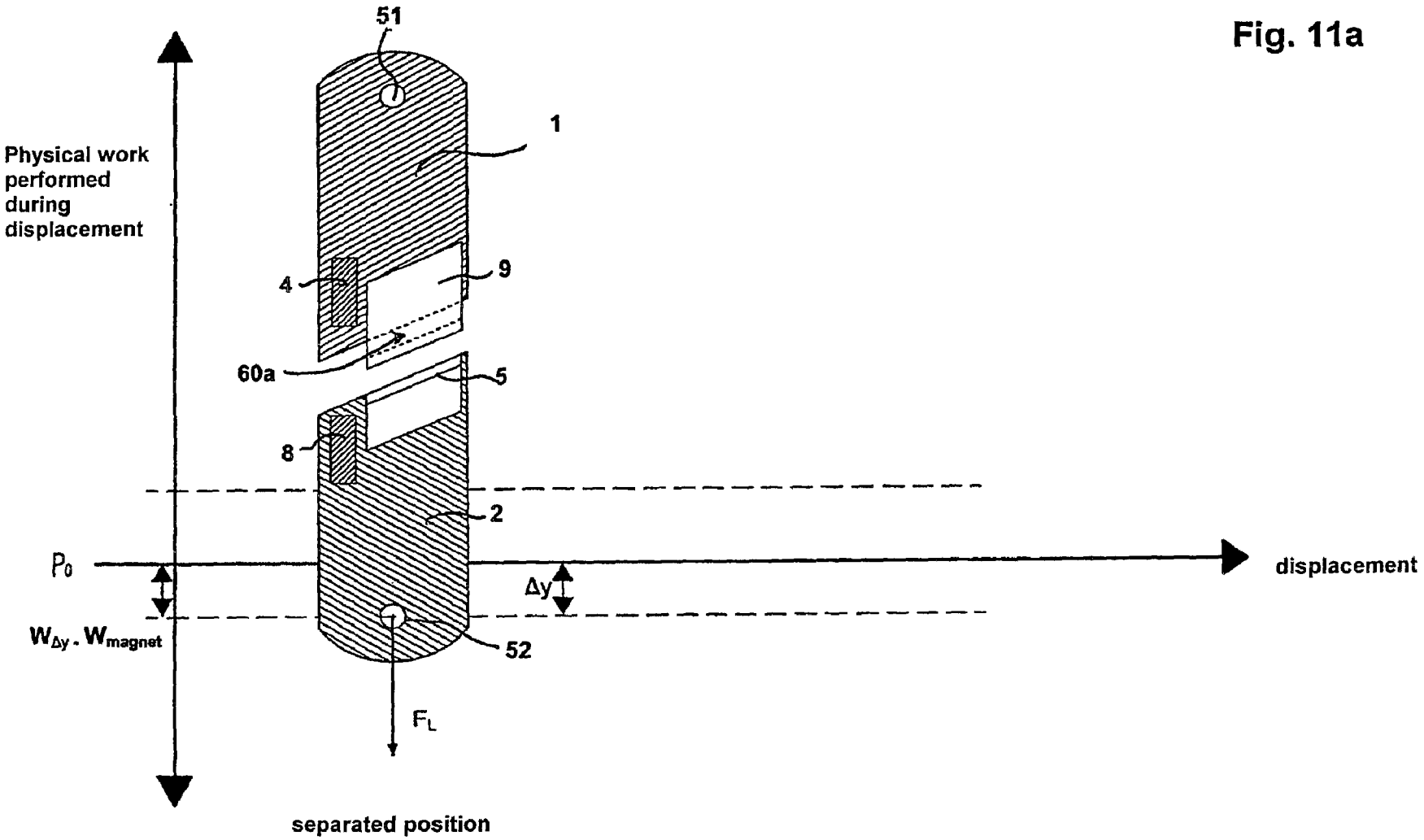
FIG. 11*a* shows the physical work which must be done for closing the closure according to an exemplary embodiment of the invention.

FIG. 11*a* shows the work which must be done for closing the closure. The connecting module 2 is in a position in which the magnetic force starts to act. Although the connecting module 2 is pulled downwards by the applied force $F_L$, the magnetic force supports the upward movement of the connecting module 2 against the load $F_L$, until it snaps into the closed position $P_0$. For this purpose, the work $W_{\Delta y}$ must be performed. Due to the magnets 4 and 8, the magnetic force between these magnets acts at the same time and performs a work $W_{magnet}$. Accordingly, the actually required work $W_{\Delta y}$ is reduced by the work $W_{magnet}$ applied by the magnetic force.

Figure 11B:
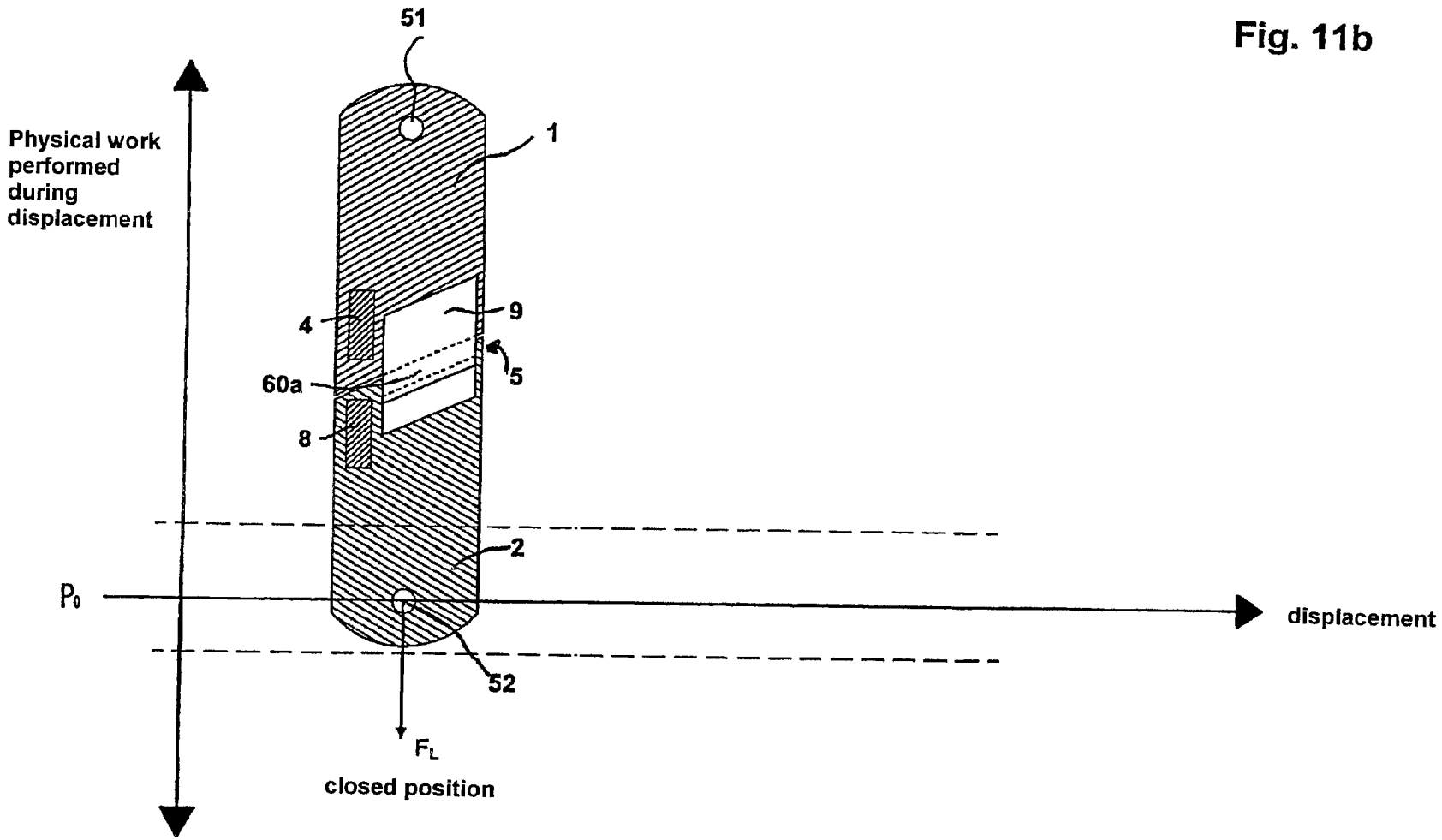
FIG. 11*b* shows the closure according to FIG. 11*a* in the closed position.

FIG. 11*b* shows the closure in the closed position $P_0$, i.e. the connecting modules 1 and 2 have snapped into place, i.e. are latched with each other by means of a spring locking means. The spring locking means consists of a spring locking element 9 and a locking piece 5. When snapping into place, the spring locking element 9 is pushed against the locking piece 5, wherein the spring locking element 9 is pushed to the side, until it snaps into place behind the locking piece 5. Since this spring locking means is known from the above-mentioned prior art, a more detailed description thereof can be omitted.

In contrast to the prior art shown in FIGS. 10*a* to 10*c*, the closure of the invention was closed without applying an additional work. In accordance with the object of the invention, this closure accordingly will close comparatively easier and also more comfortably even under load, since merely a linear movement and no complicated hang-in movement is required for snapping into place.

In the following, it will be explained that this closure also solves the object to be hard to open under load.

Figure 11C:
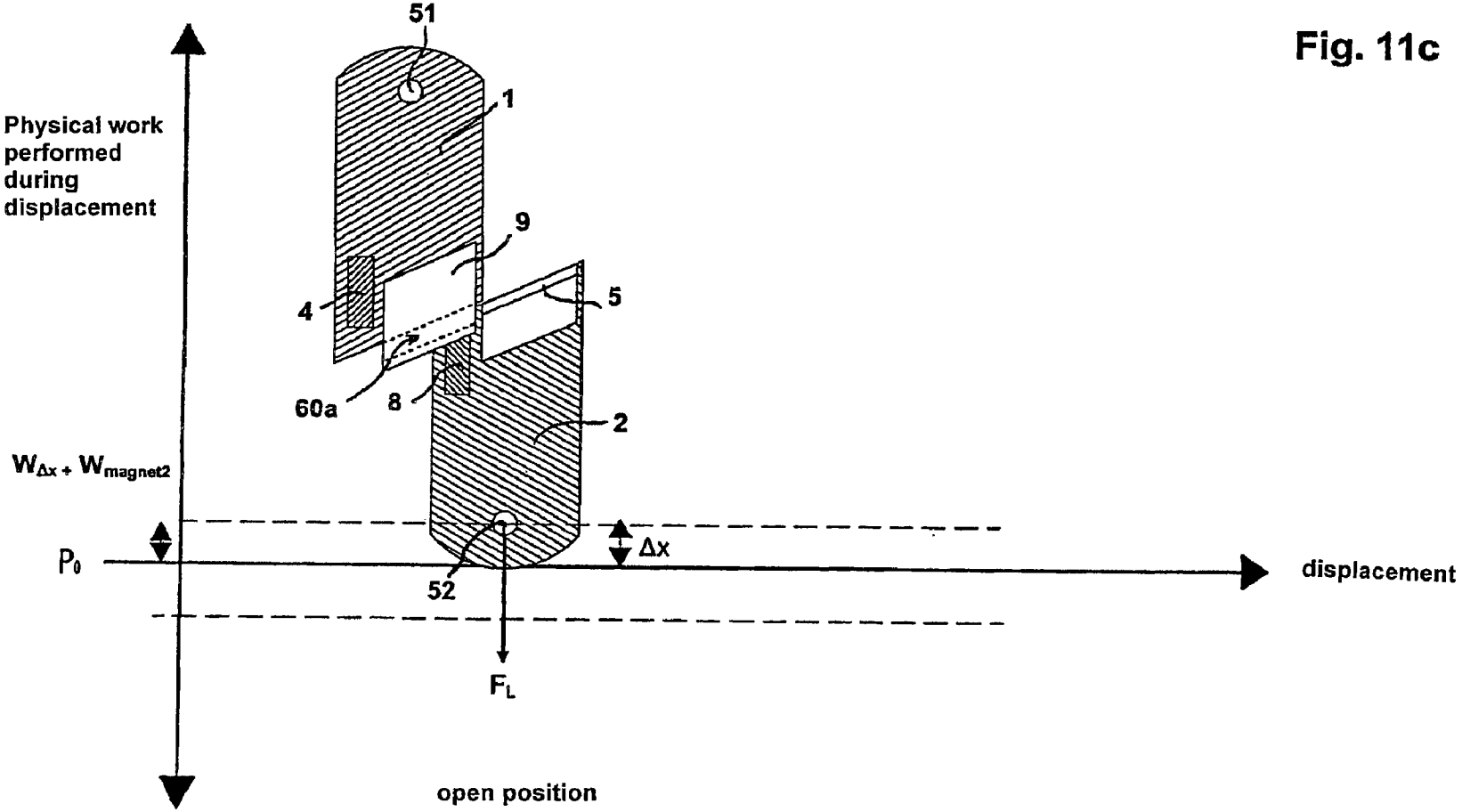
FIG. 11*c* shows the opening process according to FIG. 11*a*.

FIG. 11*c* shows the opening process. For this purpose, the connecting module 1 and the connecting module 2 are shifted on a movement track 60*a*, whereby the locking device has come out of engagement. In accordance with the technical teaching of the invention, the position of the load housings 51, 52 and the position and shape of the movement track 60*a* are chosen such that with this opening displacement of the connecting modules the load housings 51, 52 were moved towards each other by the distance Δx against the force $F_L$, so that a work $W_{\Delta x}$ had to be performed for this purpose. The required work is the greater the greater the load $F_L$, i.e. the closure opens harder with load than without load.

The functionality was shown here with reference to an inclined movement track (60*a*), but as shown by the following embodiments, the technical teaching of the invention also can be realized by curved tracks.

According to an embodiment of the invention the movement track is disposed at an angle, so that when shifting the connecting modules from the closed position into the open position the load housings move towards each other by an amount Δx against the load $F_L$, as is shown in FIG. 1*a-e*, FIG. 5*a-d*, FIGS. 6*a-g*, FIG. 7, FIGS. 8*a-f*.

According to another embodiment, the movement track (60*b*) is curved in the shape of a circular arc and has exactly one open position, wherein the center (M) of this circularly curved movement track is laterally shifted from the connecting line between the load housings towards the side of the open position of the movement track, so that on shifting the connecting modules from the closed position into the open position the load housings move towards each other by an amount Δx against the load $F_L$, as is shown in 9*a-e*.

According to another embodiment, the movement track (60*b*) likewise is curved in the shape of a circular arc, wherein the load housing (51) in the connecting module 1 lies above the center (M) of the movement track and the center (M) lies on the connecting line between the load housings, so that on shifting the connecting modules from the closed position into the open position the load housings move towards each other by an amount Δx against the load $F_L$, as is shown in FIGS. 3*a-e*.

According to another embodiment, the movement track has a closed position in the center and two open positions to the right and left thereof, i.e. the locking piece can be shifted from a center position to the left or to the right into one of the two open positions, as is shown in FIGS. 2*a-e*, 3*a-e*, 4 and 8*a-f*.

Figure 2A:
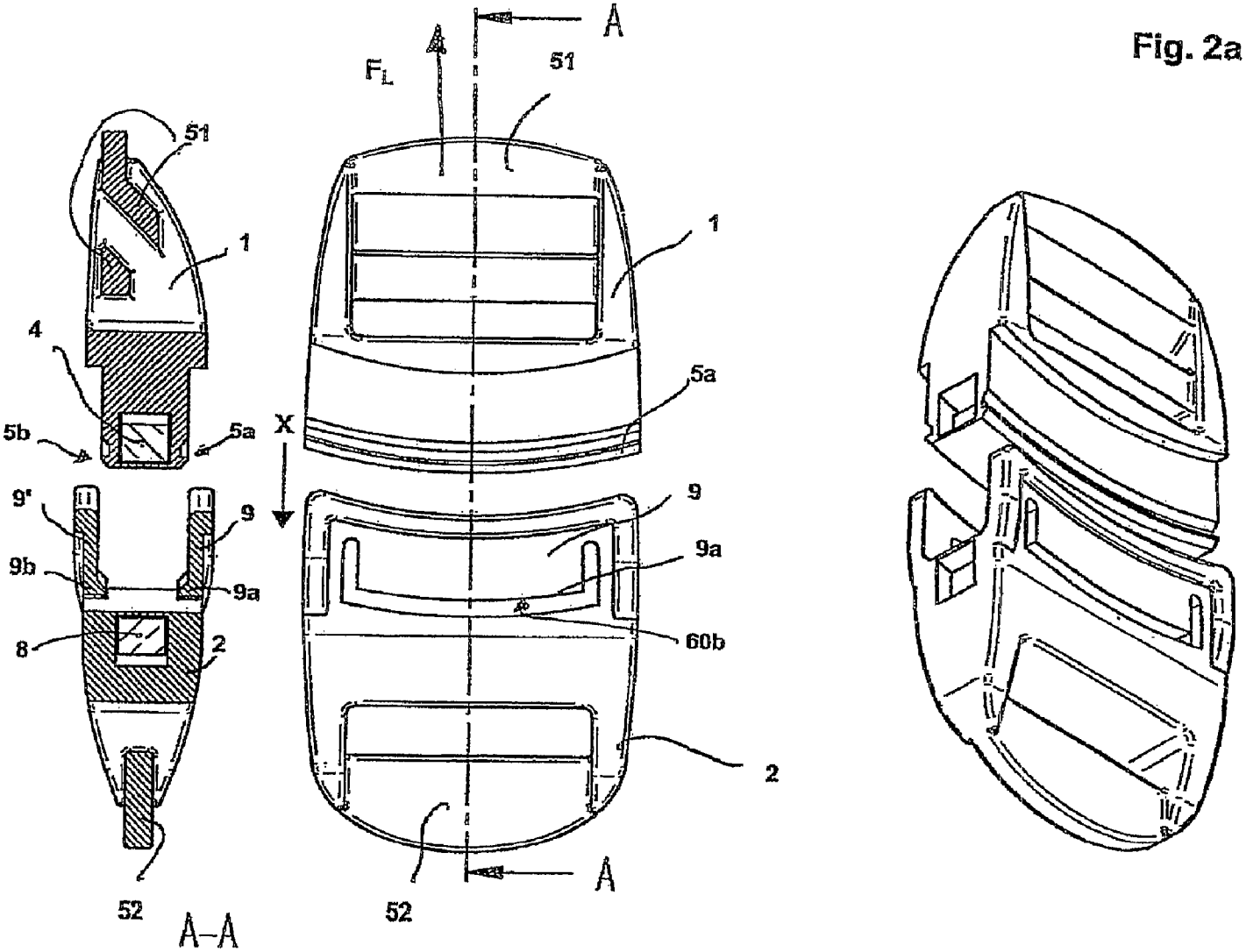
FIG. 2*a* shows a arc-shaped push-in/swivel buckle to be opened on both sides for belt webbings.
Figure 2B:
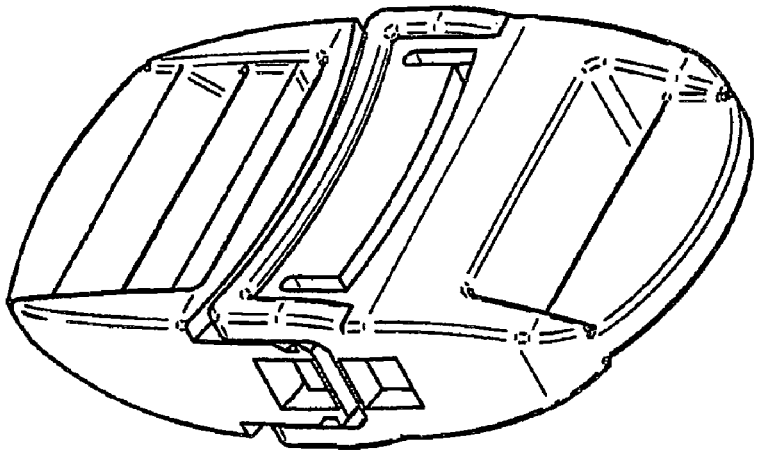
FIG. 2*b* shows the arc-shaped push-in/swivel buckle according to FIG. 2*a* while snapping into place.
Figure 2B:
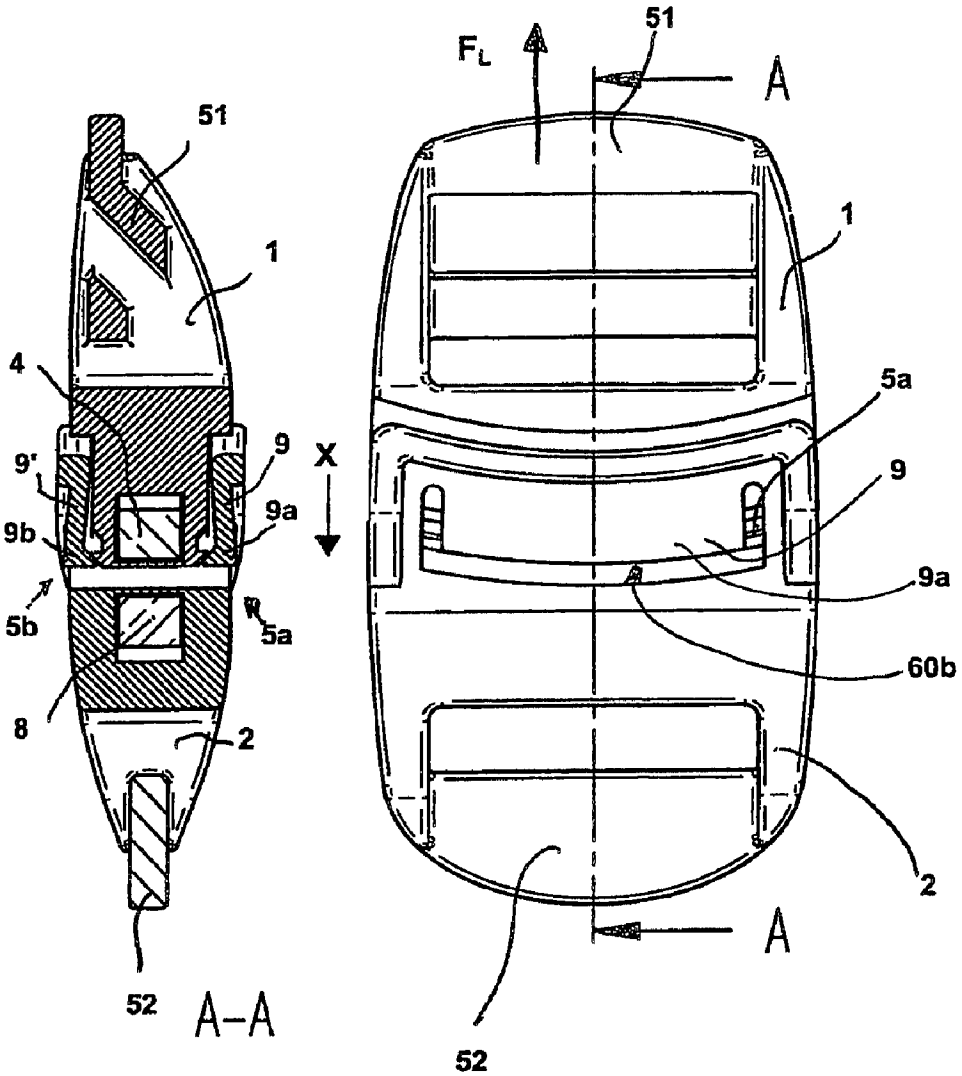
Figure 2C:
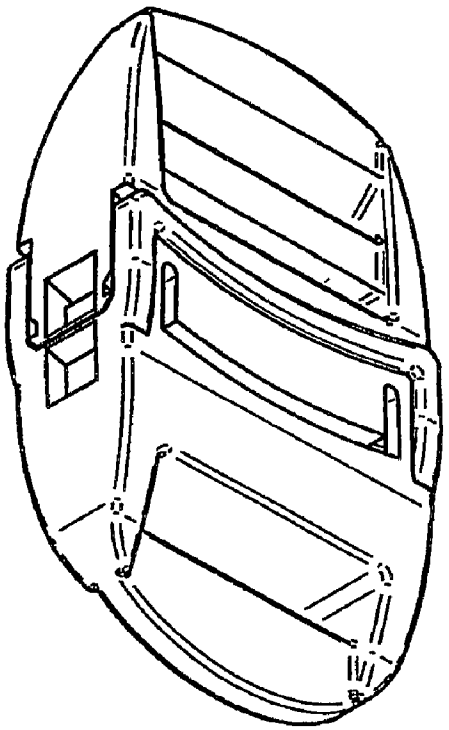
FIG. 2*c* shows the arc-shaped push-in/swivel buckle according to FIG. 2*a* after snapping into the closed position.
Figure 2C:
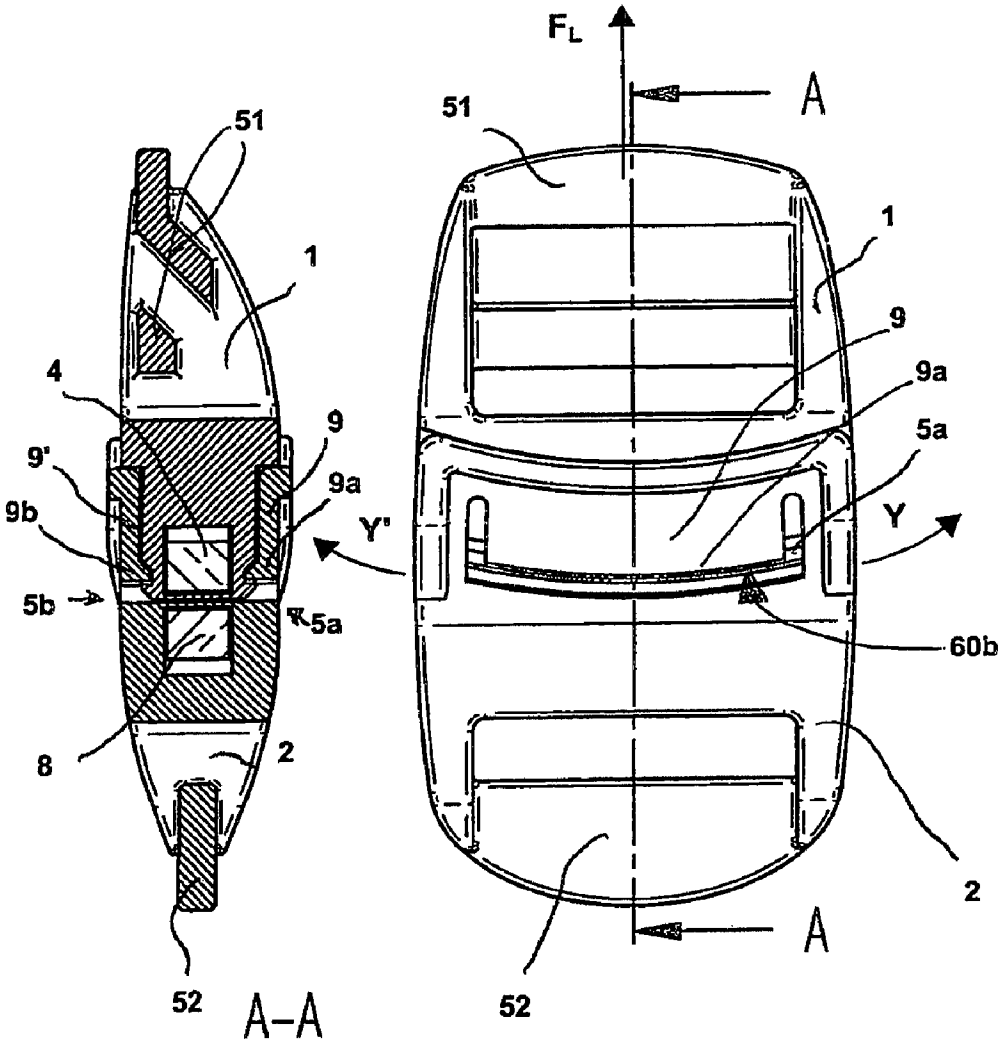
Figure 2D:
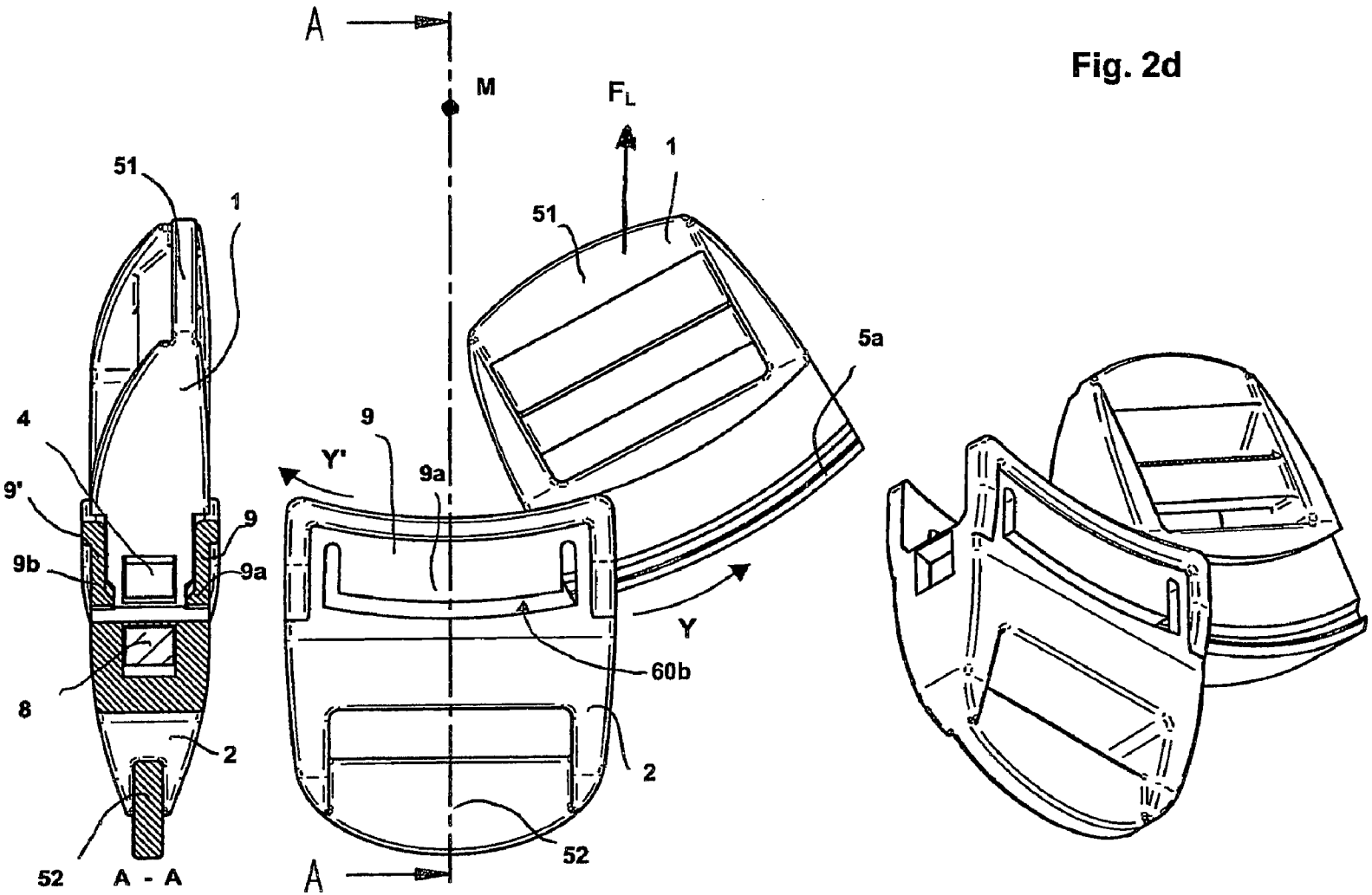
FIG. 2*d* shows the arc-shaped push-in/swivel buckle according to FIG. 2*a* after shifting into the open position.
Figure 2E:
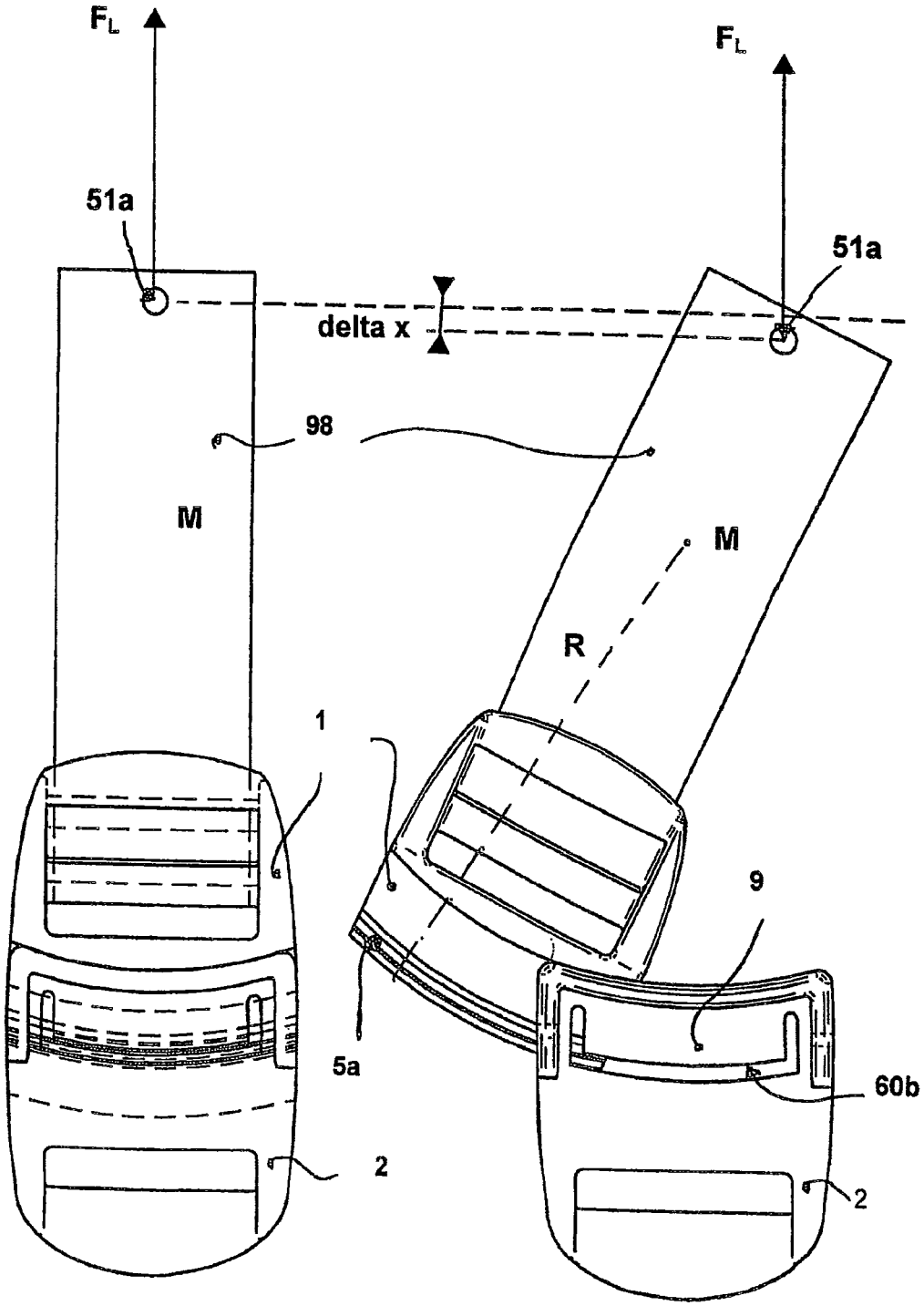
FIG. 2*e* shows the arc-shaped push-in/swivel buckle according to FIG. 2*a* in the closed position and the open position.

According to another embodiment, the movement track (60*b*) is curved in the shape of a circular arc, wherein the load housing (51) in the connecting module 1 lies below the center of the curvature, the center (M) lies on the connecting line between the load housings, and to the load housing (51) a rigid extension (98) is attached, whose loaded end (51*a*) lies above the center of the curvature, so that on shifting the connecting modules from the closed position into the open position the loaded end (51*a*) and the load housing (52) move towards each other by an amount Δx against the load $F_L$, as is shown in FIG. 2*e*.

According to another embodiment, the locking piece and the movement track are of such a shape and size that the locking piece is guided while being shifted on the movement track, i.e. a locking piece with inclined portions is forcibly guided on an inclined movement track or a locking piece with circular-arc-shaped portions likewise is forcibly guided on a circular-arc-shaped track, as is shown in FIGS. 1*a-e*, 2*a-e*, 3*a-e*, 4, 5*a-d*, 6*a-e*.

According to another embodiment, the locking piece and the movement track are of such a shape and size that the connecting module 1 and the connecting module 2 can be swiveled against each other, as is shown in FIGS. 8*a-f*.

According to another embodiment, the movement track is repeatedly curved or angled in a meandrous manner, so that on shifting the connecting modules from the closed position into the open position the load housings (51, 52) repeatedly move towards each other and back again by an amount Δx against the load $F_L$.

According to another embodiment, the surfaces of the locking piece and of the movement track, which lie on each other under load, have an increased friction due to roughened portions or toothings, so that on shifting the connecting modules from the closed position into the open position under the load $F_L$ an increased force is required.

According to another embodiment, the magnets and the armature or the second magnet are arranged and sized, i.e. dimensioned, such that the magnetic force automatically pulls the locking means together, unless a load $F_L$ acts when snapping into place.

According to another embodiment, the magnets and the armature or second magnet are arranged with an offset such that in the closed position the magnetic force produces a restoring force, which effects an automatic return of the connecting module 1 into the closed position.

The invention will subsequently be explained in detail with reference to schematic drawings and construction drawings.

FIGS. 1*a-e* each show a top view, a sectional view A-A and a perspective view of a linear push-in/sliding buckle of the invention for belt webbings in the most important phases of movement during opening and closing. The movement track is formed at an angle. The load housings 51, 52 here are formed for accommodating belt webbings and subsequently are referred to as belt webbing receptacles 51, 52. In this one and in the following embodiment, further features also are renamed depending on the embodiment, but are provided with the same reference numeral, if this is conducive to the understanding of the embodiment.

Figure 1A:
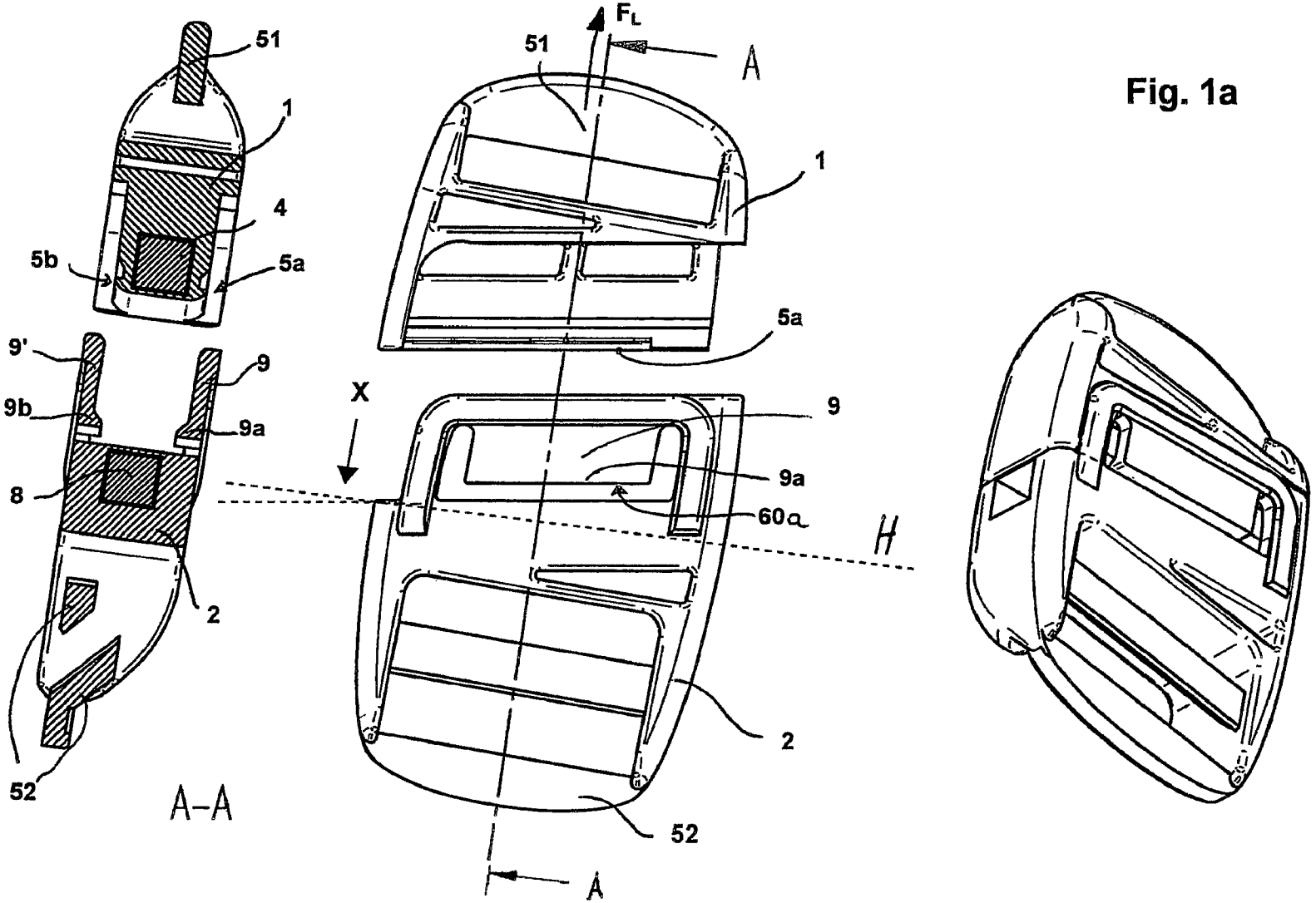
FIG. 1*a* shows a linear push-in/sliding buckle for belt webbings.

FIG. 1*a* shows a linear push-in/sliding buckle comprising plug 1 and housing 2 with the belt webbing receptacles 51 and 52, wherein plug and housing oppose each other separately. Now, they are put together in direction X against the force $F_L$, which in use acts in the direction of the connecting line between the belt webbing receptacles. In the Figure, this connecting line is identical with the cutting line A-A. In the plug a magnet 4 is provided, and in the housing an armature or second magnet 8 is provided. Due to the magnetic attraction, plug 1 and housing 2 are pulled together in direction X, and the magnetic force hence supports the closing under load. Locking pieces 5*a*, 5*b* arranged on the plug and spring locking elements 9, 9' arranged on the housing together form a snap-action closure.

Figure 1B:
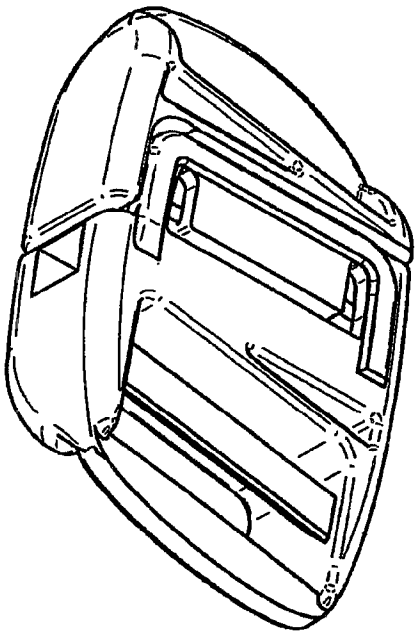
FIG. 1*b* shows the linear push-in/sliding buckle according FIG. 1*a* when snapping into place.
Figure 1B:
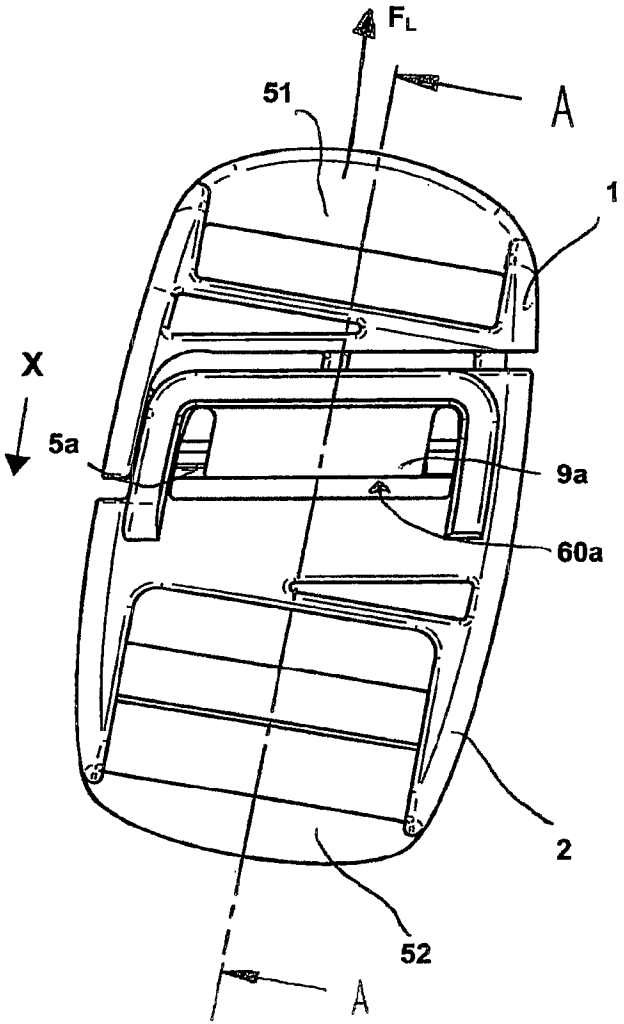
Figure 1B:
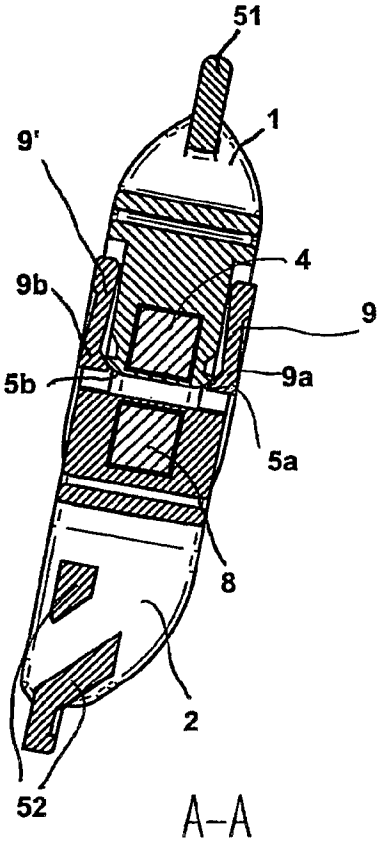

FIG. 1*b* shows the linear push-in/sliding buckle when snapping into place. The latching noses 9*a*, 9*b* of the spring locking elements are pushed to the side by the locking pieces against the spring force of the spring locking elements, until they snap into place.

Figure 1C:
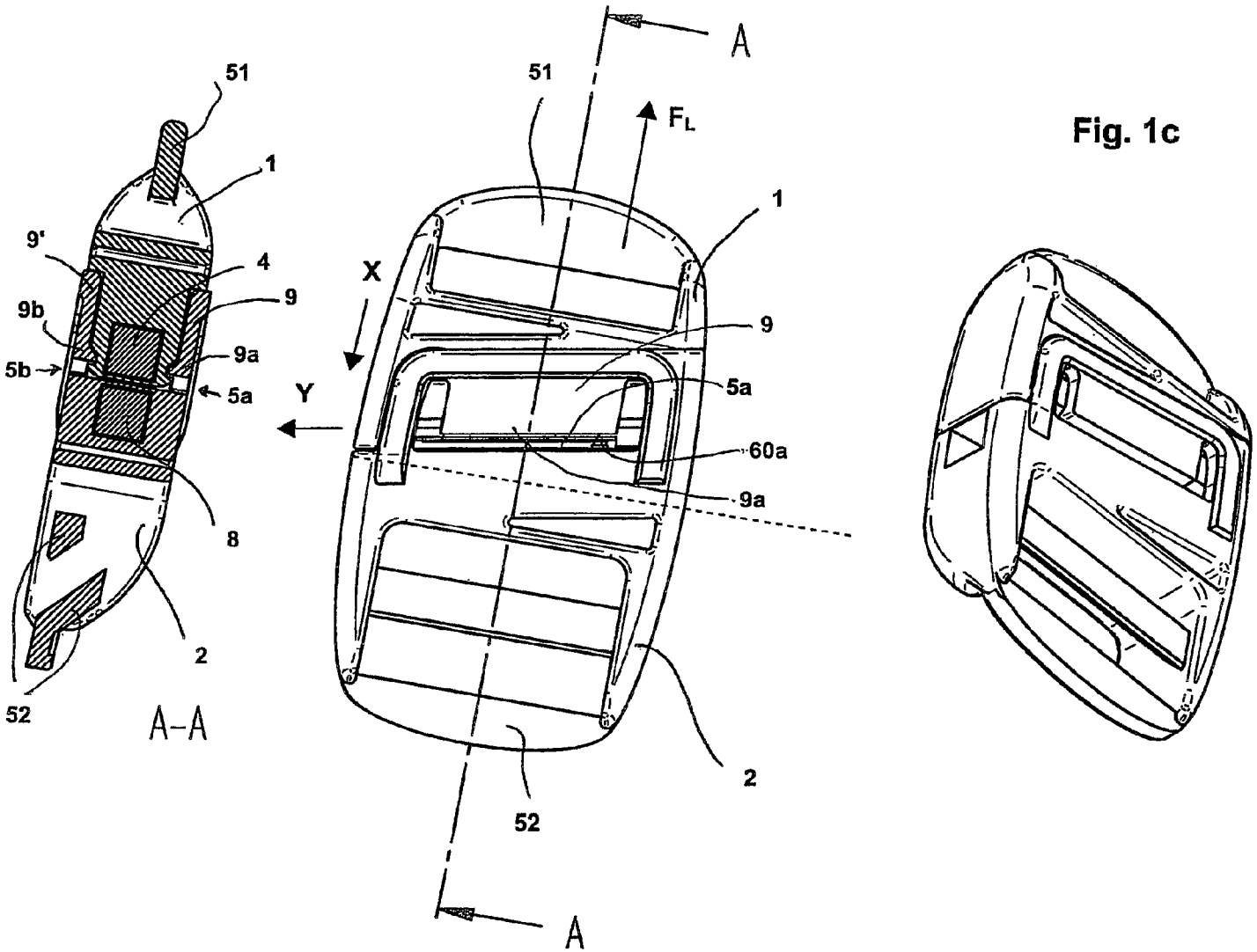
FIG. 1*c* shows the linear push-in/sliding buckle according FIG. 1*a* after snapping into the closed position.

FIG. 1*c* shows the linear push-in/sliding buckle after snapping into the closed position. Next, the plug 1 is shifted for opening relative to the housing 2 on an inclined movement track 60*a* in an opening direction Y. The inclined movement track 60*a* is disposed obliquely at an angle alpha with respect to the horizontal H (vertical to the load $F_L$), in other words: the angle between load $F_L$ and opening direction Y is greater than 90°.

Figure 1D:
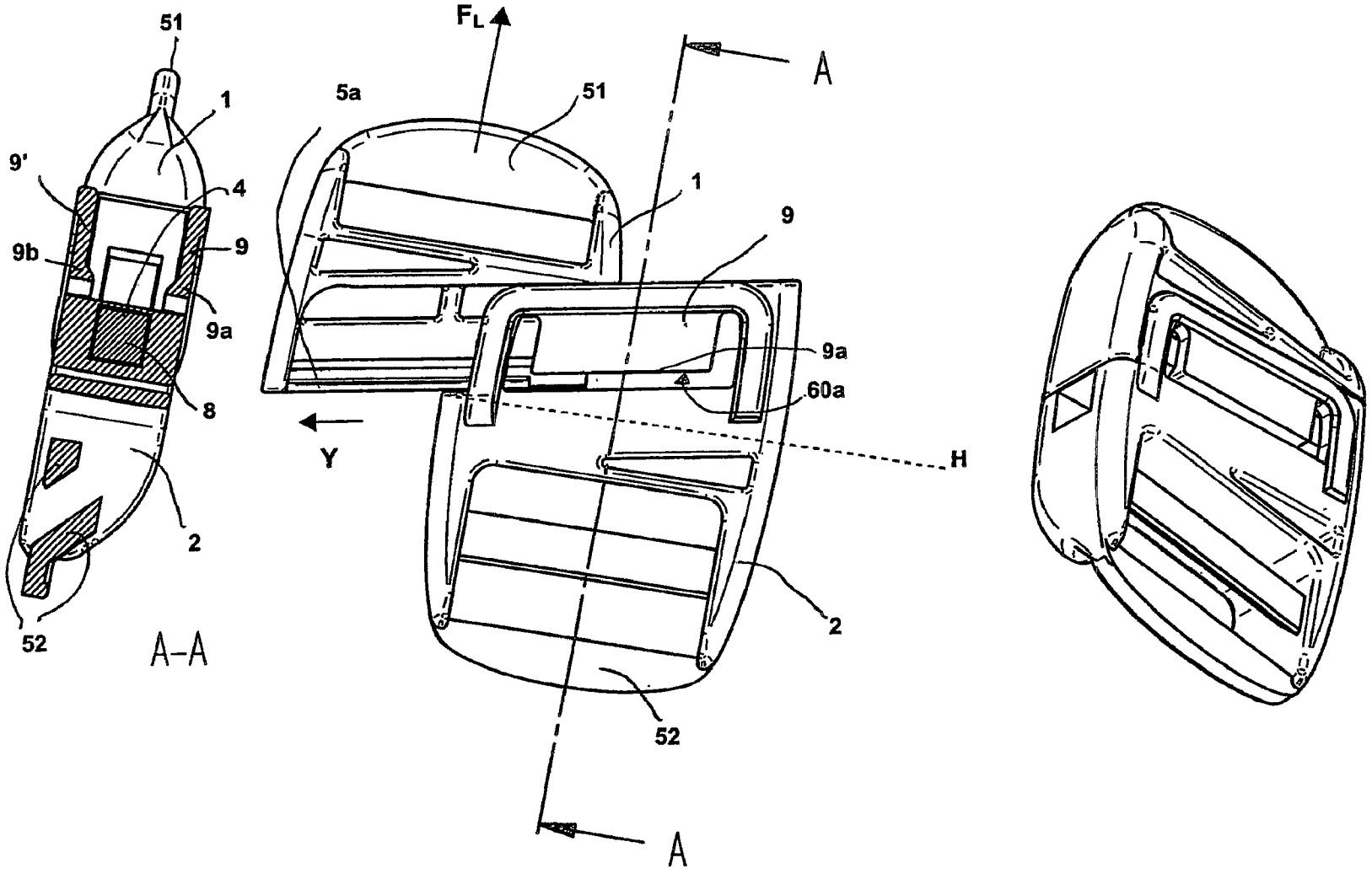
FIG. 1*d* shows the linear push-in/sliding buckle after being shifted into the open position.
Figure 1E:
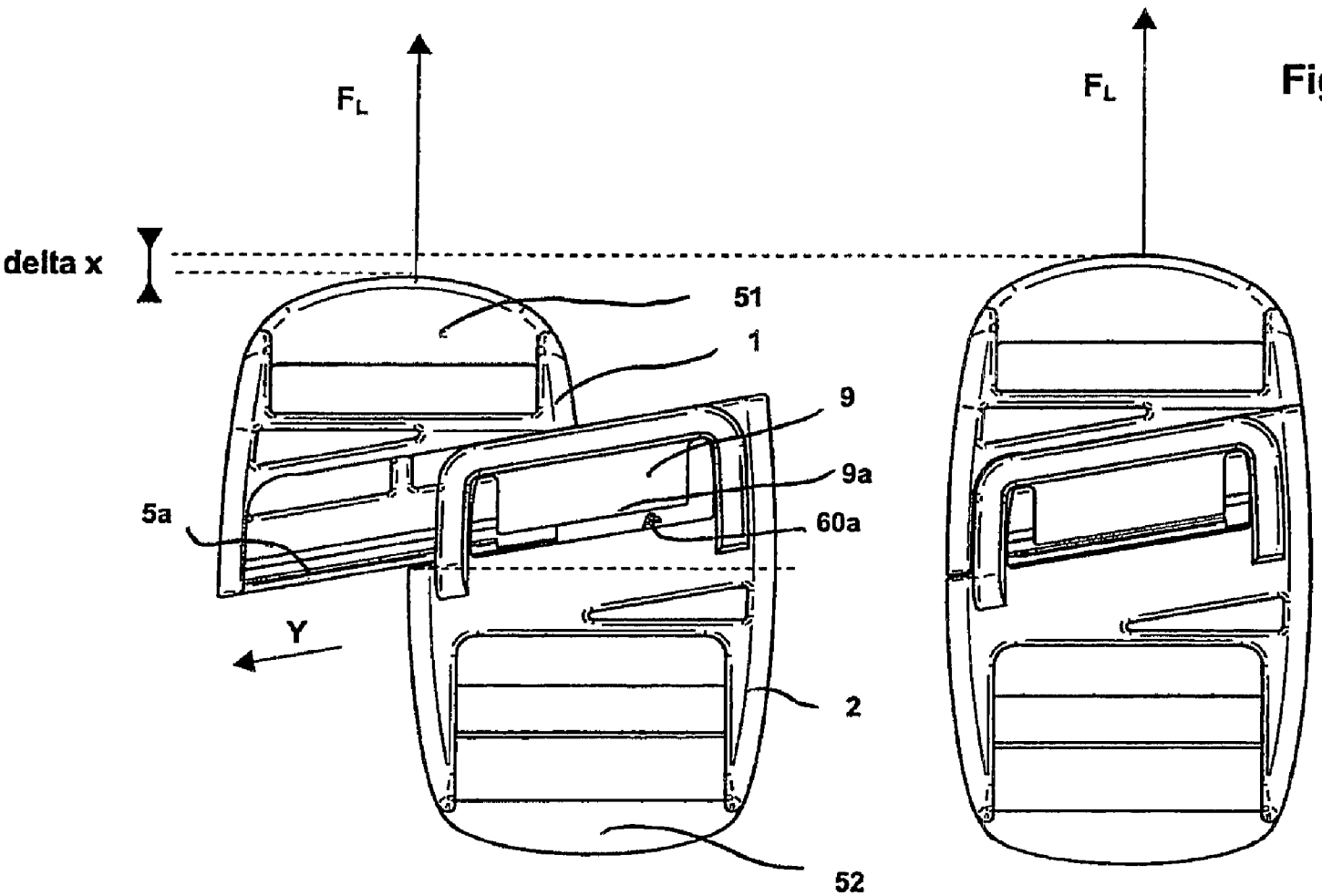
FIG. 1*e* shows the linear push-in/sliding buckle after being shifted into the open position.

FIG. 1*d* and FIG. 1*e* show the linear push-in/sliding buckle after being shifted into the open position. By shifting, three functions have been effected:

- Magnet 4 and armature or second magnet 8 gradually were sheared off from each other, whereby a pleasant haptics is achieved, which subjectively hardly requires force.
- The locking pieces 5*a*, 5*b* and the spring locking elements 9, 9' were laterally shifted against each other such that they came out of engagement, without the spring locking element 9, 9' having been pushed to the side, i.e. the snap-action closure has been opened without additional effort.
- In accordance with the invention, the connecting module 1 was shifted on the inclined movement track 60*a* such that it was pulled against the load $F_L$ by an amount delta x. For this purpose, a force depending on the load was required, i.e. the linear push-in/sliding buckle is harder to open under load than without load. The greater the angle alpha, the harder is the linear push-in/sliding buckle to open under load. Thus, different variations are conceivable: in a linear push-in/sliding buckle for use on rucksacks etc. the angle alpha=about 10°-20° will be sufficient for securing the buckle under load. The angle alpha can be chosen much greater for use with safety equipment.

Figure 7:
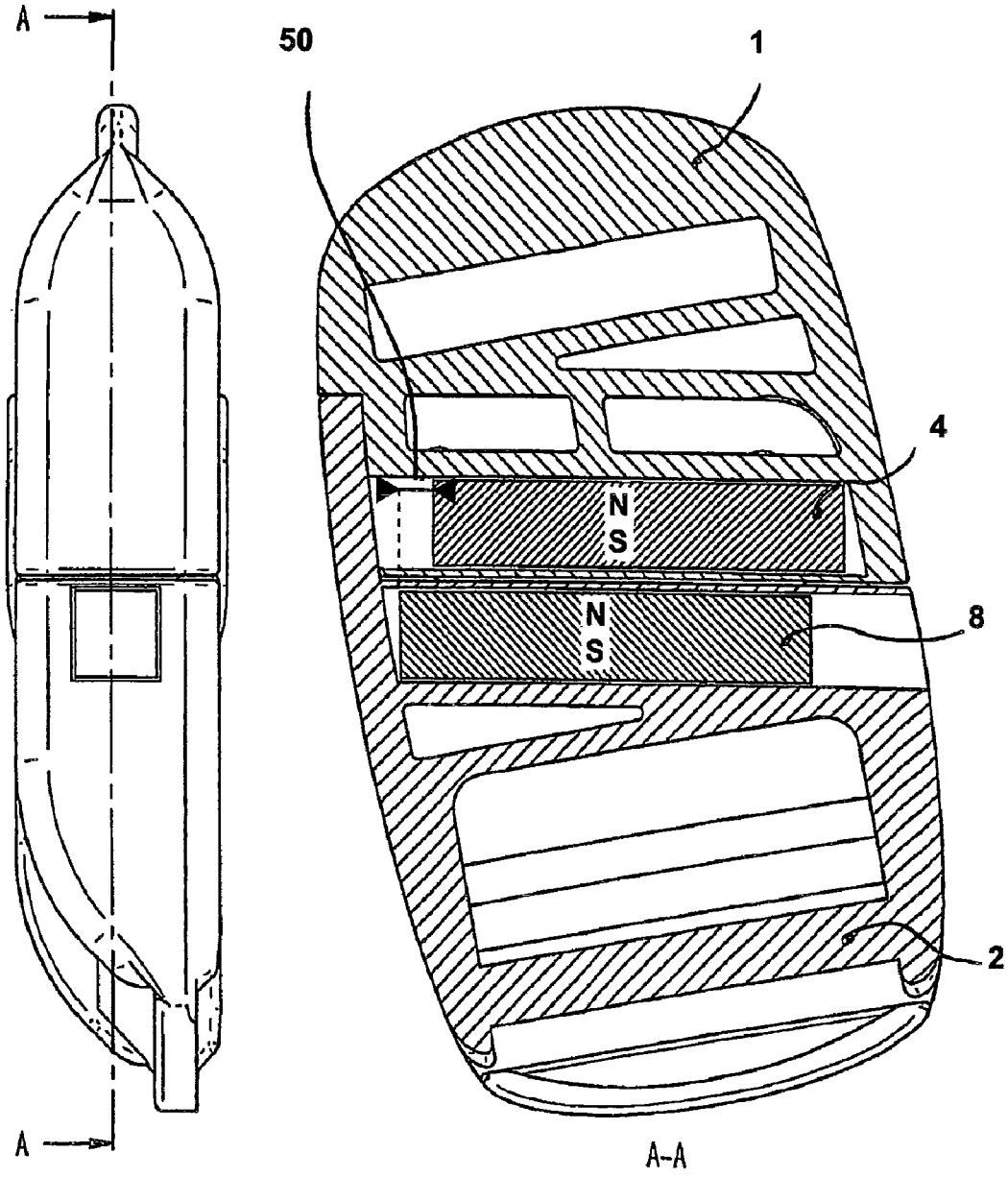
FIG. 7 shows a development of the linear push-in/sliding buckle according to FIGS. 1*a*-1*e*.

In FIG. 7 a development of the linear push-in/sliding buckle is shown.

FIGS. 2*a-e* each show a top view, a sectional view A-A and a perspective view of an arc-shaped push-in/swivel buckle for belt webbings in the most important phases of movement during opening and closing:

FIG. 2*a* shows the separate arc-shaped push-in/swivel buckle to be opened on both sides, comprising plug 1 and housing 2 with the belt webbing receptacles 51 and 52, wherein plug and housing oppose each other separately. Now, they are put together against the force $F_L$, which in use acts in the direction of the connecting line between the belt webbing receptacles. In the Figure, this connecting line is identical with the cutting line A-A. In the plug a magnet 4 is provided, and in the housing an armature or second magnet 8 is provided. Due to the magnetic attraction, plug 1 and housing 2 are pulled together in direction X, the magnetic force hence supports the closing under load. Locking pieces 5*a*, 5*b* mounted on the plug and spring locking elements 9, 9' mounted on the housing together form a snap-action closure.

FIG. 2*b* shows the arc-shaped push-in/swivel buckle while snapping into place. The latching noses 9*a*, 9*b* of the spring locking elements are pushed to the side by the locking pieces against the spring force of the spring locking elements, until they snap into place.

FIG. 2*c* shows the arc-shaped push-in/swivel buckle after snapping into the closed position. Next, the plug 1 is shifted for opening relative to the housing 2 on a circular-arc-shaped movement track 60*b* in an opening direction Y. In this embodiment, the movement track has two open positions, which are obtained by shifting in direction Y or Y'.

FIG. 2*d* shows the arc-shaped push-in/swivel buckle after shifting into the open position. By shifting, three functions have been effected:

- Magnet 4 and armature or second magnet 8 gradually were sheared off from each other, whereby a pleasant haptics is achieved, which subjectively hardly requires force.
- The locking pieces 5*a*, 5*b* and the spring locking elements 9, 9' were laterally shifted such that they came out of engagement, without the spring locking element 9, 9' having been pushed to the side, i.e. the snap-action closure has been opened without additional effort.
- A belt webbing 98 is mounted on the plug and belt webbing and plug have been regarded as a rigid structural unit, which can be assumed in commonly used modern tightly woven belt webbings made of plastics. In this embodiment, the center of the circular-arc-shaped movement track 60*b* lies outside the plug 1 and on the connecting line between the load housings. The belt webbing 98 must have a length greater than the radius of the movement track, so that the loaded end 51*a* lies above the center M.

FIG. 2*e* shows how the plug 1 was shifted on the circular-arc-shaped movement track 60*b* such that the loaded end 51*a* of the belt webbing 98 was pulled against the load $F_L$ by an amount delta x. For shifting in direction Y, a force dependent on the load was required, i.e. the arc-shaped push-in/swivel buckle is harder to open under load than without load, if the length of the belt webbing and the radius of the movement track were chosen correspondingly.

FIG. 2*e* shows this delta x in a comparison of the closed position and the open position.

Figure 3A:
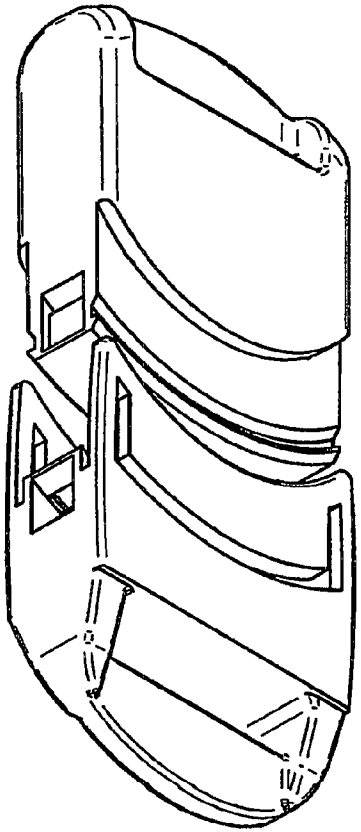
FIG. 3*a* shows an arc-shaped push-in/swivel buckle for belt webbings.
Figure 3A:
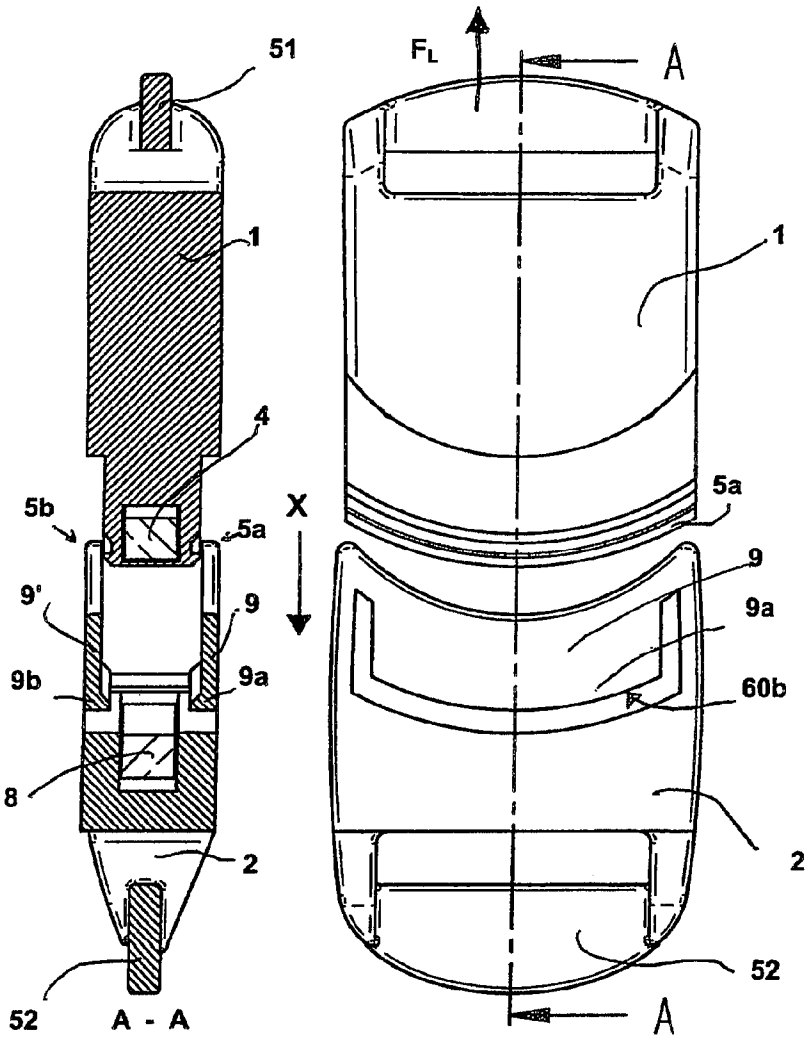

FIGS. 3*a-e* each show a top view, a sectional view A-A and a perspective view of a further inventive embodiment of an arc-shaped push-in/swivel buckle for belt webbings in the most important phases of movement during opening and closing:

FIG. 3*a* shows the open arc-shaped push-in/swivel buckle, comprising plug 1 and housing 2 with the belt webbing receptacles 51 and 52, wherein plug and housing oppose each other separately. Now, they are put together in direction X against the force $F_L$, which in use acts in direction of the connecting line between the belt webbing receptacles. In this Figure, this connecting line is identical with the cutting line A-A. In the plug a magnet 4 is provided, and in the housing an armature or a second magnet 8 is provided. Due to the magnetic attraction, plug 1 and housing 2 are pulled together in direction X, and the magnetic force hence supports the closing under load.

Locking pieces 5*a*, 5*b* mounted on the plug and spring locking elements 9, 9' mounted on the housing together form a snap-action closure.

Figure 3B:
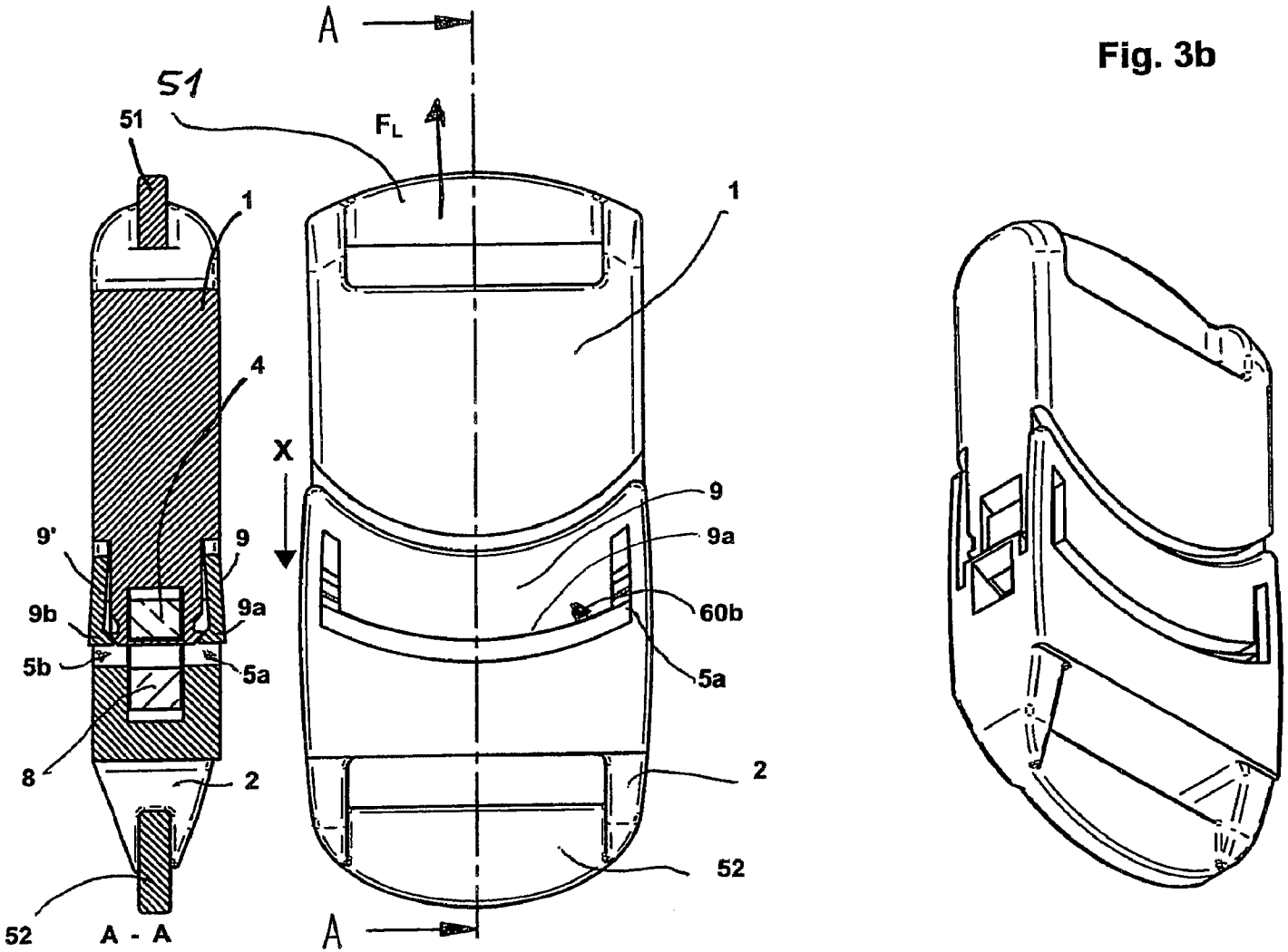
FIG. 3*b* shows the arc-shaped push-in/swivel buckle according to FIG. 3*a* while snapping into place.

FIG. 3*b* shows the arc-shaped push-in/swivel buckle while snapping into place. The latching noses 9*a*, 9*b* of the spring locking elements are pushed to the side by the locking pieces against the spring force of the spring locking elements, until they snap into place.

Figure 3C:
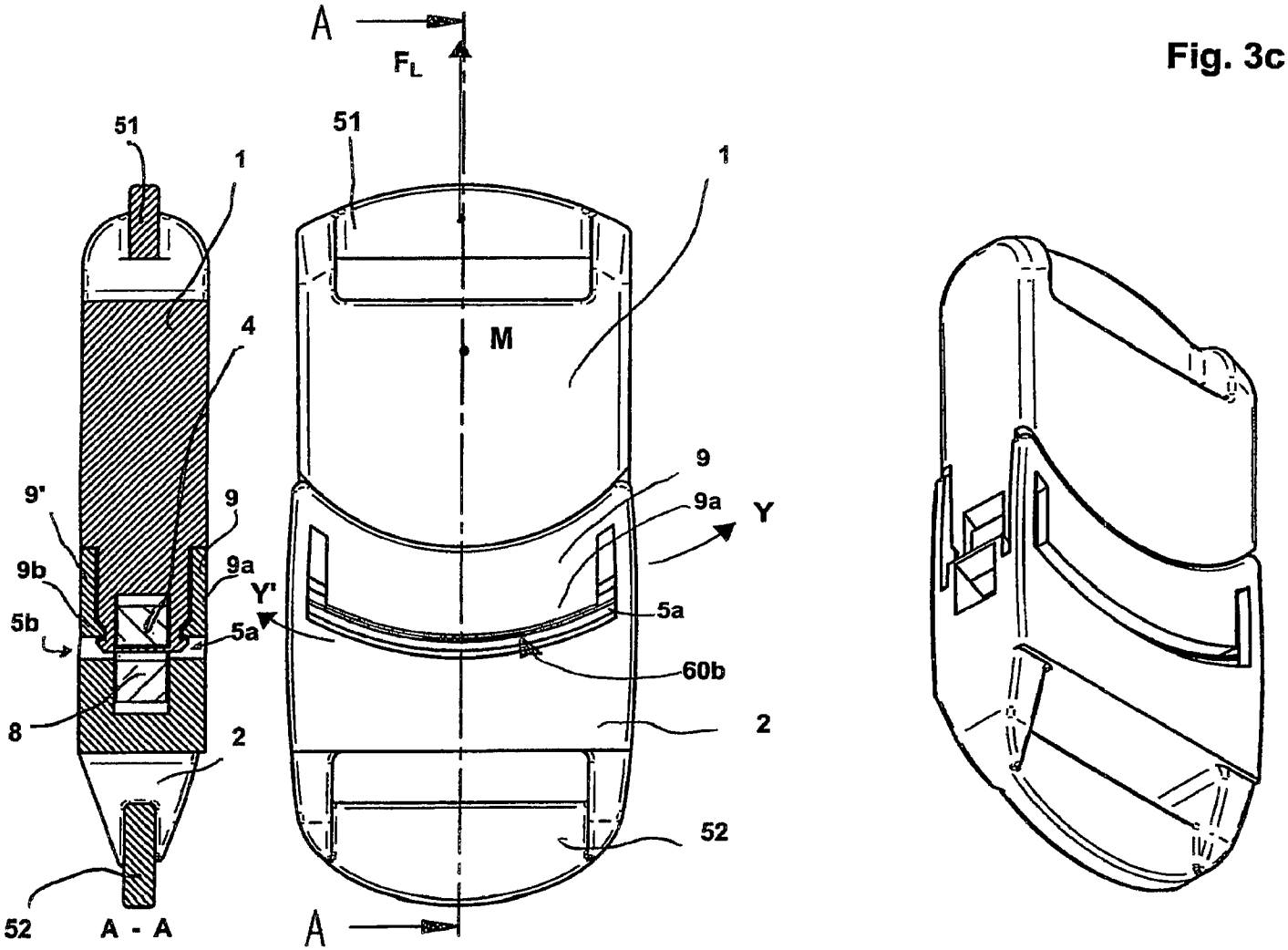
FIG. 3*c* shows the arc-shaped push-in/swivel buckle according to FIG. 3*a* after snapping into the closed position.

FIG. 3*c* shows the arc-shaped push-in/swivel buckle after snapping into the closed position. Next, the plug 1 is shifted for opening relative to the housing 2 on the circular-arc-shaped movement track 60*b* in an opening direction Y. In this embodiment, the movement track has two open positions, which are obtained by shifting in direction Y or Y'.

Figure 3D:
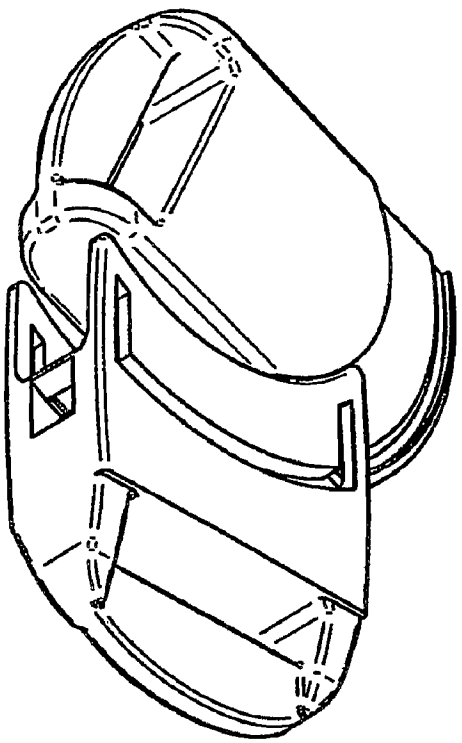
FIG. 3*d* shows the arc-shaped push-in/swivel buckle according to FIG. 3*a* after shifting into the open position.
Figure 3D:
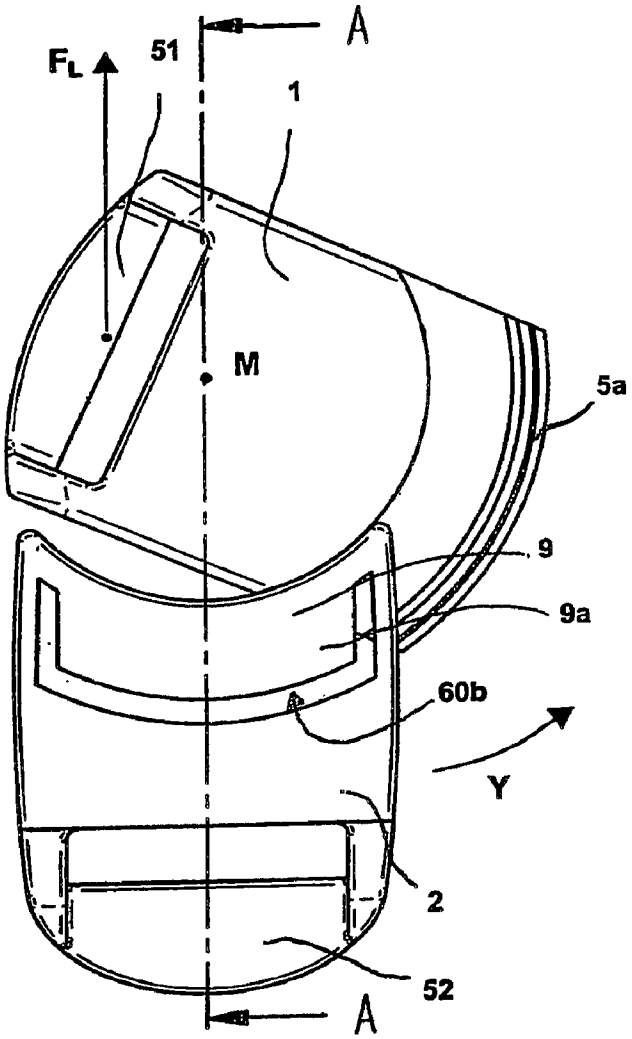
Figure 3D:
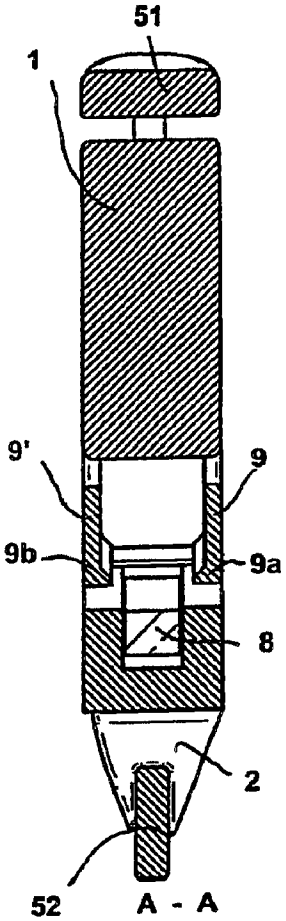
Figure 3E:
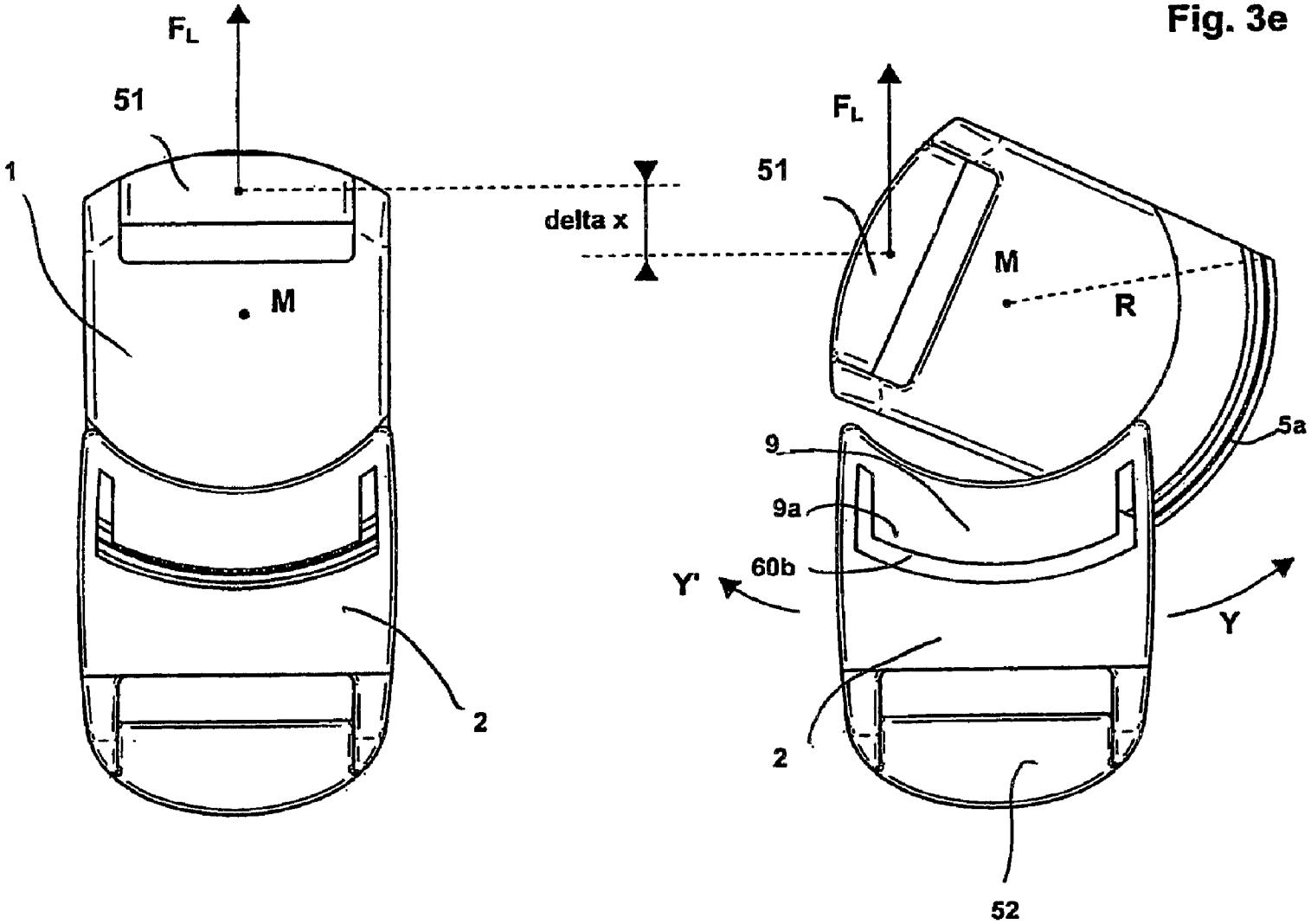
FIG. 3*e* shows the arc-shaped push-in/swivel buckle according to FIG. 3*a* after shifting into the open position.

FIG. 3*d* and FIG. 3*e* show the arc-shaped push-in/swivel buckle after shifting into the open position. By shifting, three functions have been effected:

- Magnet 4 and armature or second magnet 8 gradually were sheared off from each other, whereby a pleasant haptics is achieved, which subjectively hardly requires force.
- The locking pieces 5*a*, 5*b* and the spring locking elements 9, 9' were laterally shifted such that they came out of engagement, without the spring locking element 9, 9' having been pushed to the side, i.e. the snap-action closure has been opened without additional effort.
- The plug 1 has been shifted on the circular-arc-shaped movement track 60*b* such that the belt webbing receptacle 51 was pulled against the load $F_L$ by an amount delta x. The center M of the movement track 60*b* lies inside the plug 1 in this embodiment, the center (M) lies on the connecting line between the load housings, and the belt webbing receptacle 51 lies above the center M. For shifting the belt webbing receptacle 51 by delta x, a force dependent on the load $F_L$ was required, i.e. the arc-shaped push-in/sliding buckle is harder to open under load than without load.

FIG. 3*e* shows the delta x in a comparison of the closed position and the open position.

Depending on how strongly the arc-shaped push-in/swivel buckle should be secured under load, the radius of the movement track 60*b* and the distance of the belt webbing receptacle 51 from the center M should be chosen correspondingly.

Figure 4:
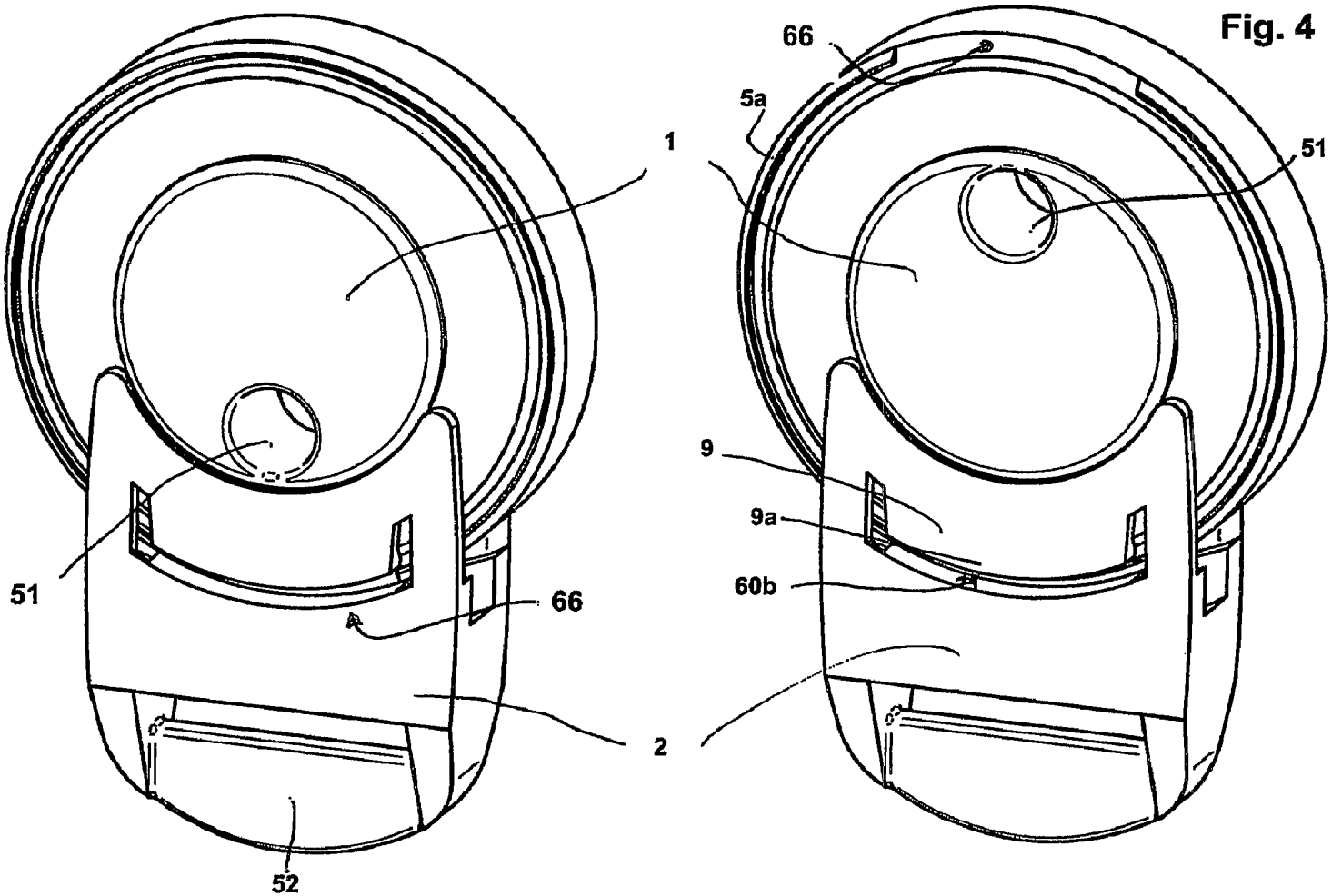
FIG. 4 shows a development of the invention according to FIGS. 3*a-e*.

FIG. 4 shows a development of the invention according to FIGS. 3*a-e*. Here, the release of the locking piece is effected only very late, although magnet 4 and armature 8 have already been sheared off from each other. In the present embodiment, the release is effected only after a rotation by 180°. The locking piece is formed all around and only interrupted by the release gap 66. With a rotation by about 180°, opening by the inverted magnet 4 in the plug 1 can be supported by a suitable arrangement of the magnets.

FIGS. 5*a-d* shows a linear push-in/sliding buckle with opening by the force-deflecting surface. It differs from the embodiment according to FIG. 1*a-e* only by the different opening. Therefore, only the opening different from FIG. 1 will be discussed.

On the plug, the force-deflecting beveled surfaces 70*a*, 70*b* are arranged, and on the spring locking elements of the housing 2 the force-deflecting beveled surfaces 71*a*, 71*b* are arranged. In functional terms, the force-deflecting surfaces 71*a*, 71*b* are not absolutely necessary, but they improve the function.

Figure 5A:
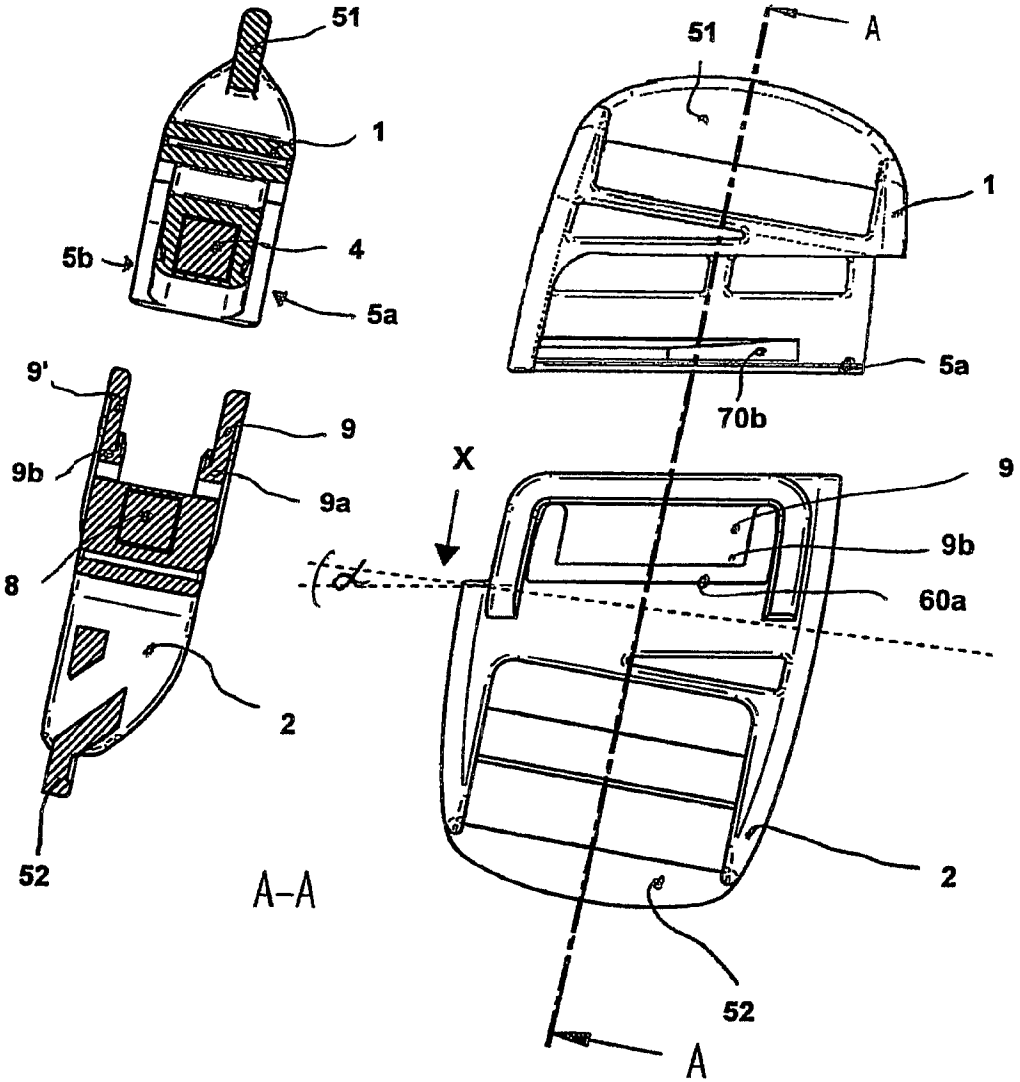
FIG. 5*a* shows a linear push-in/sliding buckle.

FIG. 5*a* shows a top view and a sectional view A-A of a linear push-in/sliding buckle consisting of plug 1 and housing 2 in a separate position.

Figure 5B:
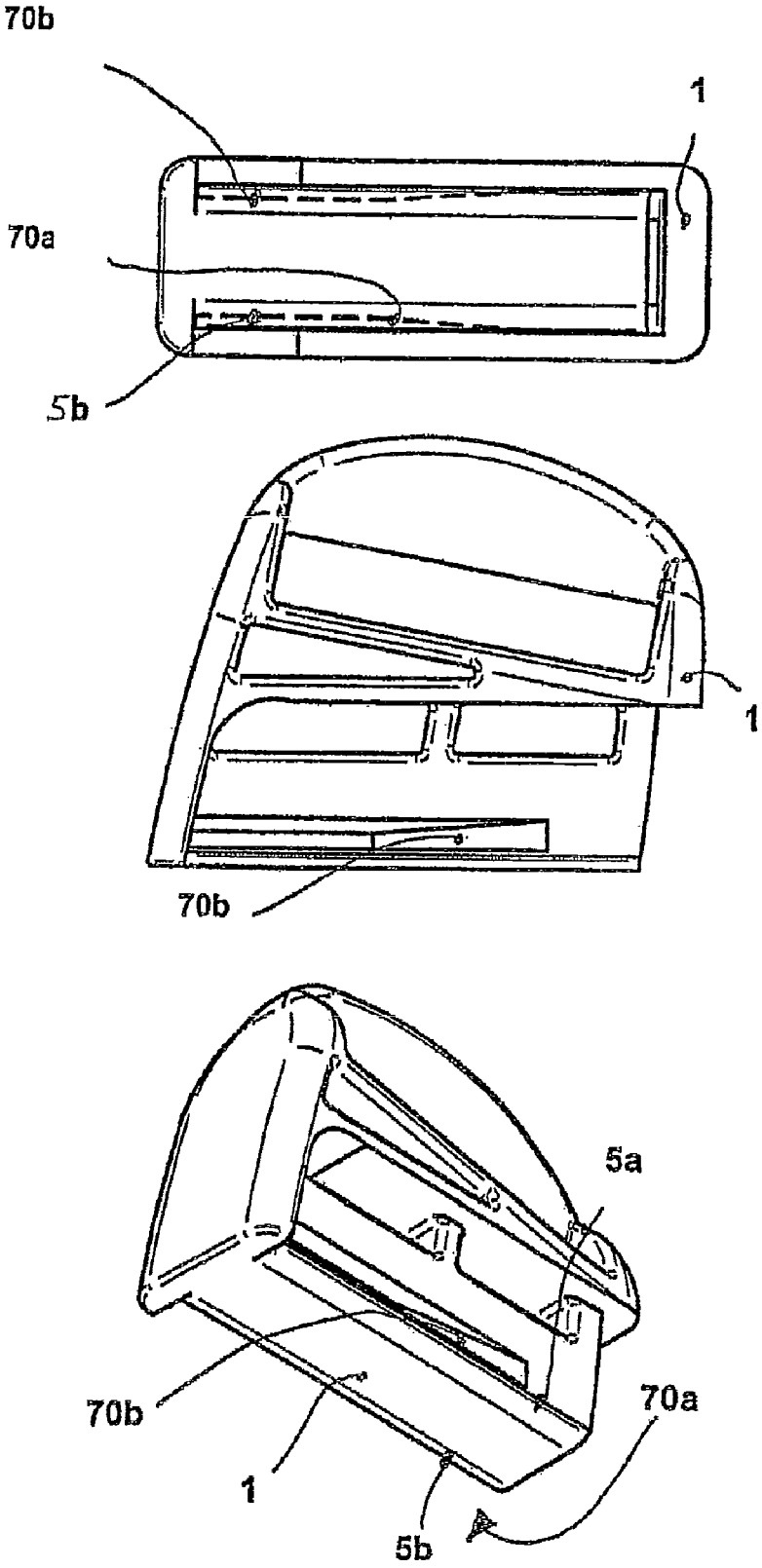
FIG. 5*b* shows the plug of the linear push-in/sliding buckle according to FIG. 5*a*.
Figure 5C:
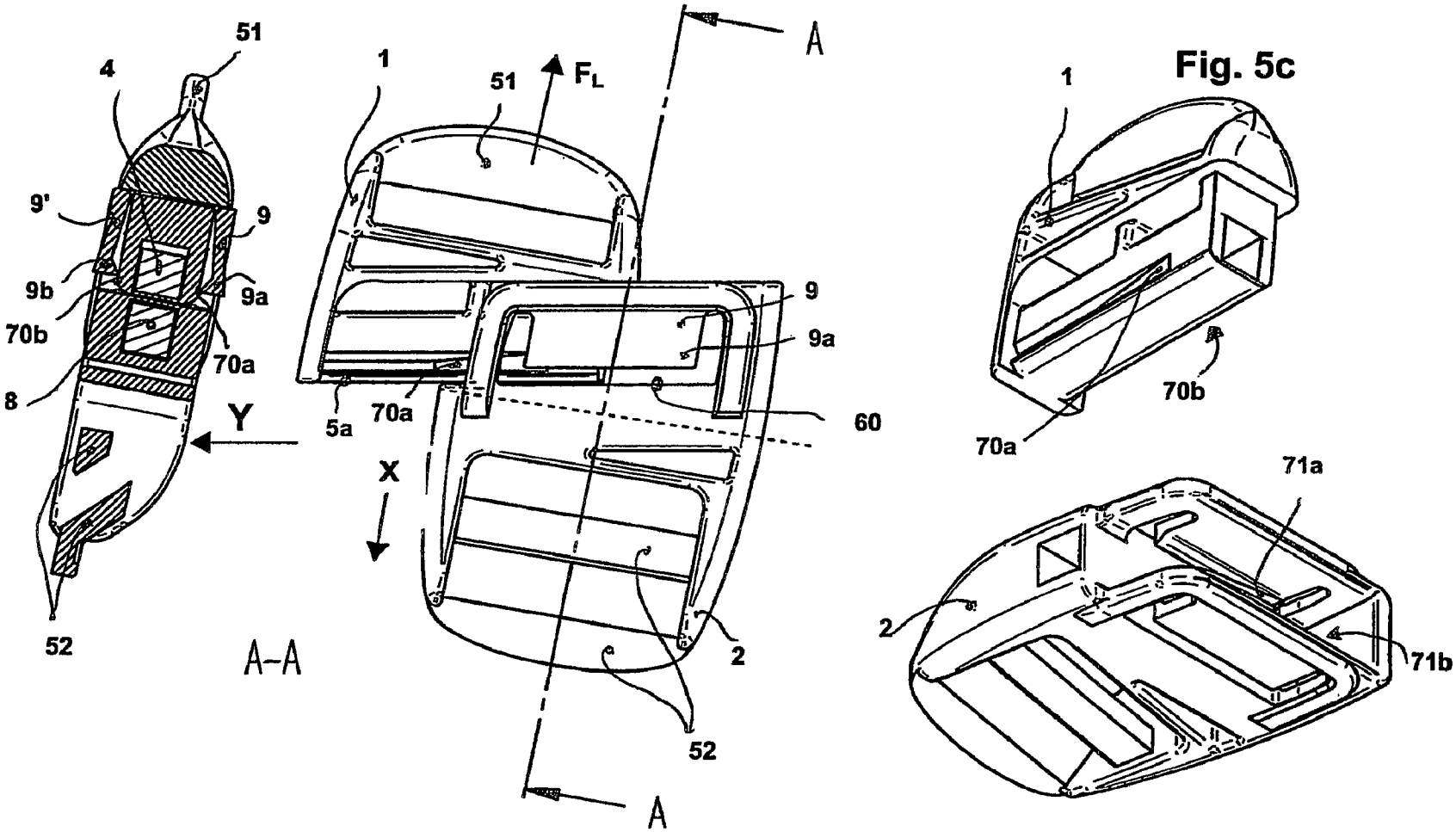
FIG. 5*c* shows the opening of the linear push-in/sliding buckle according to FIG. 5*a*.
Figure 5D:
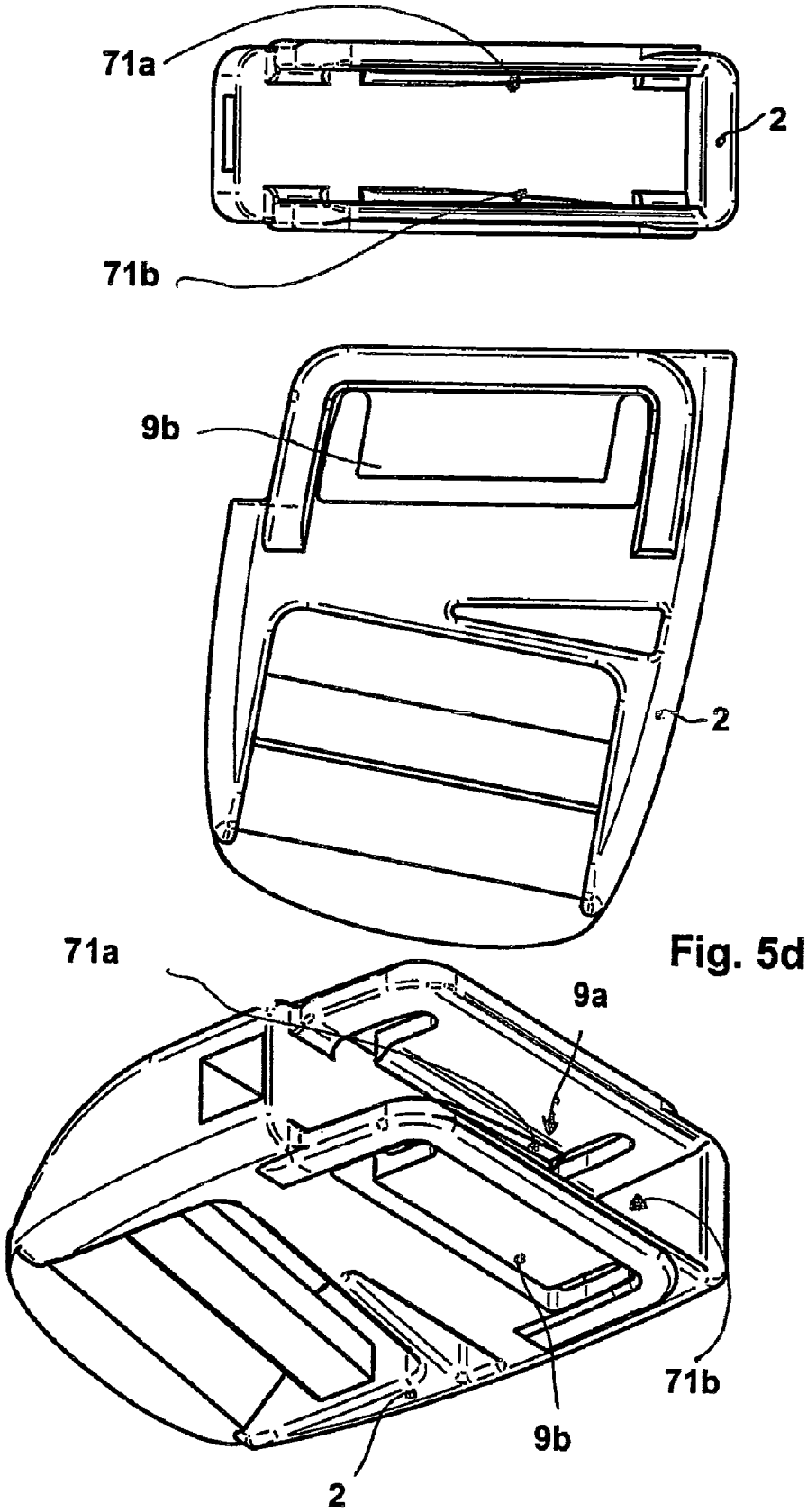
FIG. 5*d* shows the housing of the linear push-in/sliding buckle according to FIG. 5*a*.

FIG. 5*b* shows the plug and FIG. 5*d* shows the housing each in different views for a better understanding of the position of the force-deflecting beveled surfaces 70*a,b* and 71*a,b*.

FIG. 5*c* shows the opening different from FIG. 1*c*: Due to the force-deflecting surfaces 70*a, b* 71*a, b* the spring locking element is gradually pushed to the side during the displacement of the plug from the closed position into the open position in direction Y, i.e. as compared to the version of FIG. 1 a certain additional effort is required, in order to release the linear push-in/sliding buckle. This is advantageous when opening the linear push-in/sliding buckle should be rendered more difficult, i.e. in safety applications.

Figure 6A:
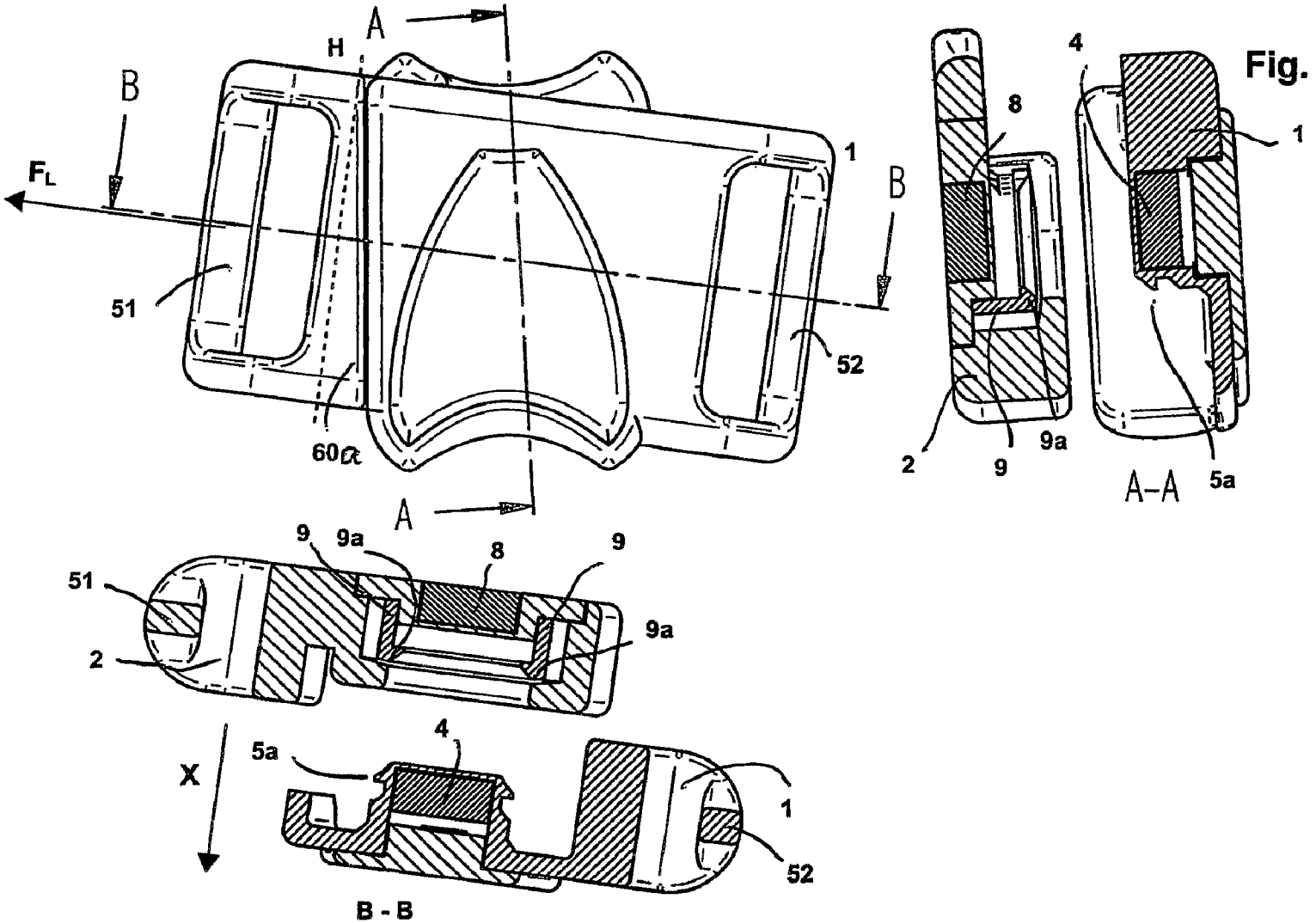
FIG. 6*a* shows a frontal sliding buckle.
Figure 6B:
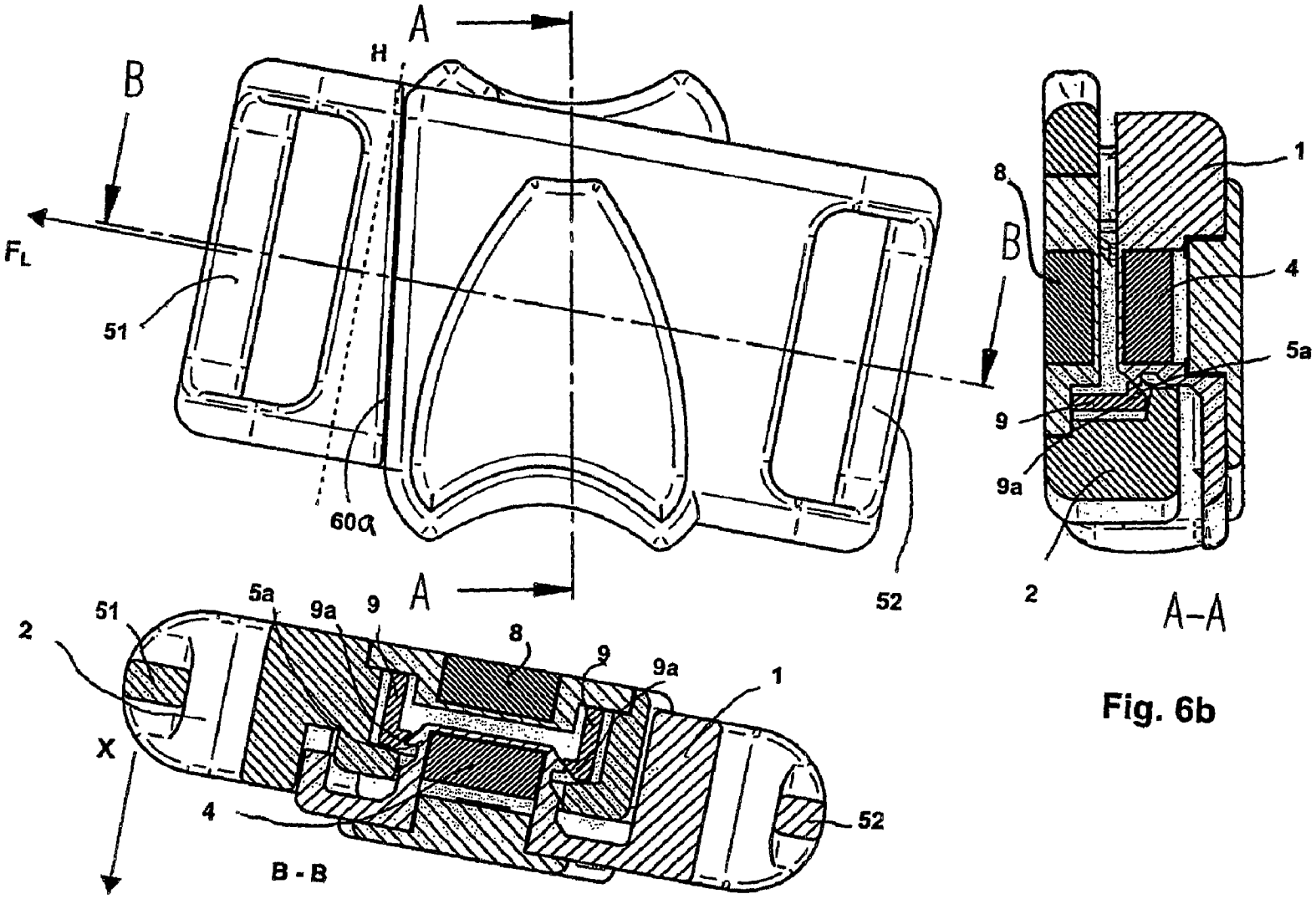
FIG. 6*b* shows the frontal sliding buckle according to FIG. 6*a* when snapping into place.
Figure 6C:
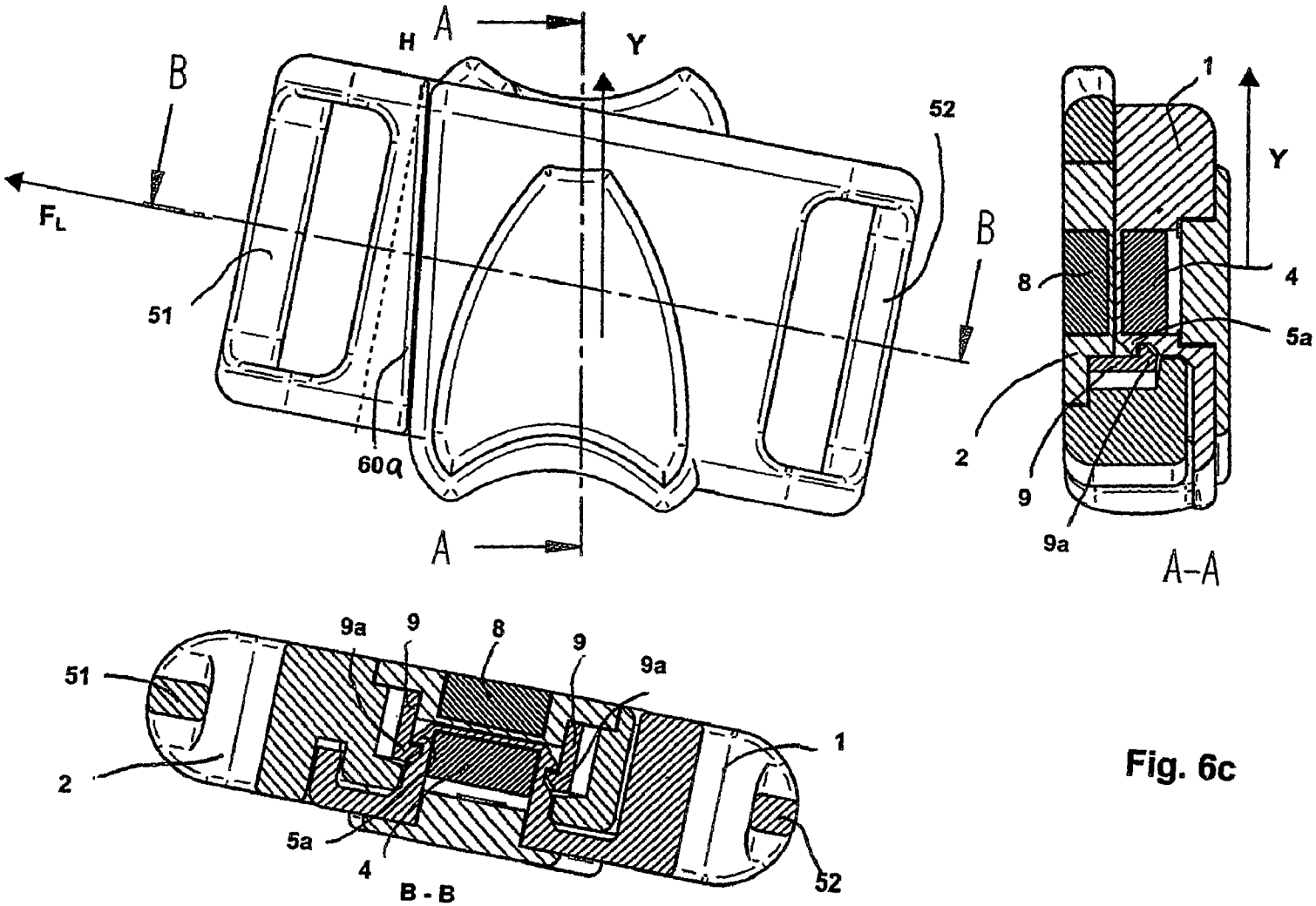
FIG. 6*c* shows the frontal sliding buckle according to FIG. 6*a* after snapping into the closed position.
Figure 6E:
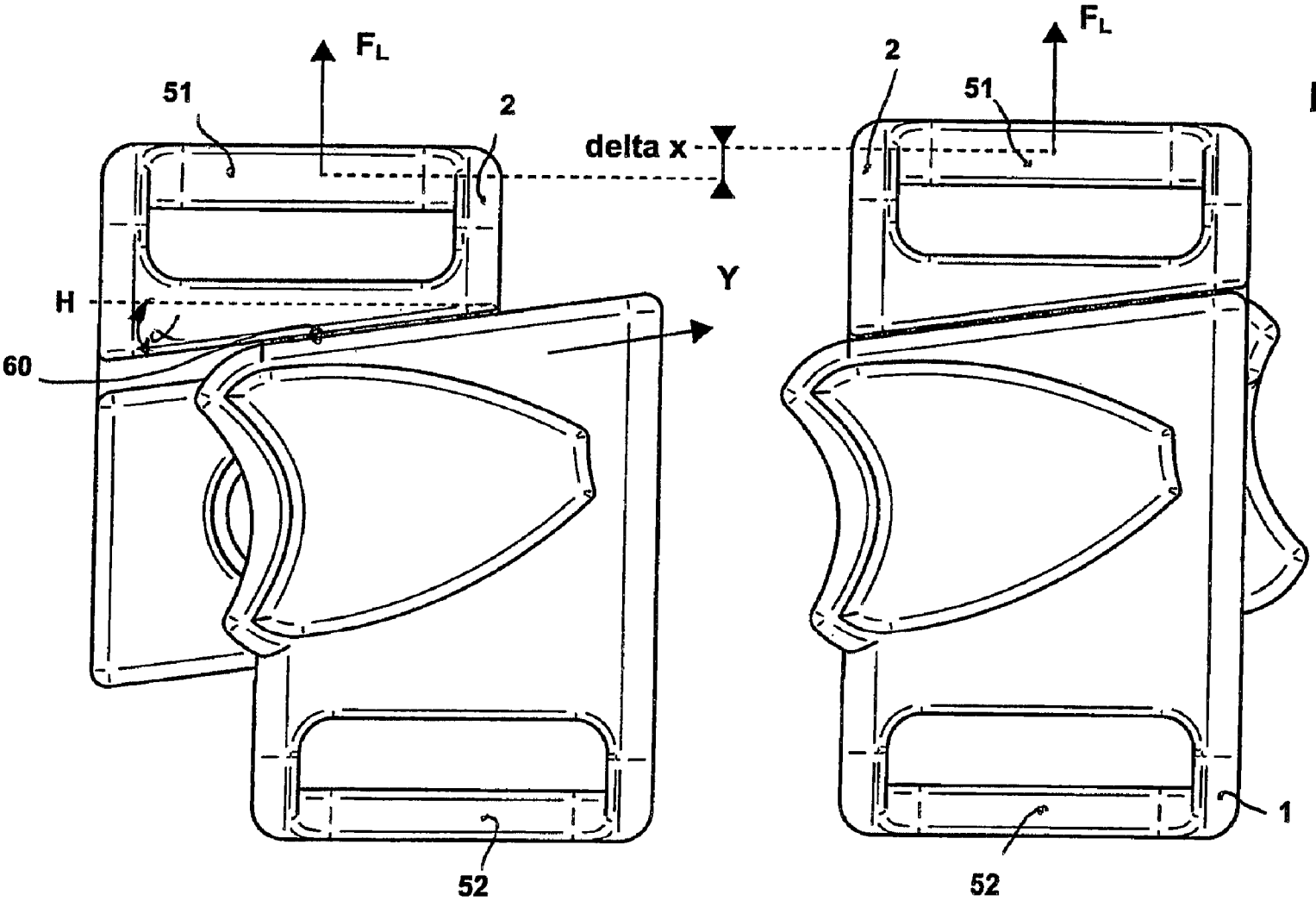
FIG. 6*e* shows the frontal sliding buckle according to FIG. 6*a* after being shifted in the open position.
Figure 6F:
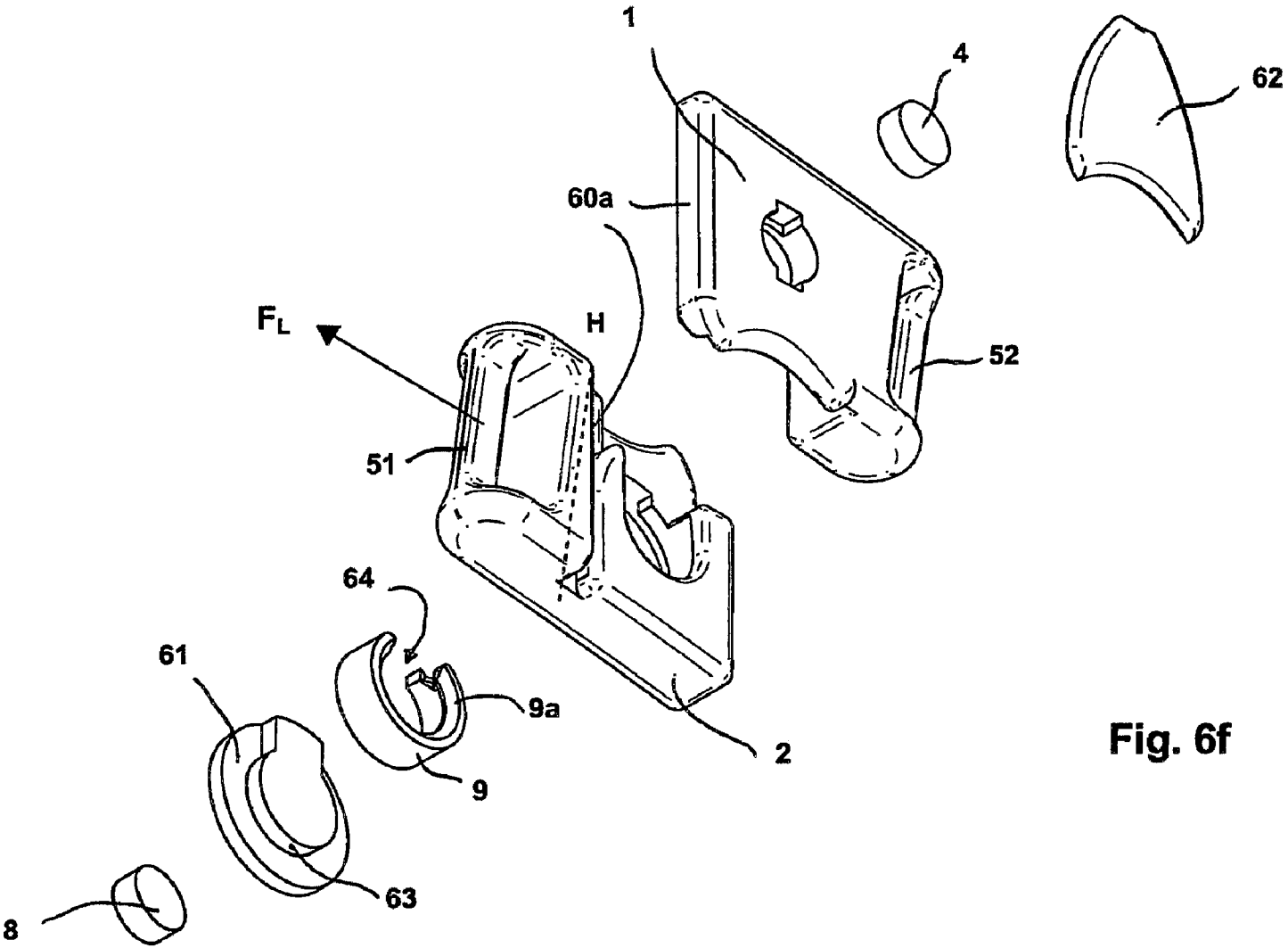
FIG. 6*f* shows an exploded representation of the frontal sliding buckle according to FIG. 6*a* from below.
Figure 6G:
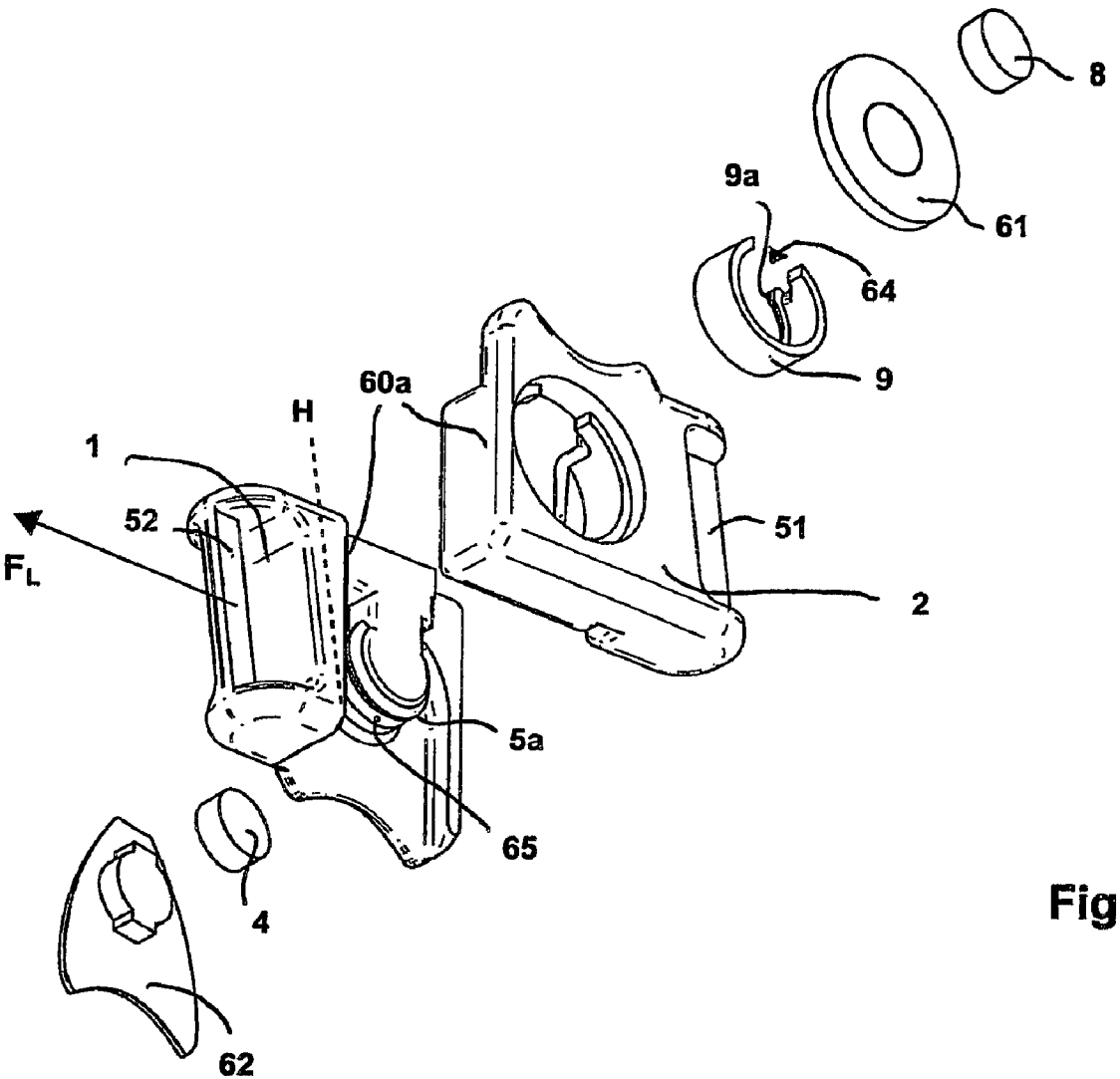
FIG. 6*g* shows an exploded representation of the frontal sliding buckle according to FIG. 6*a* from above.

FIGS. 6*a*-6*g* show a frontal sliding buckle, which in contrast to FIG. 1 closes vertical to the load $F_L$ in direction X. FIGS. 6*f* and 6*g* show an exploded representation from below and from above.

In the plug 1 a magnet 4 is arranged. It is concealed by a decorative cap 62. On the plug, a locking piece 5*a* is arranged as a beveled edge extending around a cylinder 65, which forms a snap-action closure with a spring washer 9 arranged in the housing. On the plug, a belt webbing receptacle 52 is arranged. In the housing 2, the spring washer 9 is arranged with a circumferential latching nose 9*a*. It is held centered in the housing with an inner stop 63 of an end cap 61. On the housing, a belt webbing receptacle 51 is provided. Via an inclined movement track 60*a*, which is obliquely directed at an angle alpha with respect to the horizontal H, wherein the horizontal is vertical to a load $F_L$ which in use is applied vertically between the belt webbing receptacles 51, 52, plug and housing are obliquely shifted against each other.

The phases shown in FIGS. 6*a*-6*e* correspond to the phases shown in FIGS. 1*a-e*, and they each show a top view, a sectional view A-A and a perspective view of an inventive frontal sliding buckle for belt webbings in the most important phases of movement during opening and closing:

FIG. 6*a* shows a frontal sliding buckle comprising plug 1 and housing 2 with the belt webbing receptacles 51 and 52, wherein plug and housing oppose each other separately. They are now put together in direction X. In the plug a magnet 4 is provided, and in the housing an armature or a second magnet 8 is provided. Due to the magnetic attraction, plug 1 and housing 2 are pulled together in direction X, and the magnetic force hence supports the closing under load. On closing, the magnetic-force assistance is not as pronounced as in FIG. 1 because of the location of the closing direction X different from FIG. 1. The magnetic force supports closing by the restoring force of the magnets lateral to the main direction of attraction. This restoring force is weaker than the attraction in the main direction of attraction. What is, however, essential for an easy closing under load is the fact that on closing the plug and the housing need not be pulled against each other against the load $F_L$ by an additional delta y as in FIG. 10*a* with a closure according to the prior art, so that no unnecessary force is required on closing. The locking piece 5*a* arranged on the plug and the spring washer 9 arranged in the housing together form a snap-action closure.

FIG. 6*b* shows the frontal sliding buckle when snapping into place. Magnet 4 and armature or second magnet 8 are dimensioned and arranged such that their force of attraction is sufficient to automatically pull the snap-action closure together in direction X. The spring washer 9 is spread against the spring force of the spring washer by the locking piece 5*a*, until the locking piece snaps into place behind the latching nose 9*a*.

FIG. 6*c* shows the frontal sliding buckle after snapping into the closed position. Next, the plug 1 is shifted for opening relative to the housing 2 on an inclined movement track 60*a* in opening direction Y. The inclined movement track 60*a* is disposed obliquely at the angle alpha with respect to the horizontal H (vertical to the load $F_L$), in other words: the angle between load $F_L$ and opening direction Y is greater than 90°.

FIG. 6*d* and FIG. 6*e* show the frontal sliding buckle after being shifted in the open position. By shifting, three functions have been effected:

- Magnet 4 and armature or second magnet 8 gradually were sheared off from each other, whereby a pleasant haptics is achieved, which subjectively hardly requires force.
- The cylinder 65 with locking piece 5*a* and the spring washer 9 were laterally shifted against each other such that they have come out of engagement, i.e. the snap-action closure has been opened. In doing so, the cylinder passes through an opening 64 in the spring washer.
- In accordance with the invention, the plug 1 was shifted on the inclined movement track 60*a* such that it was pulled against the load $F_L$ by an amount delta x. For this purpose, a force dependent on the load $F_L$ was required, i.e. the frontal sliding buckle is harder to open under load than without load. The greater alpha, the harder the frontal sliding buckle is to open. Thus, different variations are conceivable: in a frontal sliding buckle for use on rucksacks etc. the angle alpha=about 10°-20° will be sufficient for securing the buckle under load. The angle alpha can be chosen much greater for use on safety equipment.

FIG. 6*e* shows the delta x in a comparison of the closed position and the open position. The opening 64 in the spring washer, from which the cylinder 65 moves out on opening, can be chosen differently large for different applications.

- If the opening 64 is chosen of equal size with the cylinder 65, the spring washer is not spread while being shifted in direction Y, i.e. the frontal sliding buckle opens very easily.
- If the opening 64 is chosen smaller than the diameter of the cylinder 65, the spring washer is spread while being shifted in direction Y, i.e. the frontal sliding buckle opens with a predetermined resistance.
- If the opening 64 is chosen very small, so that the spring washer spreads further than on snapping into place according to FIG. 6*b*, a different opening behavior exists: The spring washer then has been spread so far that opening is also possible against the closing direction X, and an alternative opening variant exists in that the spring locking element is pushed to the side by a force-deflecting beveled surface.

FIG. 7 shows a sectional representation of the push-in/sliding buckle from FIG. 1*a-e* in the closed position. It represents a development in that the magnets 4 and 8 are mounted offset with respect to each other such that in the closed position the magnetic force produces a restoring force, which effects an automatic return of the connecting module 1 into the closed position. In addition to the inclined movement track, this prevents an inadvertent opening under load, in particular at the start of an inadvertent displacement from the closed position into the open position.

FIGS. 8*a-f* each show a top view, a sectional view A-A and a perspective view of an inventive arc-shaped push-in/sliding buckle for belt webbings in the most important phases of movement during opening and closing. According to one embodiment it can be opened on both sides by shifting in direction Y or Y' to obtain two open positions. According to another embodiment, locking piece 5*a* and guideway 60*a*, 60*a*' are formed such that the locking piece can swivel independent of the contour of locking piece and movement track, i.e. it is not necessarily guided in the contour of the movement track. Due to the pivotability, plug and housing can align collinearly under the load $F_L$.

Figure 8A:
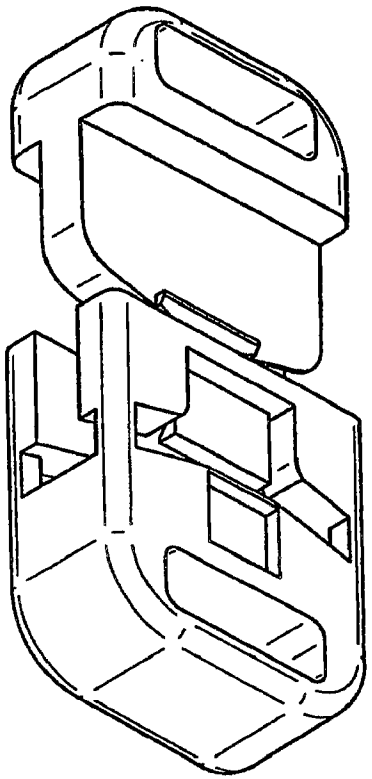
FIG. 8*a* shows an open push-in/sliding buckle for belt webbings.
Figure 8A:
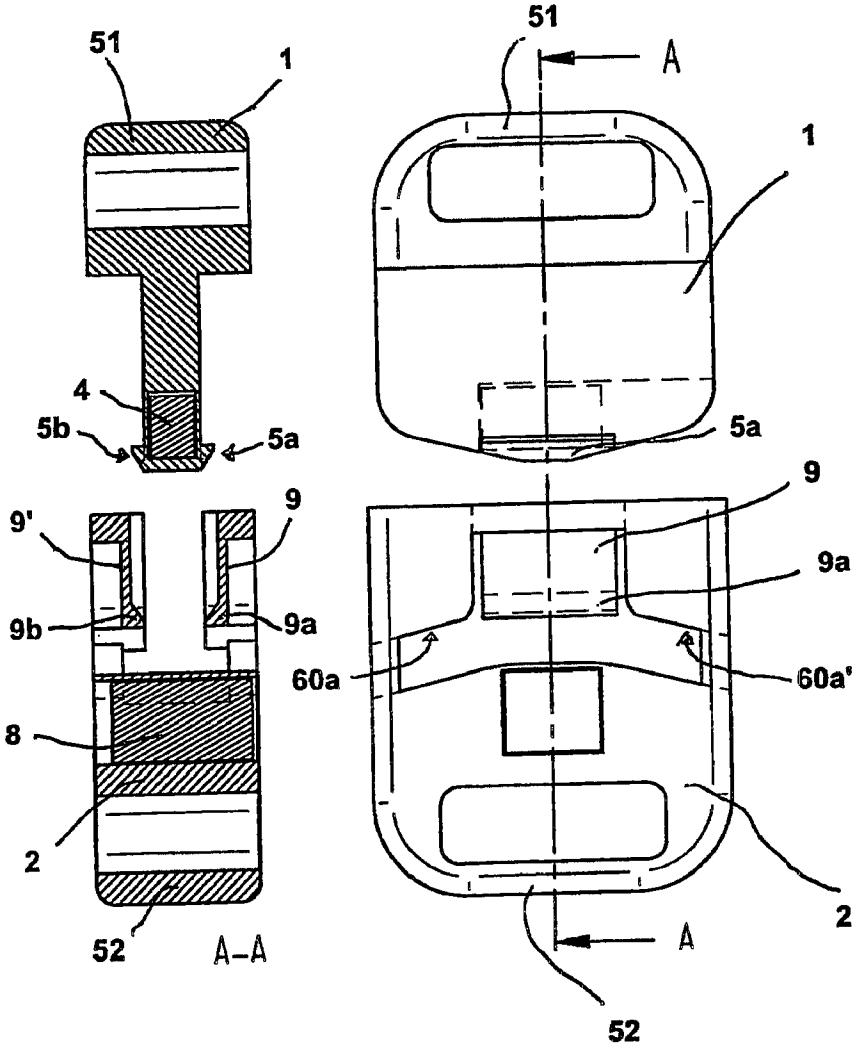

FIG. 8*a* shows the open push-in/sliding buckle comprising plug 1 and housing 2 with the belt webbing receptacles 51 and 52, wherein plug and housing oppose each other separately. Now, they are put together in direction X against the force $F_L$, which in use acts in direction of the connecting line between the belt webbing receptacles. In this Figure, this connecting line is identical with the cutting line A-A. In the plug a magnet 4 is provided, and in the housing an armature or a second magnet 8 is provided. Due to the magnetic attraction, plug 1 and housing 2 are pulled together in direction X, the magnetic force hence supports the closing under load. Locking pieces 5*a*, 5*b* mounted on the plug and spring locking elements 9, 9' mounted on the housing together form a snap-action closure.

Figure 8B:
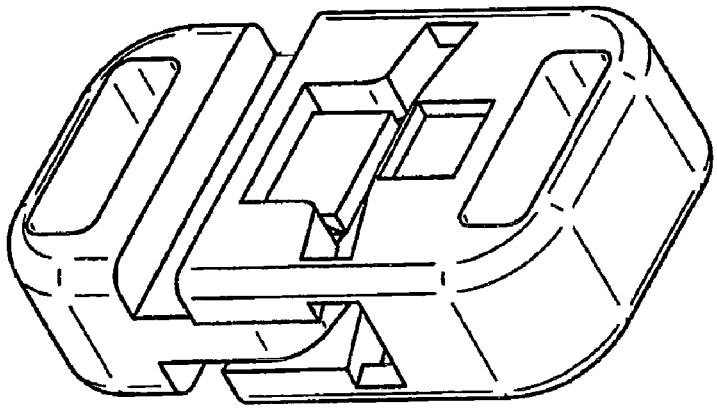
FIG. 8*b* shows the push-in/sliding buckle according to FIG. 8*a* when snapping into place.
Figure 8B:
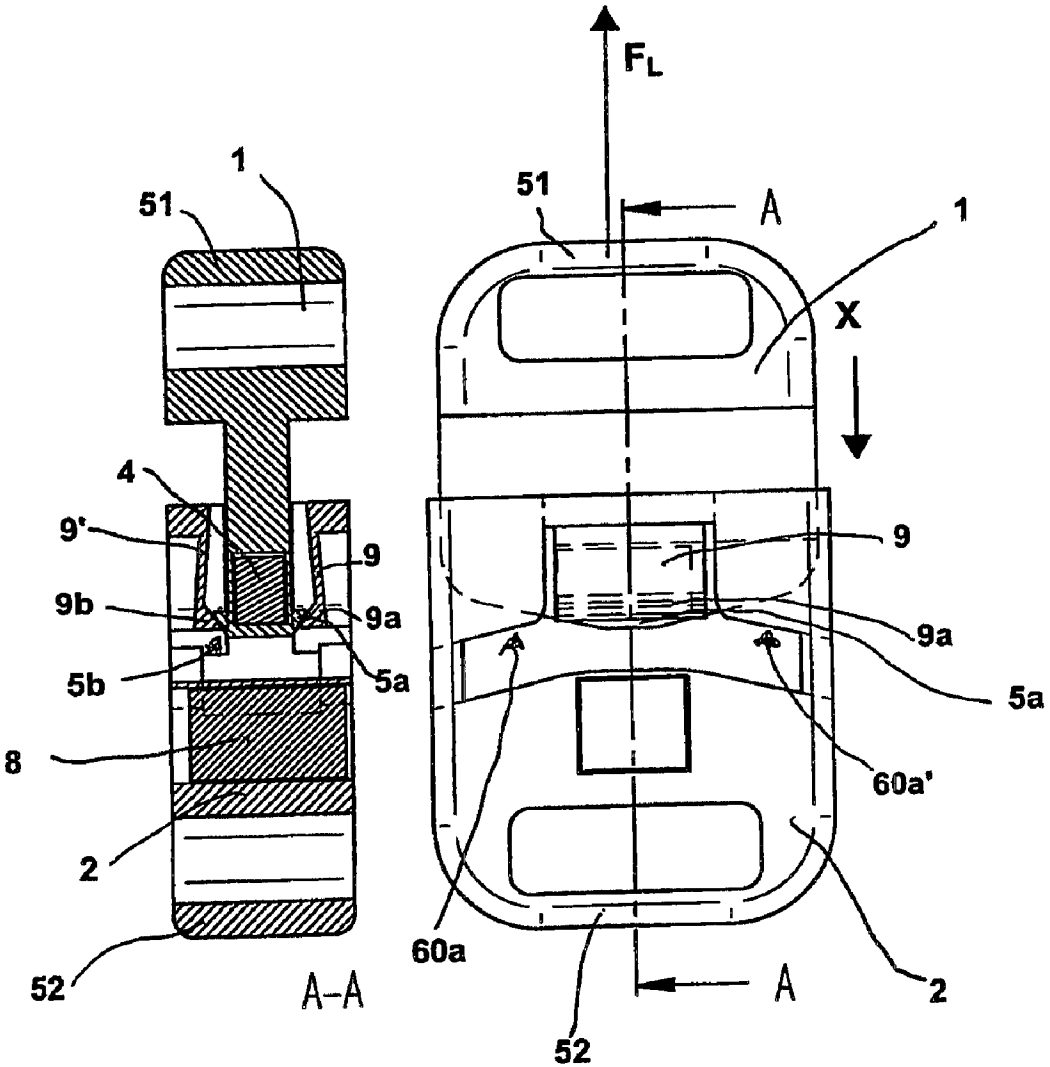

FIG. 8*b* shows the push-in/sliding buckle when snapping into place. The latching noses 9*a*, 9*b* of the spring locking elements are pushed to the side by the locking pieces against the spring force of the spring locking elements, until they snap into place.

Figure 8C:
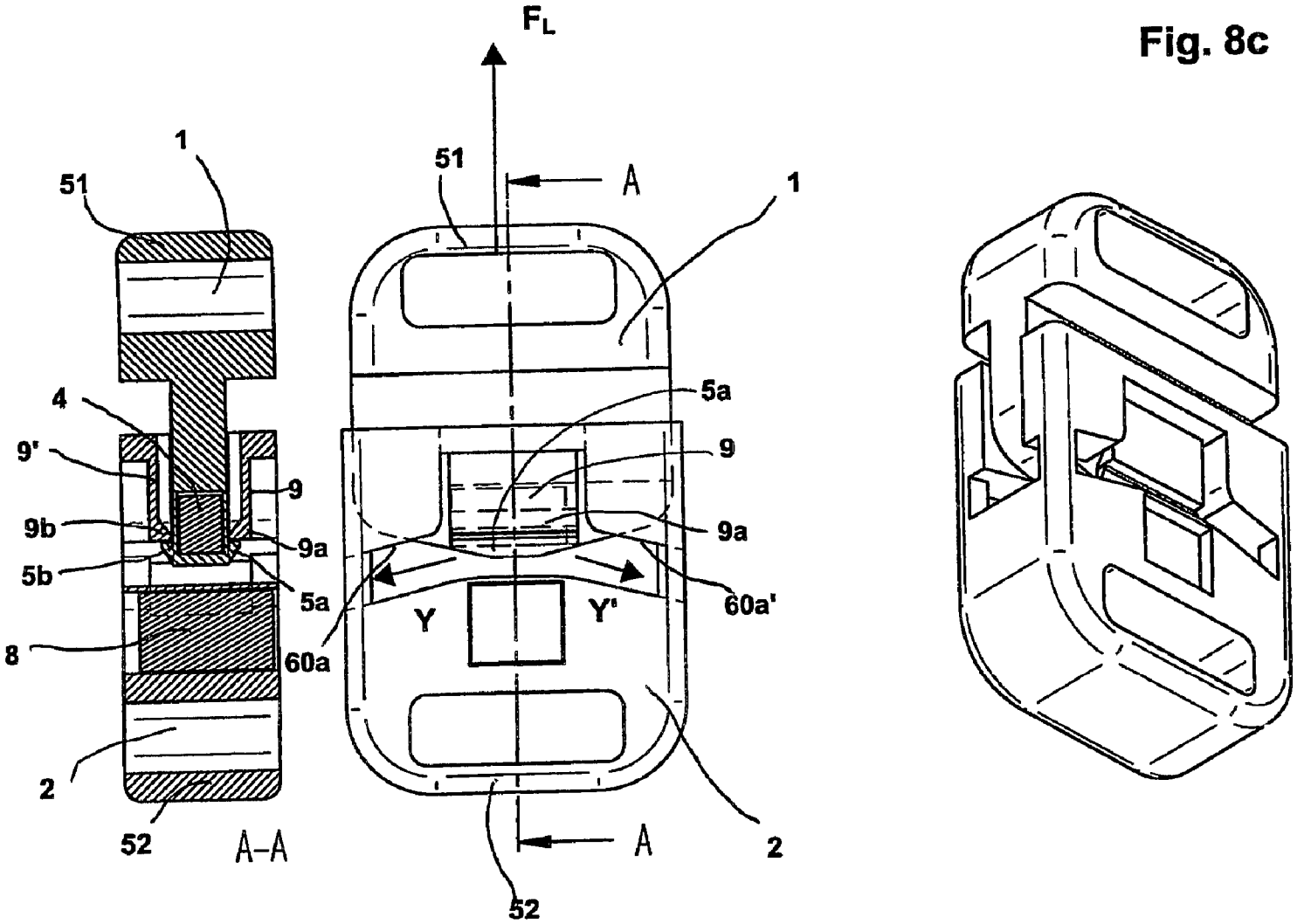
FIG. 8*c* shows the push-in/sliding buckle according to FIG. 8*a* after snapping into the closed position.

FIG. 8*c* shows the push-in/sliding buckle after snapping into the closed position. Next, the plug 1 is shifted for opening relative to the housing 2 on the inclined movement track 60' in an opening direction Y'. In this embodiment, the movement track has two open positions, which are obtained by shifting in direction Y or Y'. The closed position lies in the center therebetween.

Figure 8F:
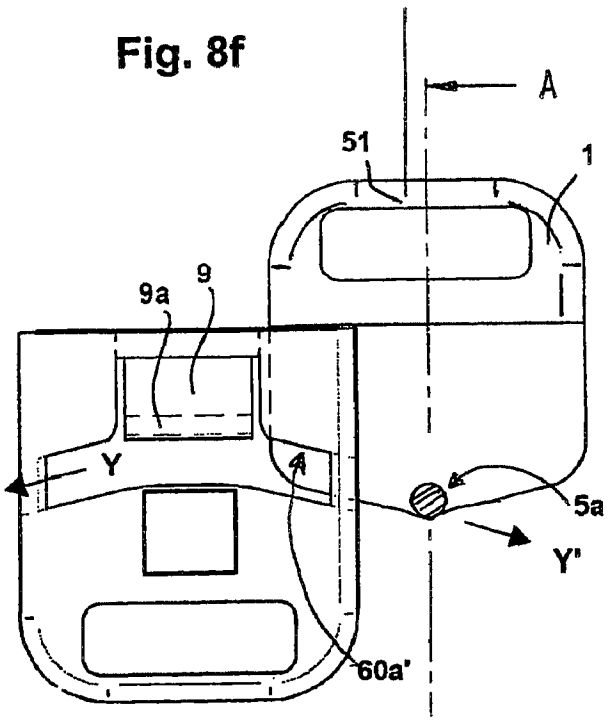
FIG. 8*d* shows the push-in/sliding buckle according to FIG. 8*a* after shifting in an open position.
FIG. 8*e* shows the push-in/sliding buckle according to FIG. 8*a* after shifting in an open position.
Figure 8D:
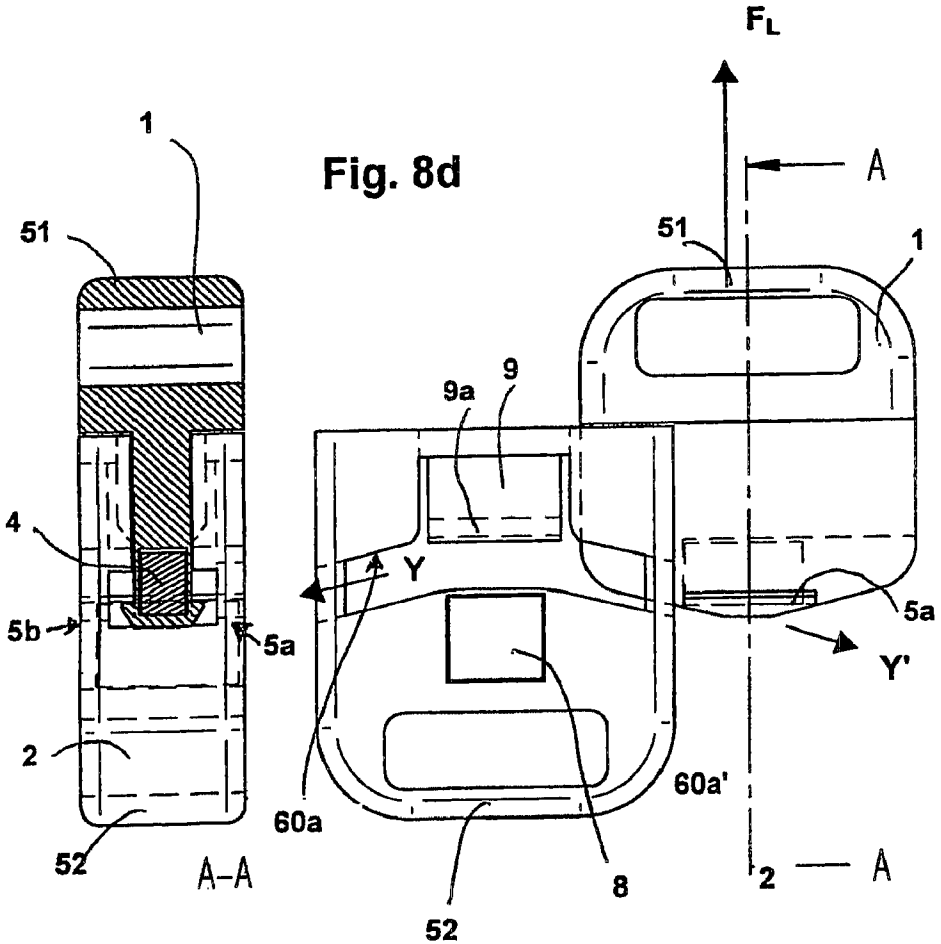
Figure 8E:
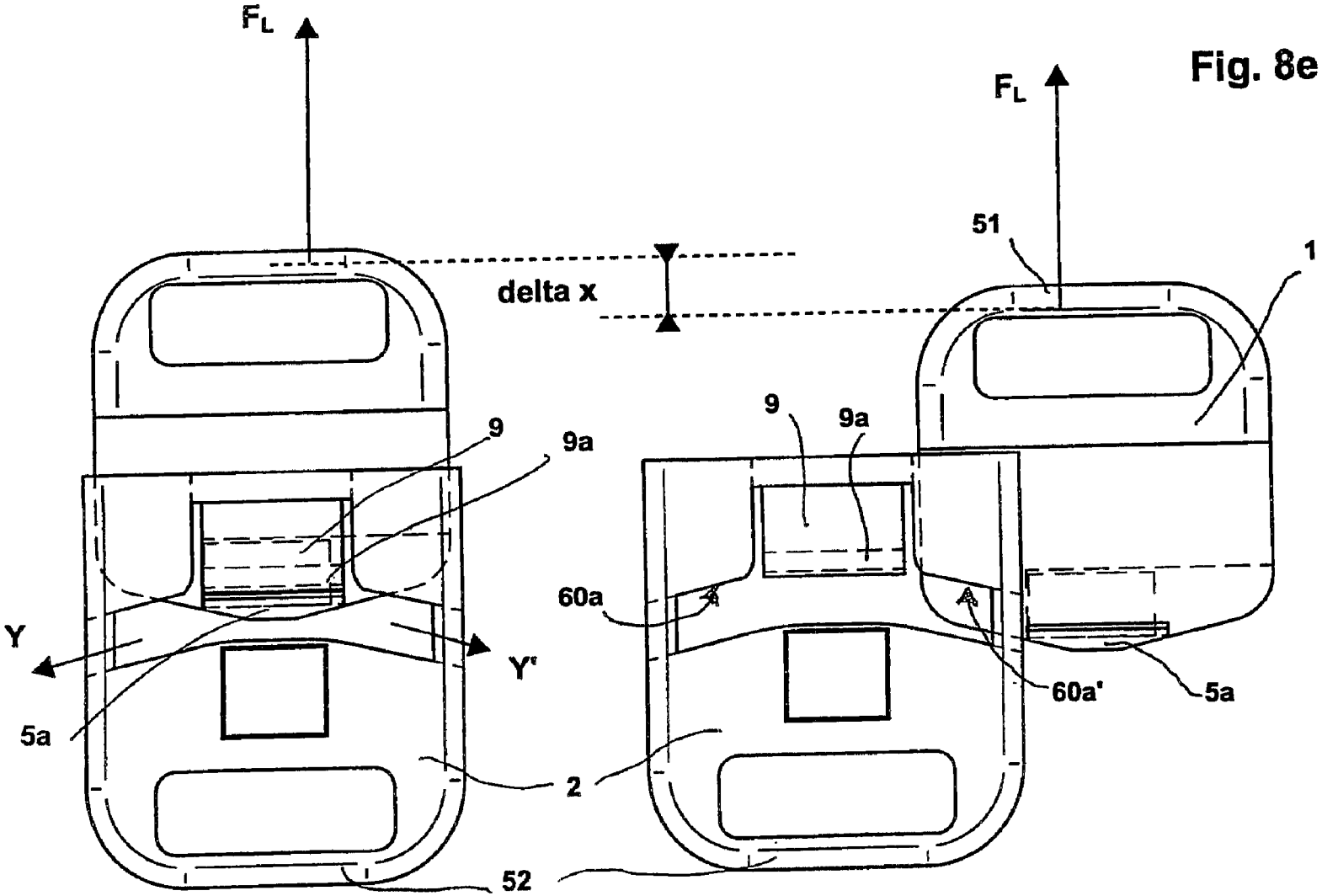

FIG. 8*d*, FIG. 8*e* and FIG. 8*f* shows the arc-shaped push-in/sliding buckle after shifting in an open position. By shifting, three functions have been effected:

- Magnet 4 and armature or second magnet 8 gradually were sheared off from each other, whereby a pleasant haptics is achieved, which subjectively hardly requires force.
- The locking pieces 5*a*, 5*b* and the spring locking elements 9, 9' were laterally shifted such that they came out of engagement, without the spring locking element 9, 9' having been pushed to the side, i.e. the snap-action closure has been opened without additional effort.
- The plug 1 has been shifted on the inclined movement track 60*a*' such that the belt webbing receptacle 51 was pulled against the load $F_L$ by am amount delta x.

The locking piece 5*a* is movable within the inclined movement track 60*a* or 60*a*'. In other words: Plug and housing are shifted against each other, but not guided exactly against each other, so that plug and housing can be swiveled against each other independent of the shape of the locking piece and of the movement track and can align depending on the applied force. FIG. 8*f* shows a variant with a round locking piece, which is movable particularly well in the movement track, so that plug and housing can be swiveled against each other.

FIG. 8*e* shows the delta x in a comparison of the closed position and the open position.

FIG. 9*a-e* each show a top view, a sectional view A-A and a perspective view of an inventive arc-shaped push-in/swivel buckle for belt webbings in the most important phases of movement during opening and closing The center of the circular-arc-shaped movement track 60*b* is shifted laterally to the side of the open position from the center position on the connecting line between the load housings 51, 52.

Figure 9A:
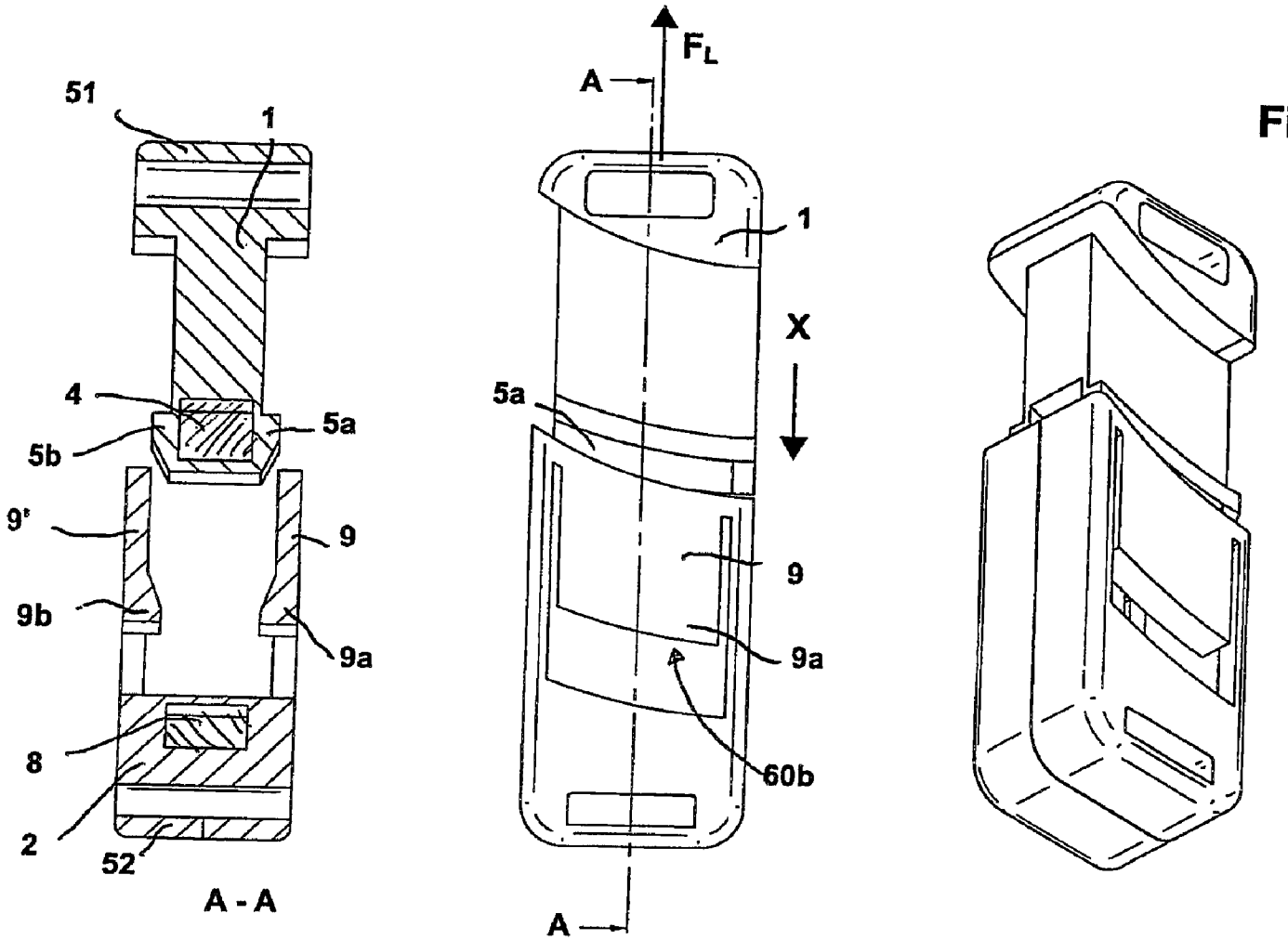
FIG. 9*a* shows a unilateral arc-shaped push-in/swivel buckle for belt webbings.

FIG. 9*a* shows the open, unilateral push-in/swivel buckle, comprising plug 1 and housing 2 with the belt webbing receptacles 51 and 52, wherein plug and housing face each other separately. Now, they are put together in direction X against the force $F_L$, which in use acts in direction of the connecting line between the belt webbing receptacles. In this Figure, this connecting line is identical with the cutting line A-A.

In the plug a magnet 4 is provided, and in the housing an armature or a second magnet 8 is provided. Due to the magnetic attraction, plug 1 and housing 2 are pulled together in direction X, and the magnetic force hence supports the closing under load.

Locking pieces 5*a*, 5*b* mounted on the plug and spring locking elements 9, 9' mounted on the housing together form a snap-action closure.

Figure 9B:
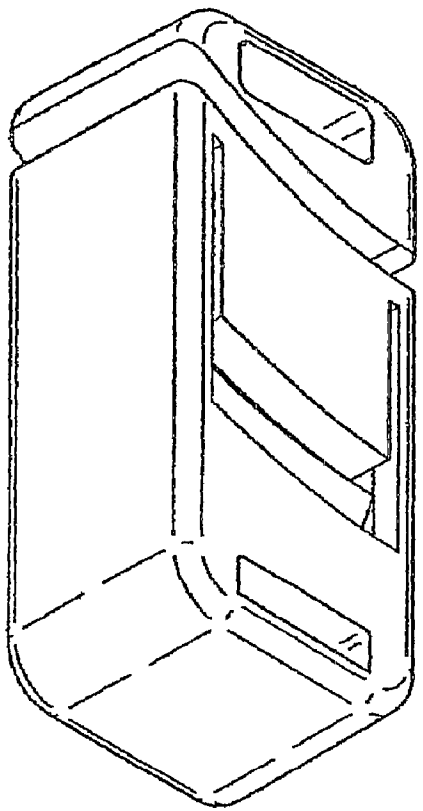
FIG. 9*b* shows the unilateral push-in/swivel buckle according to FIG. 9*a* when snapping into place.
Figure 9B:
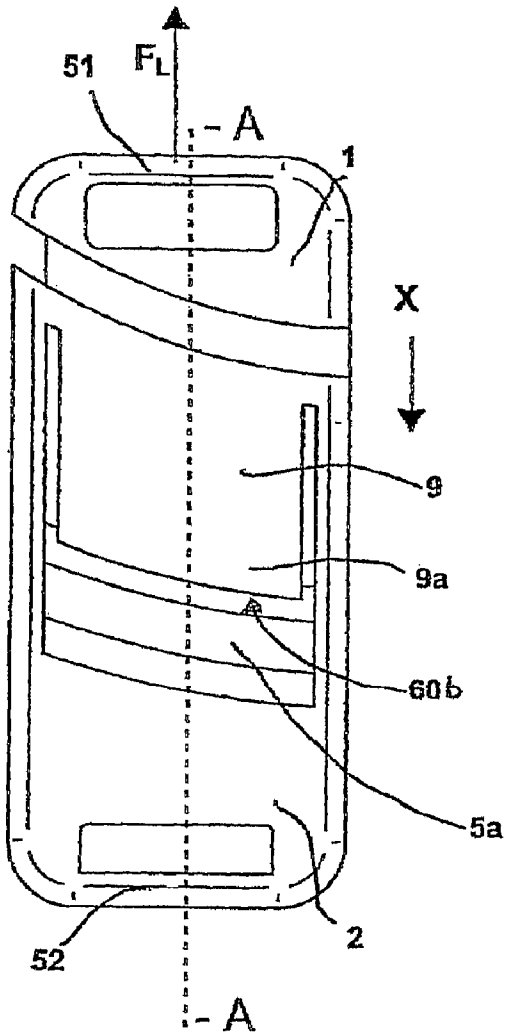
Figure 9B:
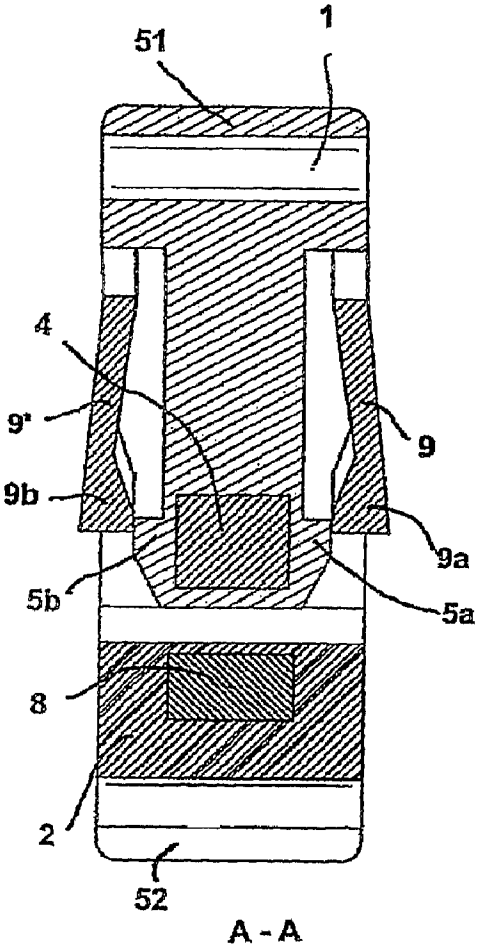

FIG. 9*b* shows the unilateral push-in/swivel buckle when snapping into place. The latching noses 9*a*, 9*b* of the spring locking elements are pushed to the side by the locking pieces against the spring force of the spring locking elements, until they snap into place.

Figure 9C:
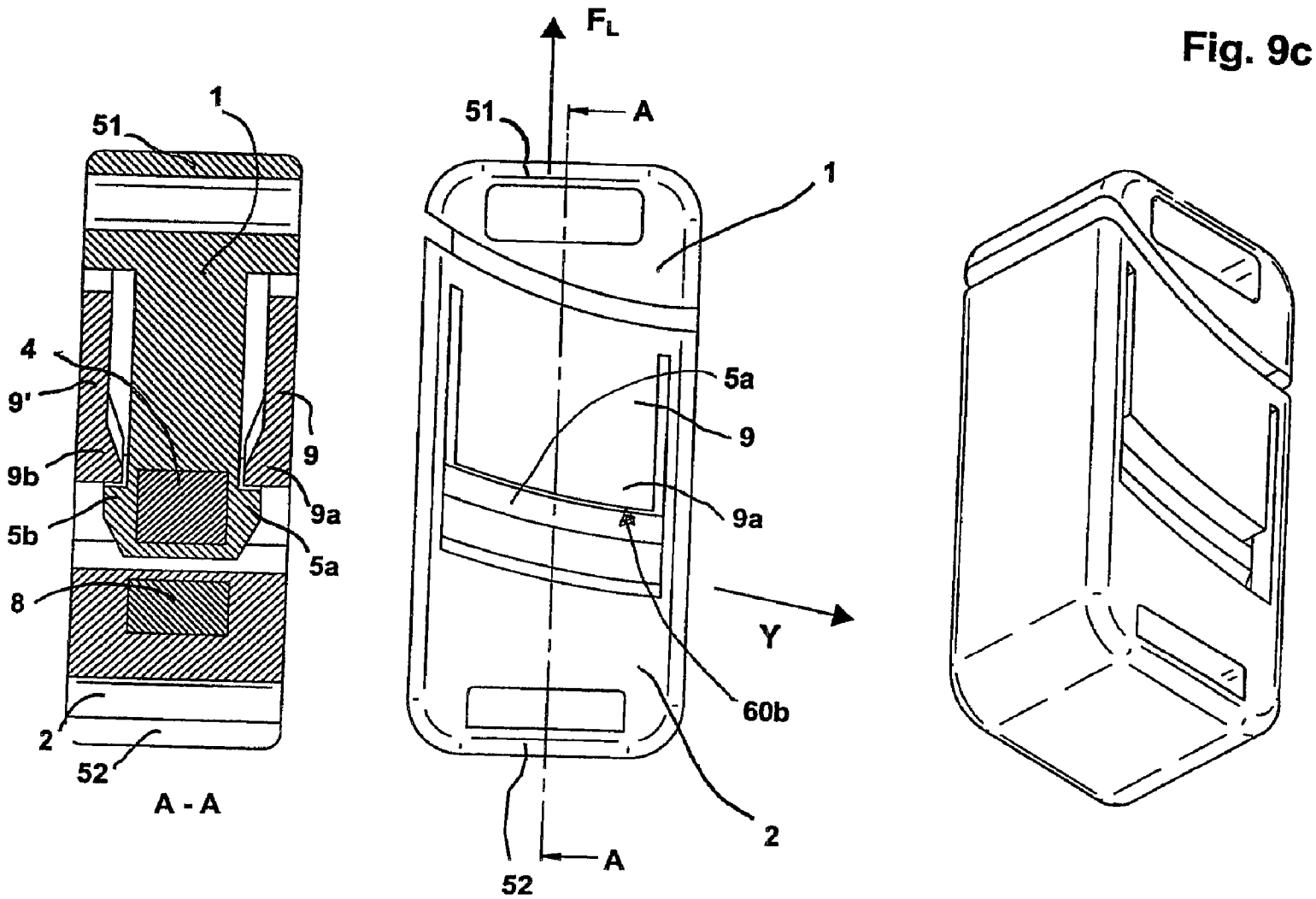
FIG. 9*c* shows the unilateral push-in/swivel buckle according to FIG. 9*a* after snapping into the closed position.

FIG. 9*c* shows the unilateral push-in/swivel buckle after snapping into the closed position. Next, the plug 1 is shifted for opening relative to the housing 2 on the circular-arc-shaped movement track 60*b* in an opening direction Y.

Figure 9D:
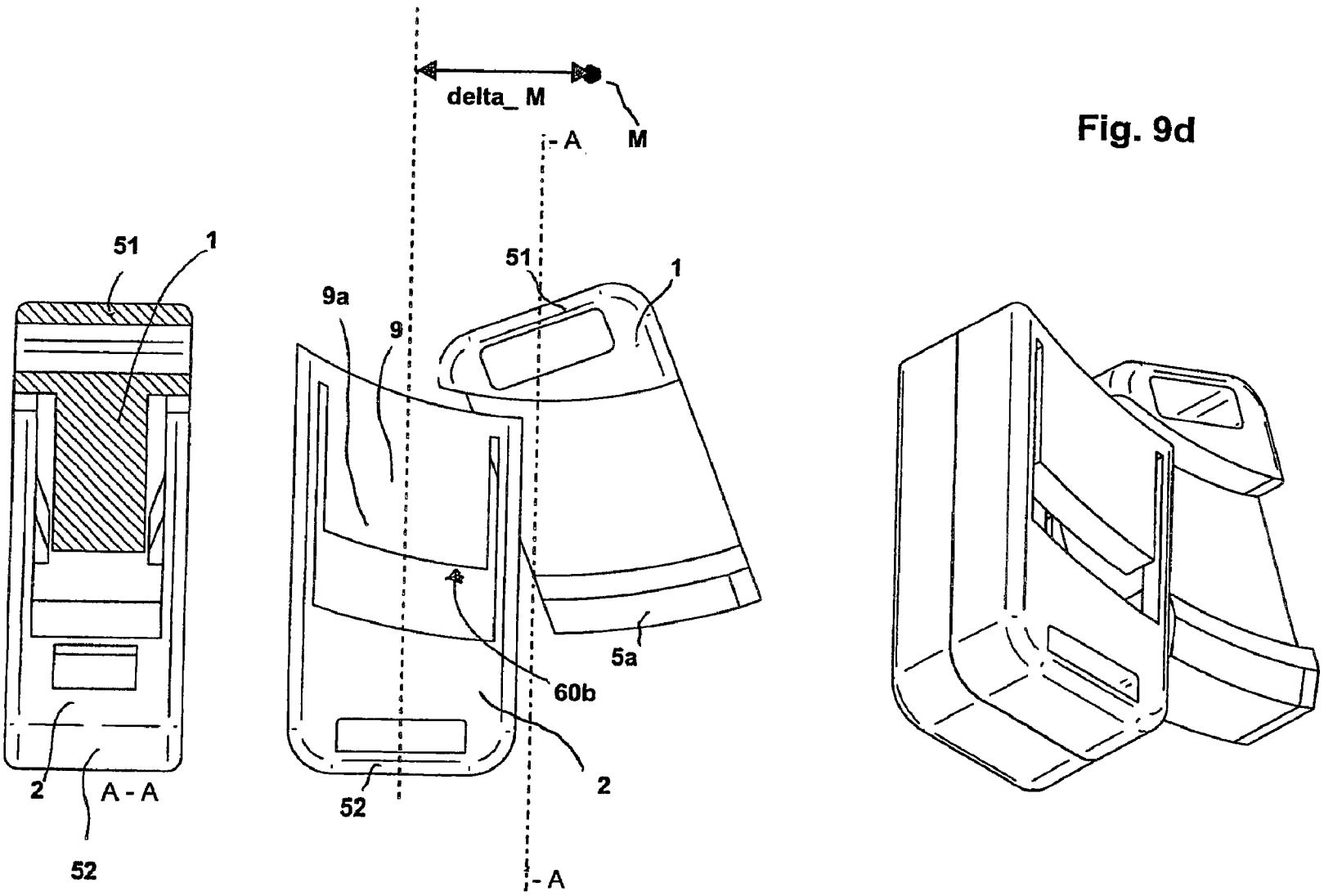
FIG. 9*d* shows the unilateral push-in/swivel buckle according to FIG. 9*a* after shifting into the open position.
Figure 9E:
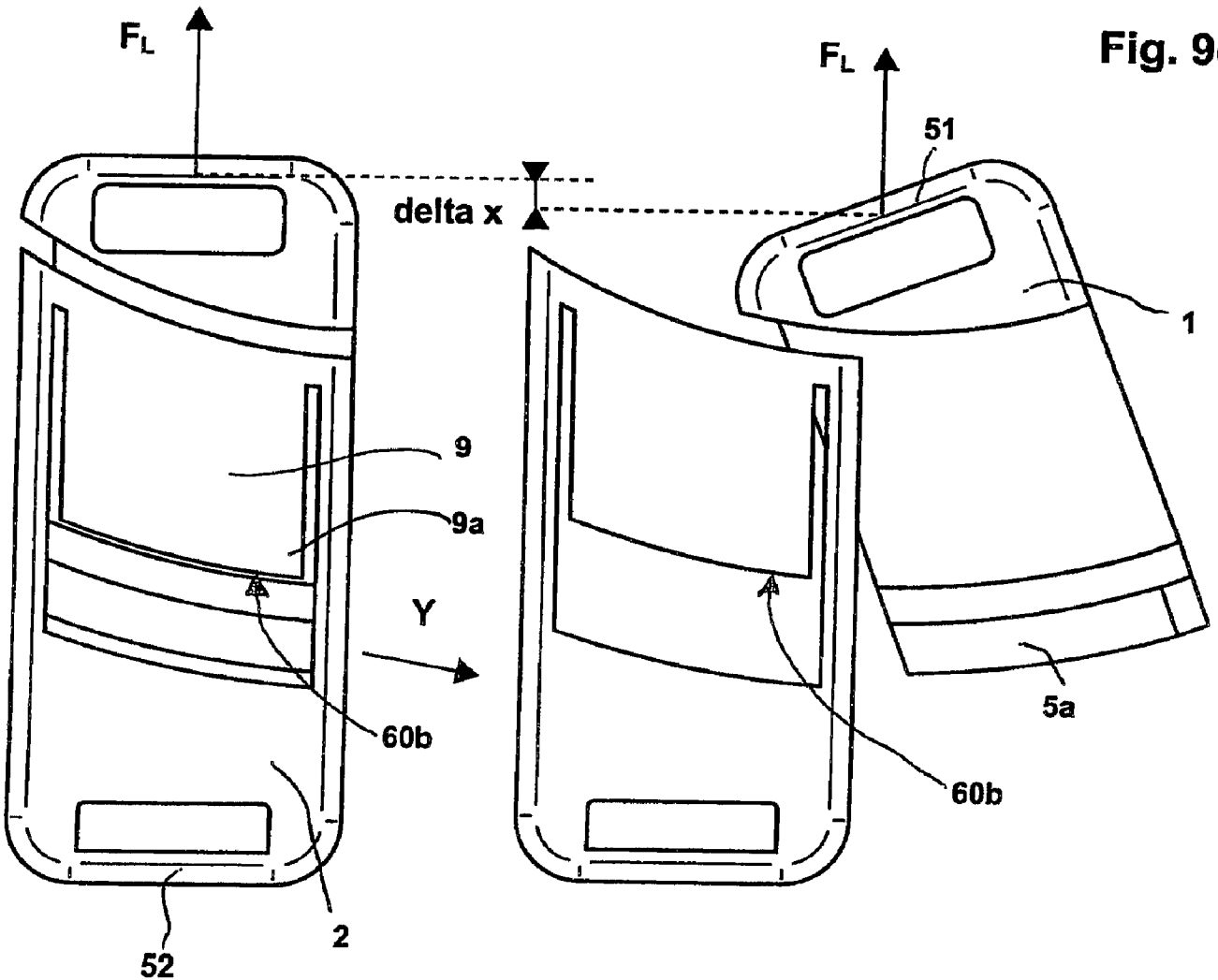
FIG. 9*e* shows the unilateral push-in/swivel buckle according to FIG. 9*a* after shifting into the open position.

FIG. 9*d* and FIG. 9*e* shows the unilateral push-in/swivel buckle after shifting into the open position. By shifting, three functions have been effected:

- Magnet 4 and armature or second magnet 8 gradually were sheared off from each other, whereby a pleasant haptics is achieved, which subjectively hardly requires force.
- The locking pieces 5*a*, 5*b* and the spring locking elements 9, 9' were laterally shifted such that they came out of engagement, without the spring locking element 9, 9' having been pushed to the side, i.e. the snap-action closure has been opened without additional effort.
- The plug 1 has been shifted on the circular-arc-shaped movement track 60*b* such that the belt webbing receptacle 51 was pulled against the load $F_L$ by an amount delta x.

FIG. 9*e* shows delta x in a comparison of the closed position and the open position.

The invention has been explained both with reference to schematic diagrams and with reference to construction drawings. The construction drawings show concrete products, whose structure and function have also been explained with respect to the schematic diagrams. Due to the multitude of the described embodiments it is clear that further variations and modifications of the invention exist, which the skilled person can find without having to perform an inventive activity, due to the disclosed technical teaching and in consideration of the individual embodiments.

In particular, it is clear to the skilled person that the closure of the invention can not only be used as a buckle for belts, but can also be connected with the object to be connected by sew-on, weld-on, snap-on or otherwise attachable fastening pieces. The closure can also directly be integrated in two objects to be connected. However, the load must chiefly act in direction of the connecting line of the load housings, in order to ensure securing of the load in accordance with the technical teaching of the invention.

It is clear to the skilled person that the curved tracks are not limited to exactly circular-arc-shaped tracks.

It is furthermore clear to the skilled person that a variety of non-illustrated combinations between the sub-claims are possible on the basis of the main claims. Finally, it is also clear to the skilled person that multipole magnetic systems comprising a plurality of magnets or armatures can also be used, which after shifting from the closed position into the open position effect a mutual repulsion of the connecting modules.

The invention claimed is:

1. A magnetomechanical connection assembly consisting of two connecting modules each including a load housing for connecting two elements, to each of which one of the connecting modules can be attached, wherein the connecting modules to be closed can be preloaded with a load $F_L$ which substantially acts in direction of a connecting line between the load housings, the connecting line being in the longitudinal direction of the connecting modules in attachment, and the connecting modules have the following features:

- a locking device with
  - a spring locking element which is arranged in the first connecting module, and
  - a locking piece which is arranged in the second connecting module, for positively locking the connecting modules,
- a magnet-armature construction with
  - a magnet which is arranged in one of the connecting modules, and
  - an armature or a second magnet, which is arranged in the other connecting module, and
  - a movement track in the first connecting module, on which the locking piece of the second connecting module can be shifted from a closed position into an open position, wherein the locking device, the magnet-armature construction and the movement track are operatively connected by the following features:

a. on opening, the connecting modules are shifted on the movement track from the closed position into the open position, wherein the magnet and the armature or the second magnet are shifted against each other, so that a gradual attenuation of the mutual attraction occurs, and b. on opening, the connecting modules are shifted on the movement track from the closed position into the open position, wherein the locking piece and the spring locking element are shifted against each other without urging the spring locking element to the side, until the spring locking element no longer is in engagement with the locking piece; and

- on closing, the connecting modules snap into the closed position by means of the locking device, wherein the locking piece pushes the spring locking element to the side against a spring force of the spring locking element until the spring locking element snaps into place; and c. on closing, the magnet-armature construction pulls the connecting modules towards each other, whereby the locking of the locking device is at least supported, wherein

- the position of the load housings on the connecting modules and
- the position and shape of the movement track are formed such that on shifting the connecting modules from the closed position into the open position the load housings are moved towards each other by an amount $\Delta x$ parallel with the connecting line and against the load $F_L$ when applied to the connecting modules, so that for opening the physical work $W=F_L \times \Delta x$ is required and thus the connection assembly is harder to open under the load $F_L$ than without the load $F_L$.

2. The magnetomechanical connection assembly according to claim 1, wherein the movement track is formed with an inclination, so that on shifting the connecting modules from the closed position into the open position the load housings move towards each other by an amount Δx against the load $F_L$ when applied to the connecting modules.

3. The magnetomechanical connection assembly according to claim 1, wherein the movement track is curved in the shape of a circular arc, has exactly one open position, and a center of the circularly curved movement track is laterally shifted from the connecting line between the load housings towards the side of the open position of the movement track, so that on shifting the connecting modules from the closed position into the open position the load housings move towards each other by an amount Δx against the load $F_L$ when applied to the connecting modules.

4. The magnetomechanical connection assembly according to claim 1, wherein the movement track is curved in the shape of a circular arc, wherein the load housing in the connecting module lies to one side of a center of the movement track, which center lies on the connecting line between the load housings, so that on shifting the connecting modules from the closed position into the open position the load housings move towards each other by an amount Δx against the load $F_L$ when applied to the connecting modules.

5. The magnetomechanical connection assembly according to claim 1, wherein the movement track has a closed position in a center and two open positions to the right and left thereof.

6. The magnetomechanical connection assembly according to claim 1, wherein the movement track is curved in the shape of a circular arc, wherein the load housing in the connecting module lies to one side of a center of the curvature, which center lies on the connecting line between the load housings, and to the load housing a rigid extension is attached, whose loaded end lies to the one side of the center of the curvature, so that on shifting the connecting modules from the closed position into the open position the loaded end and the load housing move towards each other by an amount Δx against the load $F_L$ when applied to the connecting modules.

7. The magnetomechanical connection assembly according to claim 1, wherein the locking piece and the movement track are formed with such a shape and size that during shifting the locking piece is guided on the movement track.

8. The magnetomechanical connection assembly according to claim 1, wherein the locking piece and the movement track are formed with such a shape and size that the connecting modules can be swiveled against each other.

9. The magnetomechanical connection assembly according to claim 1, wherein the magnet and the armature or the second magnet are arranged and dimensioned such that the magnetic force automatically pulls the spring locking element and the locking piece together, unless the load $F_L$ when applied to the connecting modules acts when snapping into place.

10. The magnetomechanical connection assembly according to claim 1, wherein the magnet and the armature or second magnet are arranged with an offset such that in the closed position the magnetic force produces a restoring force, which effects an automatic return of the connecting modules into the closed position.

11. A magnetomechanical connection assembly consisting of two connecting modules each including a load housing for connecting two elements, to each of which one of the connecting modules can be attached, wherein the connecting modules to be closed can be preloaded with a load $F_L$ which substantially acts in direction of a connecting line between the load housings, the connecting line being in the longitudinal direction of the connecting modules in attachment, and the connecting modules have the following features:

a locking device with

- a spring locking element which is arranged in the first connecting module, and
- a locking piece which is arranged in the second connecting module, for positively locking the connecting modules,
- a force-deflecting bevel which likewise is arranged in the other connecting one of the connecting modules, a magnet-armature construction with

- a magnet which is arranged in one of the connecting modules, and
- an armature or a second magnet, which is arranged in the other connecting module, and
- a movement track in the first connecting module, on which the locking piece of the second connecting module can be shifted from a closed position into an open position, wherein the locking device, the magnet-armature construction and the movement track are operatively connected by the following features:

a. on opening, the connecting modules are shifted on the movement track from the closed position into the open position, wherein the magnet and the armature or the second magnet are shifted against each other, so that a gradual attenuation of the mutual attraction occurs, and b. on opening, the connecting modules are shifted on the movement track from the closed position into the open position, wherein the spring locking element is pushed to the side by the force-deflecting bevel, until the spring locking element no longer is in engagement with the locking piece; and on closing, the connecting modules snap into the closed position by means of the locking device, wherein the locking piece pushes the spring locking element to the side against a spring force of the spring locking element, until the spring locking element snaps into place; and c. on closing, the magnet-armature construction pulls the connecting modules towards each other, whereby the locking of the locking device is at least supported, wherein

- the position of the load housings on the connecting modules and
- the position and shape of the movement track are formed such that on shifting the connecting modules from the closed position into the open position the load housings are moved towards each other by an amount Δx parallel with the connecting line and against the load $F_L$ when applied to the connecting modules, so that for opening the physical work $W=F_L \times \Delta x$ is necessary and thus the connection assembly is harder to open under the load $F_L$ than without the load $F_L$.

12. The magnetomechanical connection assembly according to claim 11, wherein the movement track is formed with an inclination, so that on shifting the connecting modules from the closed position into the open position the load housings move towards each other by an amount Δx against the load $F_L$ when applied to the connecting modules.

13. The magnetomechanical connection assembly according to claim 11, wherein the movement track is curved in the shape of a circular arc, has exactly one open position, and the center of the circularly curved movement track is laterally shifted from the connecting line between the load housings towards the side of the open position of the movement track, so that on shifting the connecting modules from the closed position into the open position the load housings move towards each other by an amount Δx against the load $F_L$ when applied to the connecting modules.

14. The magnetomechanical connection assembly according to claim 11, wherein the movement track is curved in the shape of a circular arc, wherein the load housing in the connecting module lies to one side of a center of the movement track, which center lies on the connecting line between the load housings, so that on shifting the connecting modules from the closed position into the open position the load housings move towards each other by an amount $\Delta x$ against the load $F_L$ when applied to the connecting modules.

15. The magnetomechanical connection assembly according to claim 11, wherein the movement track has a closed position in the center and two open positions to the right and left thereof.

16. The magnetomechanical connection assembly according to claim 11, wherein the movement track is curved in the shape of a circular arc, wherein the load housing in the connecting module lies to one side of a center of the curvature, which center lies on the connecting line between the load housings, and to the load housing a rigid extension is attached, whose loaded end lies to the one side of the center of the curvature, so that on shifting the connecting modules from the closed position into the open position the loaded end and the load housing move towards each other by an amount $\Delta x$ against the load $F_L$ when applied to the connecting modules.

17. The magnetomechanical connection assembly according to claim 11, wherein the locking piece and the movement track are formed with such a shape and size that during shifting the locking piece is guided on the movement track.

18. The magnetomechanical connection assembly according to claim 11, wherein the locking piece and the movement track are formed with such a shape and size that the connecting modules can be swiveled against each other.

19. The magnetomechanical connection assembly according to claim 11, wherein the magnet and the armature or the second magnet are arranged and dimensioned such that the magnetic force automatically pulls the spring locking element and the locking piece together, unless the load $F_L$ when applied to the connecting modules acts when snapping into place.

20. The magnetomechanical connection assembly according to claim 11, wherein the magnet and the keeper or second magnet are arranged with an offset such that in the closed position the magnetic force produces a restoring force, which effects an automatic return of the connecting modules into the closed position.

* * * * *

UNITED STATES PATENT AND TRADEMARK OFFICE

CERTIFICATE OF CORRECTION

PATENT NO. : 8,359,716 B2
APPLICATION NO. : 12/918440
DATED : January 29, 2013
INVENTOR(S) : Joachim Fiedler It is certified that error appears in the above-identified patent and that said Letters Patent is hereby corrected as shown below:

Column 18, Line 10, Claim 11, after "in" delete "the other connecting"

Column 18, Line 35, Claim 11, after "element" delete ","

Signed and Sealed this
Ninth Day of April, 2013

Teresa Stanek Rea
*Acting Director of the United States Patent and Trademark Office*